US005250382A

United States Patent [19]

Shimojo et al.

[11] Patent Number: 5,250,382

[45] Date of Patent: Oct. 5, 1993

[54] TONER FOR DEVELOPING ELECTROSTATIC IMAGE, AND IMAGE FIXING METHOD

[75] Inventors: Minoru Shimojo, Tokyo; Takaaki Kohtaki; Tsuyoshi Takiguchi, both of Yokohama, all of Japan

[73] Assignee: Canon Kabushiki Kaisha, Tokyo, Japan

[21] Appl. No.: 813,677

[22] Filed: Dec. 26, 1991

[30] Foreign Application Priority Data

| | | | |
|---|---|---|---|
| Dec. 25, 1990 | [JP] | Japan | 2-412967 |
| Dec. 25, 1990 | [JP] | Japan | 2-412968 |
| Jan. 16, 1991 | [JP] | Japan | 3-014921 |
| Jan. 21, 1991 | [JP] | Japan | 3-019198 |
| Jan. 21, 1991 | [JP] | Japan | 3-019199 |
| Jan. 30, 1991 | [JP] | Japan | 3-027772 |
| Jun. 13, 1991 | [JP] | Japan | 3-167386 |
| Jun. 13, 1991 | [JP] | Japan | 3-167388 |

[51] Int. Cl.[5] ..... G03G 9/087

[52] U.S. Cl. ..... 430/109; 430/99

[58] Field of Search ..... 430/109, 110, 96, 99; 524/505, 513

[56] References Cited

U.S. PATENT DOCUMENTS

| | | | |
|---|---|---|---|
| 2,297,691 | 10/1942 | Carlson | 95/5 |
| 4,820,763 | 4/1989 | Yang | 524/505 |
| 4,925,765 | 5/1990 | Madeline | 430/110 |
| 4,988,794 | 1/1991 | Kubo et al. | 430/109 |
| 5,089,544 | 2/1992 | Ross et al. | 524/513 |

FOREIGN PATENT DOCUMENTS

| | | |
|---|---|---|
| 42-23910 | 11/1967 | Japan . |
| 43-24748 | 10/1968 | Japan . |
| 52-3304 | 1/1977 | Japan . |
| 52-3305 | 1/1977 | Japan . |
| 56-158340 | 12/1981 | Japan . |
| 56-159340 | 12/1981 | Japan . |
| 57-52574 | 11/1982 | Japan . |
| 58-14148 | 1/1983 | Japan . |
| 58-8505 | 2/1983 | Japan . |
| 58-72948 | 5/1983 | Japan . |
| 58-86558 | 5/1983 | Japan . |
| 58-106552 | 6/1983 | Japan . |
| 58-43740 | 9/1983 | Japan . |
| 58-203453 | 11/1983 | Japan . |
| 59-88748 | 5/1984 | Japan . |
| 59-174855 | 10/1984 | Japan . |
| 59-174856 | 10/1984 | Japan . |
| 59-50060 | 12/1984 | Japan . |
| 60-2411 | 1/1985 | Japan . |
| 60-45259 | 3/1985 | Japan . |
| 60-45261 | 3/1985 | Japan . |
| 60-46566 | 3/1985 | Japan . |
| 60-123855 | 7/1985 | Japan . |
| 61-89845 | 5/1986 | Japan . |
| 63-214760 | 9/1988 | Japan . |
| 63-217360 | 9/1988 | Japan . |
| 63-217361 | 9/1988 | Japan . |
| 63-217362 | 9/1988 | Japan . |
| 63-217363 | 9/1988 | Japan . |
| 1-204061 | 8/1989 | Japan . |

*Primary Examiner*—John Goodrow

*Attorney, Agent, or Firm*—Fitzpatrick, Cella, Harper & Scinto

[57] ABSTRACT

A toner for developing an electrostatic image has toner particles containing i) a binder resin comprising a resin composition with a domain-matrix structure and ii) a colorant.

The resin composition with a domain-matrix a structure is comprised of a resin P1 that forms domain particles and a resin P2 that forms a matrix. The resin P1 has a glass transition temperature Tg1 of from 0° C. to 60° C., and the resin P2 has a glass transition temperature Tg2 of from 40° C. to 90° C. The glass transition temperature Tg2 of the resin P2 is at least 5° C. higher than the glass transition temperature Tg1 of the resin P1, and the domain particles having an average particle diameter of not larger than 5 μm.

79 Claims, 6 Drawing Sheets

TONER FOR DEVELOPING ELECTROSTATIC IMAGE, AND IMAGE FIXING METHOD

BACKGROUND OF THE INVENTION

1. Field of the invention

The present invention relates to a toner for forming an image by developing an electrostatic image, as in electrophotography, electrostatic recording or electrostatic printing. It also relates to a toner image fixing method and an image forming apparatus that make use of the toner, and a resin composition.

2. Related Background Art

A number of methods as disclosed in U.S. Pat. No. 2,297,691, Japanese Patent Publications No. 42-23910 and No. 43-24748 and so forth are conventionally known for electrophotography. In general, copies are obtained by forming an electrostatic latent image on a photosensitive member by utilizing a photoconductive material and by various means, subsequently developing the latent image by the use of a toner, and transferring the toner image to a transfer medium such as paper if necessary, followed by fixing by the action of heat, pressure or solvent vapor.

Various methods or techniques have been developed in relation to the above final step, i.e., the step of fixing the toner image to a sheet such as paper. A method most commonly available at present is the pressure heating system making use of a heating roller.

The pressure heating system making use of a heating roller is a method of carrying out fixing by causing an image-receiving sheet to pass over a heating roller whose surface is formed of a material having a releasability to toner while a toner image surface of the former is brought into contact with the surface of the latter under application of a pressure. Since in this method the surface of the heating roller comes into contact with the toner image of the image-receiving sheet under application of a pressure, a very good thermal efficiency can be achieved when the toner image is melt-adhered onto the image-receiving sheet, so that fixing can be carried out rapidly. This method is therefore very effective in high-speed electrophotographic copying machines. In this method, however, since the surface of the heating roller comes into contact with the toner image under application of a pressure, part of the toner image may sometimes adhere and transfer to the surface of the fixing roller, which may re-transfer to the subsequent image-receiving sheet to cause an offset phenomenon, resulting in a contamination of the image-receiving sheet. Thus, it is essential in the heating roller fixing system that no toner is adhered to the surface of the heat fixing roller.

Accordingly, under existing circumstances, it is sought to provide a binder resin for toner, having a broad fixing temperature range and high anti-offset properties.

Research has been conducted regarding two-color copying machines or full-color copying machines, and many of which have been put into practical use. For example, Journal of Electrophotographic Society, Vol. 22, No. 1 (1983) and Journal of Electrophotographic Society, Vol. 25, No. 1, p. 52 (1986) make reports on color reproduction and gradation reproduction.

However, images formed by full-color electrophotography presently put into practical use are not necessarily satisfactory to those who are accustomed to seeing color images that are not directly compared with actual things or objects as in television pictures, photographs and color gravures or that are made artificially more beautiful than actual things.

In the formation of color images by full-color electrophotography, all colors are reproduced usually using three-color toners of yellow, magenta and cyan corresponding to the three primary colors, or four-color toners in which a black toner is used in addition to the three-color toners. In a method commonly used therefor, first, light reflecting from an original is passed through a filter capable of transmitting color-separated light that stands in a relation of a complementary color with respect to the color of a toner, and an electrostatic latent image is formed on a photoconductive layer. Next, a toner image is formed on a support (an image-receiving medium) through development and transfer steps. Subsequently, the above procedure is successively repeated plural times so that the subsequent toner images are superposed on one another on the same support while in proper registration, and thus a final full-color image is obtained through a fixing step.

In the full-color electrophotography, development is carried out plural times using plural kinds of toners with different colors, and toner layers are superposed on the same support to form a full-color image. For this reason, binder resins used for color toners are required to satisfy conditions as itemized below.

(1) Fixed toner must be brought into an almost perfectly molten state such that the form of toner particles can not be distinguished, in order that the fixed toner not cause irregular reflection of light to hinder color reproduction.

(2) Since the toner layers are superposed, the binder resin must be transparent so that a different color tone present on a lower toner layer has is not affected.

As stated above, when used in monochrome copying machines, binder resins used for toner are required to give a broad fixing temperature range and high anti-offset properties. When used in full-color copying machines, binder resins are required not only to have a broad fixing temperature range but also to be transparent and to give a flat image surface when images are fixed.

The transparency of resin and flatness of fixed-image surface as stated above have a great influence on image quality not only in the case when the toner image is fixed on a non-light-transmissive transfer medium such as paper and the image reflected therefrom is viewed but also in the case when the toner image is fixed On a light-transmissive transfer medium such as an OHP sheet and the transmitted light image is viewed on a screen.

Moreover, in recent years, in the field ranging from monochrome copying machines to full-color copying machines, a variety of features is required, e.g., to take copies at higher speed, to shorten the heat-up time and to decrease power consumption.

In order to satisfy these requirements, it is necessary to provide a binder resin for a toner that enables low-temperature fixing, and also, which as stated above, can give a broad fixing temperature range, has an excellent transparency, and can give a flat image surface when images are fixed.

Meanwhile, one may contemplate a method making use of pressure fixing toners. In this method, the binder resin can not melt when the toners are used as toners for full colors in which three or four colors are superposed to effect color reproduction, so that color-mixing performance becomes poor to give a dull, chroma-poor image. Hence, in the fixing step, a heat must be applied to the extent the binder resin can melt and achieve color mixture.

Only for the purpose of achieving low-temperature fixing, it is possible to decrease melt viscosity of binder resins for the toner. For example, there is a method in which the molecular weight of resin or glass transition point thereof is lowered. This method, however, may result in a poor storage stability of toner to tend to cause phenomena such as blocking between toners and melt-adhesion of toner to a developing drum.

Hitherto, for the purpose of expanding the fixing temperature range of vinyl polymers, methods in which an anti-offset agent is used are disclosed in Japanese Patent Applications Laid-open No. 58-14148, No. 58-72948, No. 59-174855, No. 59-174856 and No. 60-123855, and Japanese Patent Publications No. 52-3304, No. 52-3305, No. 57-52574 and No. 58-8505. These, however, are supplementary means, and may damage the transparency of toner when applied in monochrome toners or may bring about a poor color mixing performance when applied in full-color toners.

Japanese Patent Applications Laid-open No. 56-158340, No. 58-86558, No. 58-203453, No. 59-88748, No. 59-226358, No. 60-45259, No. 60-45261 and No. 60-46566 and Japanese Patent Publication No. 60-2411 disclose binder resins for toner that have a low-molecular weight component and a high-molecular weight component. Use of such resins has made it possible to expand the fixing temperature range to a certain extent, but on the other hand causes the problem that grindability is lowered or melt viscosity becomes excessively high at the time of heat kneading, because of the presence of high-molecular weight components such as gels. Particularly when such binders are used in full-color toners, there is the problem that the smoothness of image surfaces when images are fixed is damaged, resulting in a poor color mixing performance.

U.S. Pat. No. 4,925,765 discloses a negative solid block toner wherein an AB type, BAB type or ABA type block copolymer is used as a charge control agent.

In this block copolymer, a copolymer comprising acrylic monomers or a copolymer comprising methacrylic monomers is used as segment-A and a copolymer comprising monomers selected from the group consisting of styrene, a substituted styrene, butadiene, and an acrylate and/or a methacrylate as segment-B.

It can be presumed that use of such a block copolymer as a binder resin for toner causes the problems that the grindability in the preparation of toner becomes poor to make particle size distribution broad and also the environmental stability of toner becomes poor, because of the segment-A which is an acrylic copolymer or methacrylic copolymer.

Thus, it is very difficult to satisfy at the same time carrying out fixing at a low temperature, expanding the fixing temperature range and ensuring the properties of toner, i.e., storage stability, fluidity, durability, transparency, and smoothness of fixed-image surface.

As for fixing rollers, they can be roughly grouped into a silicone rubber roller and a fluorine type roller.

When the silicone rubber roller is used as a fixing roller, a high-temperature offset tends to occur as a result of its repeated use regardless of whether or not a release oil has been applied. In the case of the silicone rubber roller, the release properties can be maintained to a certain extent since the smoothness or cleanness of the roller surface is not damaged at the initial stage where its use is started. However, repetition of full-color copying in which, as in the case of full-color images, image areas are larger and toners are held on the support in a much greater quantity than in the case of black and white images may result in a gradual lowering of the release properties of the roller surface. The degree of this lowering of release properties is several times that in black and white copying. This may cause what is called a high-temperature offset, which is a phenomenon in which a coating of toner or granular deposits are formed on the roller surface after full-color copies are made for only several thousand to several ten thousand sheets or an upper layer portion of an image surface is torn off when a full-color image is passed through a heat roller.

The fluorine type roller has in general a good durability, but tends to undergo a stretching because of pressure, thus having disadvantages such that it causes a lowering of resolution in copied images and causes conspicuous background staining. In order to eliminate such disadvantages, there is a disclosure (Japanese Patent Publication No. 58-43740) of a roller comprising a rubber covered thereon with a PFA (perfluoroalkoxyl resin) tube of 300 to 100 μm thick. Use of such a roller can better prevent the resolution of copied images from being lowered because of the spread of toner under pressure.

In general, however, when the fluorine type roller is used as a fixing roller, a pressure roller is used which comprises a mandrel whose periphery is covered with a relatively thick, elastic material layer of rubber or the like, as disclosed by the present applicant in Japanese Patent Application Laid-open No. 61-89845.

In such an instance, as shown in FIG. 5, the paper output from a fixing roller after fixing of an image is in the direction inclined toward the fixing roller side with respect to the direction perpendicular to a line connecting the centers of a fixing roller 11 and a pressure roller 12.

Hence, the fixed image, even after it has passed the nip portion at which the fixing roller and pressure roller come into contact with each other is pulled along the fixing roller to cause what is called a "winding" phenomenon, so that the offset occurs. In order to prevent this phenomenon, a method is available in which a separation claw for paper output is provided. This separation claw, however, is in contact with the fixing roller, and hence may scratch the roller or may make a streak on the image surface, resulting in a serious lowering of image quality particularly in the full-color copying of photographs with wide image areas.

To solve or make small this problem, various measures have been attempted in fixing devices and toners, but no satisfactory solution can be said to have been achieved.

In the fixing devices or apparatus, materials with excellent surface release properties are used. It has been also known to apply an oil to the roller. In almost all heat-roller fixing devices presently put on the market, oil is applied anyway. However, application of oil in a large quantity for the purpose of improving release properties has caused undesirable problems such as oil contamination of copy sheets and an increase in cost.

From an approach from the toners, a method is taken in which a polyethylene or wax with a molecular weight low enough to be well melted when heated is added so that the release properties can be improved. This method can be effective for preventing offset, but on the other hand its addition in a large quantity may bring about undesired influences such that the transparency of OHP images of full-color toner is damaged, the static charge characteristics become unstable and the durability is lowered. Thus it is hard to say that this method is satisfactory.

In particular, as a problem peculiar to the full-color copying, the colors of toners of at least three colors, preferably four colors must be harmoneously balanced, and hence all the colors must be well balanced in respect of fixing performance or color reproducibility.

In theory, almost all colors could be reproduced by the subtractive color process if there are the three primary colors, the yellow, magenta and cyan colors. For this reason, presently commercially available full-color copying machines are so constituted that color toner images of the three primary colors are superposingly used. This ideally should enable achievement of the reproduction of all colors in all density ranges, but, in practice, more improvements must be made in some ways such as spectral reflection properties of toners, color mixture performance required when toner images are superposingly fixed, and prevention of a lowering of chroma.

When a black color is obtained by superposing the three colors, it follows that, as previously stated, toner layers three times thicker than a monochrome layer are formed on a transfer sheet, bringing about more difficulties in respect of anti-offset properties.

SUMMARY OF THE INVENTION

An object of the present invention is to provide a toner for developing an electrostatic image, having solved the above problems; and an image fixing method, en image forming apparatus and a resin composition.

Another object of the present invention is to provide a toner for developing an electrostatic image, capable of achieving low-temperature fixing and having a broad fixing temperature range; and an image fixing method, an image forming apparatus and a resin composition.

Still another object of the present invention is to provide a toner for developing an electrostatic image, having a good storage stability and fluidity, causing no agglomeration and also having an excellent impact resistance; and an image fixing method, an image forming apparatus and a resin composition.

A further object of the present invention is to provide a toner for developing an electrostatic image, having good static charge properties, having an always stable chargeability during its use and capable of giving a sharp and fog-free image; and an image fixing method, an image forming apparatus and a resin composition.

A still further object of the present invention is to provide a toner for developing an electrostatic image, capable of forming a smooth fixed-image surface so that the fixed toner image does not cause irregular reflection Of light to hinder color reproduction, when used in full-color toners; and an image fixing method, an image forming apparatus and a resin composition.

A still further object of the present invention is to provide a toner for developing an electrostatic image, capable of obtaining a full-color image having color-mixing properties that do not affect a lower toner layer having a different color tone, when used in full-color toners; and an image fixing method, an image forming apparatus and a resin composition.

A still further object of the present invention is to provide an image fixing method capable of well preventing high-temperature offset an operable at a broad fixing temperature range.

A still further object of the present invention is to provide an image fixing method capable of maintaining anti-offset properties throughout repeated paper feed for fixing.

The objects of the present invention can be achieved by a toner for developing an electrostatic image, comprising toner particles containing i) a binder resin comprising a resin composition with a domain-matrix structure and ii) a colorant;

said resin composition with a domain-matrix structure being comprised of a resin P1 that forms domain particles and a resin P2 that forms a matrix; said resin P1 having a glass transition temperature Tg1 of from 0° C. to 60° C., and said resin P2 having a glass transition temperature Tg2 of from 40° C. to 90° C., provided that the glass transition temperature Tg2 of said resin P2 is at least 5° C. higher than the glass transition temperature Tg1 of said resin P1 and said domain particles having an average particle diameter of not larger than 5 μm.

The objects of the present invention can also be achieved by an image fixing method comprising passing a transfer medium bearing a toner image, through a heat-roller fixing device comprised of a fixing roller and a pressure roller each having a rubbery elastic material layer formed on a mandrel, to fix said toner image to said transfer medium, and outputting said transfer medium in the direction inclined toward the pressure roller side with respect to the direction perpendicular to a line connecting the centers of said fixing roller and said pressure roller, wherein said toner for forming the toner image comprises toner particles containing i) a binder resin comprising a resin composition with a domain-matrix structure and ii) a colorant;

said resin composition with a domain-matrix structure being comprised of a resin P1 that forms domain particles and a resin P2 that forms a matrix; said resin P1 having a glass transition temperature Tg1 of from 0° C. to 60° C., and said resin P2 having a glass transition temperature Tg2 of from 40° C. to 90° C., provided that the glass transition temperature Tg2 of said resin P2 is at least 5° C. higher than the glass transition temperature Tg1 of said resin P1; and said domain particles having an average particle diameter of not larger than 5 μm.

The objects of the present invention can also be achieved by an image forming apparatus comprising;

- a latent image bearing member capable of bearing an electrostatic latent image;
- a charging means for statically charging said latent image bearing member;
- a latent image forming means for forming an electrostatic latent image on the latent image bearing member having been statically charged;
- a developing means for developing said electrostatic latent image to form a toner image on said latent image bearing member;
- a transfer means for transferring said toner image to a transfer medium from said latent image bearing member;
- a cleaning means for cleaning the surface of said latent image bearing member to remove toner remaining thereon untransferred; and a fixing means for fixing the toner image transferred to said transfer medium by the action of heat and pressure; wherein;

said developing means retains a toner comprising toner particles containing i) a binder resin comprising a resin composition with a domain-matrix structure and ii) a colorant:

said resin composition with a domain matrix structure being comprised of a resin P1 that forms domain particles and a resin P2 that forms a matrix: said resin P1 having a glass transition temperature Tg1 of from 0° C. to 60° C., and said resin P2 having a glass transition temperature Tg2 of from 40° C. to 90° C., provided that the glass transition temperature Tg2 of said resin P2 is at least 5° C. higher than the glass transition temperature Tg1 of said resin P1; and said domain particles having an average particle diameter of not larger than 5 μm.

The objects of the present invention can also be achieved by a resin composition having a domain-matrix structure, comprising a resin P1 that forms domain particles and a resin P2 that forms a matrix: said resin P1 having a glass transition temperature Tg1 of from 0° C. to 60° C., and said resin P2 having a glass transition temperature Tg2 of from 40° C. to 90° C., provided that the glass transition temperature Tg2 of said resin P2 is at least 5° C. higher than the glass transition temperature Tg1 of said resin P1 and said domain particles having an average particle diameter of not larger than 5 μm.

DESCRIPTION OF THE PREFERRED EMBODIMENTS

Figure 1:
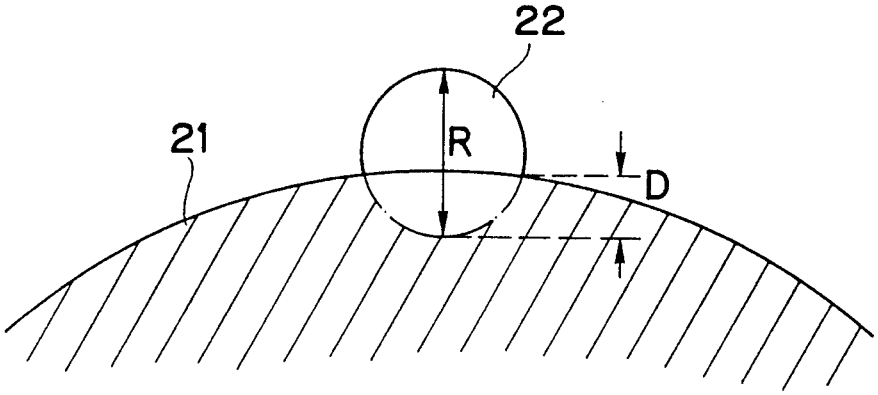
FIG. 1 diagrammatically illustrates a state wherein a fine conductive particle is held on the surface of a toner particle.

As a result of extensive studies, the present inventors have reached a discovery that the problems previously discussed can be solved by the use of a resin composition having a domain-matrix structure in which domain particles dispersed in a matrix have an average particle diameter of not larger than 5 μm, a resin P1 that forms the domain particles has a glass transition temperature Tg1 of from 0° C. to 60° C., and a resin P2 that forms the matrix has a glass transition temperature Tg2 of from 40° C. to 90° C., provided that the glass transition temperature Tg2 of the resin P2 is at least 5° C. higher than the glass transition temperature Tg1 of the resin P1.

The present inventors have grasped the reason therefor as follows:

The structure wherein a resin with a higher glass transition temperature Tg is made to serve as a matrix and a resin with a lower glass transition temperature Tg is made to serve as domain particles generally brings about excellent low-temperature fixing performance and also excellent blocking resistance.

With regard to the toner having what is called a domain-matrix structure, in which a binder resin is comprised of domain particles and a matrix, Japanese Patent Publication No. 57-6586 discloses a method of controlling diameters of domain particles by adding a dispersant such as a graft or block polymer, where the domain particles are formed of a soft and deformable polymer having a glass transition temperature (Tg) lower than 30° C. and a number average molecular weight (Mn) of from 500 to 50,000 and the matrix is formed of an amorphous polymer having a glass transition temperature (Tg) higher than 50° C., a crystalline polymer having a melt temperature (Tm) higher than 40° C. and a tough polymer having a number average molecular weight (Mn) more than 1,500. Such a method has problems as follows: (1) As shown in exemplary materials described in its specification, the polymers that form the matrix and the domain particles are completely non-compatible materials, and it is essential to add the graft or block polymer in order to give the domain-matrix structure. For this reason, a special method is considered to have been used to control the domain particles and matrix by spray drying or the coacervation process. The toner obtained by this method is certainly feasible for low-temperature fixing. (2) However, the toner prepared by the spray drying has a broad particle size distribution, resulting in a coarseness in image quality because of fogging or toner spots around images. (3) In the spray drying, the resins for the domain particles, matrix and dispersant are dissolved in a mutual solvent, to which a non-solvent (a selective solvent for the matrix component having a higher boiling point than the mutual solvent) is added, and the resulting mixture is spray dried, whereby firstly the mutual solvent is removed so that the soft polymer component is precipitated and secondly the solvent is removed from the matrix formed around the soft polymer component. Thus a toner is obtained. Use of this method is accompanied by a limitation in the combination of the resins and the solvents (the resins dissolve in the solvent firstly added but do not dissolve in the solvent secondly added, or the solvent must have a low boiling point because of the spray drying), and hence it is not easy, for example, to change the molecular weights of the resins or change their composition. It is also difficult to use resins having similar composition, taking account of the fact that they are successively selectively precipitated. (4) The polarity of the graft or block polymer playing a role as the dispersant for the domain particles formed is not so much strong that the domain becomes larger with storage for a long period of time, resulting in a poor blocking resistance.

Japanese Patent Publication No. 59-50060 discloses a method in which a condensation resin such as polyester resin or epoxy resin is blended for the purpose of low-temperature fixing, and a vinyl resin for the purpose of improving high-temperature offset resistance. In this method, a vinyl resin with a giant molecular weight of 500,000 or more in weight average molecular weight is melt-kneaded together with the condensation resin such as polyester resin or epoxy resin. In such mixing, no graft or block polymer is added in some instances, so that, even if domain particles have been formed, it is very difficult in itself to control the diameters of domain particles in a state better than those described above. Moreover, the domain particles become larger with storage for a long period of time, resulting in a gradual lowering of blocking resistance.

Japanese Patent Applications Laid-open No. 56-159340, No. 58-106552, No. 63-214760, Nos. 63-217360 to 63-217363 and No. 1-204061 disclose methods in which resins having different glass transition temperatures (Tg), molecular weights and/or compositions are blended. In these methods, however, domain particles are not formed, or, even if formed, they have large particle diameters, and hence a very poor blocking resistance may be brought about when any one of the blended resins has a glass transition temperature (Tg) lower than 50° C.

Now, as a result of extensive studies, the present inventors have accomplished the invention of the resin composition used for a toner, that does not cause the various problems discussed above, having a superior low-temperature fixing performance.

The resin composition in the present invention has a domain-matrix structure comprising the domain particles with an average particle diameter of not larger than 5 μm, having a glass transition temperature Tg1 of from 0° C. to 60° C., and the matrix having a glass transition temperature Tg2 of from 40° C. to 90° C., both having the relationship that the Tg2 is at least 5° C. higher than the Tg1. The toner of the present invention employs a binder resin comprising such a resin composition.

The constitution described above makes it possible to obtain a toner having a superior low-temperature fixing performance and also having a superior blocking resistance.

The domain-matrix structure in the present invention may include the following embodiments (1) to (4).

(1) A domain-matrix structure obtained by introducing carboxyl groups, using a carboxyl group-containing resin, into any one of the resin that forms the domain particles and the vinyl resin that forms the matrix.

In this embodiment, in the case when the resin that forms the domain particles contains the carboxyl groups, the domain particles formed of the resin P1 having a glass transition temperature Tg1 which is at least 5° C. lower than the glass transition temperature Tg2 of the resin P2 are aggregated by the aid of the carboxyl groups to form a very fine and stable micelle.

The domain-matrix structure can be reversed by making larger the amount of the resin that forms the domain particles, in the mixing proportion of the carboxyl group-containing resin that forms the domain particles and the resin that forms the matrix (when the carboxyl group-containing resin has an acid, the proportion of the resin that forms the domain particles and the resin that forms the matrix may be selected in the range of from 6 to 9:4 to 1), so that the carboxyl group-containing resin forms the matrix.

In this embodiment, a cross-linkable metal compound can be used. When it is used, the domain particles having formed the micelle turn into a microgel in its part or entirety by the action of the cross-linkable metal compound, so that a more superior effect can be obtained in respect of the low-temperature fixing performance and the blocking resistance.

(2) A domain-matrix structure obtained by chemically bonding part of unsaturated double bonds possessed by two kinds of resins having no or low compatibility with the resin that forms the matrix and the resin that forms the domain particles, using as the resin that forms the matrix a polyester resin having unsaturated double bonds and using as the resin that forms the domain particles a resin comprising vinyl monomers having unsaturated double bonds.

In this embodiment, the glass transition temperature Tg2 of the resin P2 that forms the matrix is at least 5° C. higher than the glass transition temperature Tg1 of the resin P1 that forms the domain particles, and also part of unsaturated double bonds possessed by two kinds of resins having no or low compatibility with the resin P1 that forms the domain particles and the resin P2 that forms the matrix is chemically bonded, so that the domain particles are finely and stably dispersed in the matrix, making it possible to achieve a superior low-temperature fixing performance and blocking resistance. Moreover, the chemical bonding of part of the unsaturated double bonds possessed by the resins that respectively form the domain particles and the matrix brings about an improvement in fluidity because the domain particles do not come to the surfaces of toner particles as a result of pulverization in the manufacture of the toner.

(3) A domain-matrix structure obtained by the use of a vinyl resin having an acid value of not less than 15, comprised of the domain particles forming resin into which carboxyl groups have been introduced by acid modification of a vinyl resin, using a polyester resin having an acid value of less than 15 and having substantially no carboxyl groups.

In this embodiment the glass transition temperature Tg2 of the resin P2 that forms the matrix is at least 5° C. higher than the glass transition temperature Tg1 of the resin P1 that forms the domain particles, and also the domain particles formed by the resin into which carboxyl groups have been introduced by acid modification of a vinyl resin are aggregated by the aid of the carboxyl groups to form a micelle, and hence are very finely and stably dispersed in the matrix, thus making it possible to achieve a superior low-temperature fixing performance and blocking resistance.

In this embodiment, a cross-linkable metal compound can be used. When it is used, the resin that forms the domain particles and the resin that forms the matrix are cross-linked, and hence the domain particles do not come to the surfaces of toner particles as a result of pulverization in the manufacture of the toner, bringing about a more improvement in fluidity.

(4) A domain matrix structure obtained by cross-linking, with use of a cross-linkable metal compound, part or the whole of the resin that forms the matrix and the resin that forms the domain particles, using as the resin that forms the matrix a carboxyl group-containing polyester resin having an acid value of not less than 15 and using as the resin that forms the domain particles a carboxyl group-containing vinyl resin having an acid value Of not less than 15.

In this embodiment, the glass transition temperature Tg2 of the resin P2 that forms the matrix is at least 5° C.

higher than the glass transition temperature Tg1 of the resin P1 that forms the domain particles, and also part or the whole of two kinds of resins having no or low compatibility with the resin P1 that forms the domain particles and the resin P2 that forms the matrix is cross-linked, so that the domain particles are very finely and stably dispersed in the matrix, making it possible to achieve a superior low-temperature fixing performance and blocking resistance. Moreover, the cross-linking of part or the whole of the resins that respectively form the domain particles and the matrix brings about an improvement in fluidity because the domain particles do not come to the surfaces of toner particles as a result of pulverization in the manufacture of the toner.

If the glass transition temperature Tg1 of the resin P1 that forms the domain particles is lower than 0° C., blocking may occur even if the glass transition temperature Tg2 of the resin P2 that forms the matrix is made higher. If on the other hand the glass transition temperature Tg1 of the resin P1 that forms the domain particles is higher than 60° C., the toner may come to have a poor fixing performance. If the glass transition temperature Tg2 of the resin P2 that forms the matrix is lower than 40° C., blocking may occur, and if it is higher than 90° C., the toner may come to have a poor fixing performance. The glass transition temperature Tg1 of the resin that forms the domain particles, which constitutes the binder resin, may preferably be from 15° to 50° C. and the glass transition temperature Tg2 of the resin that forms the matrix may preferably be from 55° to 80° C. In order to make the present invention more effective, the glass transition temperature Tg2 of the resin P2 that forms the matrix must be at least 5° C., and preferably at least 10° C., higher than the glass transition temperature Tg1 of the resin P1 that forms the domain particles.

In the above embodiments (1) and (3), the domain particles may preferably have an acid value of not less than 15. Those having an acid value of less than 15 may make poor the dispersion stability of the domain particles, tending to cause a lowering of blocking resistance. If the acid value of the matrix is more than 10, its compatibility with the domain particles may increase to make poor the dispersion stability of the domain particles, tending to cause a lowering of blocking resistance.

In the above embodiment (2), the resin that forms the domain particles may preferably have an acid value of not less than 15, and the resin that forms the matrix, an acid value of less than 15. If this condition is not satisfied, the dispersion stability of the domain particles may become unsatisfactory to tend to cause a lowering of blocking resistance.

In the above embodiment (4), the resin that forms the domain particles and the resin that forms the matrix may each preferably have an acid value of not less than 15. If the resin that forms the domain particles has an acid value of less than 15, the dispersion stability of the domain particles ma become unsatisfactory to tend to cause a lowering of blocking resistance. If the resin that forms the matrix has an acid value of less than 15, the density of cross-linking of the resin that forms the domain particles and the resin that forms the matrix may become lower to cause a lowering of blocking resistance.

The weight ratio of the resin that forms the matrix to the resin that forms the domain particles may preferably be such that the resin that forms the domain particles is in an amount of from 5 to 300 parts by weight based on 100 parts by weight of the resin that forms the matrix. If the resin that forms the domain particles is less than 5 parts by weight, no effect Of lowering fixing temperature tends to be brought about. If it is mixed in an amount more than 300 parts by weight, the blocking resistance tends to become poor.

In order to attain the embodiment in which the matrix is formed from the carboxyl group-containing resin, the mixing amount Of the carboxyl group-containing resin may be made larger. In particular, a resin having a long-chain aliphatic hydrocarbon on the side chain, as exemplified by stearyl methacrylate, may be used, which is preferable because this embodiment can be more readily attained.

In the binder resin used in the present invention, when the vinyl monomer is used as a material for the resin that forms the domain particles, the vinyl monomer may include the following.

For example, styrene, and styrene derivatives such as o-methylstyrene, m-methylstyrene, p-methylstyrene, p-phenylstyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, p n-dodecylstyrene, p-methoxystyrene, p-chlorostyrene, 3,4-dichlorostyrene, m-nitrostyrene, o-nitrostyrene and p-ntrostyrene; ethylene and unsaturated monoolefins such as ethylene, propylene, butylene and isobutylene; unsaturated diolefins such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic acid and esters thereof such as methacrylic acid. methyl methacrylate. ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid, and acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrol, N-vinylcarbazole, N-vinylindole and N-vinylpyrrolidone; vinyl naphthalenes; acrylic acid or methacrylic acid derivatives such as acrylonitrile, methacrylonitrile and acrylamide; and acroleic acid. A polymer of one or more kinds of any of these may be used.

In the binder resin used in the present invention, the domain particles can be incorporated with the carboxyl groups by using a carboxyl group-containing vinyl monomer. This carboxyl group-containing vinyl monomer may include acrylic acid, methacrylic acid, crotonic acid, itaconic acid, maleic anhydride, fumaric acid, maleic acid, and their monoesters such as methyl, ethyl, butyl or 2-ethylhexyl esters. One or more kinds of these monomers is/are used together with the monomer described above. Such a carboxyl group-containing vinyl monomer should preferably be contained in an amount of from 0.1 to 50% by weight, and more preferably from 1 to 30% by weight, on the basis of the polymer that forms the domain particles, in order to make the domain particles have particle diameters of 5 μm or less.

When, in particular the acid-modified polymer having unsaturated double bonds is used as the resin that forms the domain particles, a monomer having an acid-modifiable unsaturated double bond is used. The monomer having the unsaturated double bond should be used in an amount of from 0.1 to 70% by weight, and more preferably from 0.3 to 55% by weight, on the basis of the resin that forms the domain particles.

The acid for modifying the resin that forms the domain particles in the binder resin of the present invention may include acrylic acid, methacrylic acid, crotonic acid, itaconic acid, maleic anhydride, fumaric acid, maleic acid, and their monoesters such as methyl, ethyl, butyl, 2-ethylhexyl, octyl, dodecyl, hexadecyl or stearyl esters. One or more kinds of these monomers is/are added to the unsaturated double bonds after synthesis of the resin that forms the domain particles, using a method such as heating in solvent.

The acid for modifying the resin that forms the domain particles in the binder resin of the present invention should be incorporated into the resin that forms the domain particles, preferably in an amount of from 0.1 to 50% by weight, and more preferably from 1 to 30% by weight, on the basis of the polymer that forms the domain particles, in order to make the domain particles have particle diameters of 5 μm or less.

In order to chemically bond the resin that forms the matrix and the resin that forms the domain particles, the double bonds in the resin that forms the domain particles must be left in part. Hence, in such an instance, the acid for modifying the resin that forms the domain particles should be in an amount of not more than 95 mol % based on the diolefin monomer weight.

In the binder resin used in the present invention the resin that forms the matrix may include vinyl resins, polyester resins, phenol resins and epoxy resins.

Use of the vinyl resin as the resin that forms the matrix is preferable since it brings about a low polarity and a improvement in the dispersion stability of the domain particles.

As the vinyl resin that forms the matrix, it is possible to use the same resin as the vinyl resin usable for the formation of the domain particles.

Also when the carboxyl group-containing vinyl monomer is used for incorporating carboxyl groups into the resin that forms the matrix and when the monomer having unsaturated double bonds and the acid are used for constituting the acid-modified polymer having unsaturated double bonds, it is possible to use the same monomers as used in the resin that forms the domain particles.

The acid for modifying the resin that forms the matrix in the binder resin of the present invention should be incorporated into the resin that forms the matrix, preferably in an amount of from 0.1 to 50% by weight, and more preferably from 1 to 30% by weight, on the basis of the polymer that forms the matrix, in order to make the domain particles have glass transition temperature Tg2 of from 40° C. to 90° C., particle diameters of 5 μm or less.

Use of the polyester resin as the resin that forms the matrix is preferable since it brings about a superior fluidity of toner and superior rise of static charge.

The polyester resin that forms the matrix in the present invention has the composition as shown below.

Of the whole components of the polyester resin, an alcohol component comprises 45 to 55 mol % and an acid component comprises 55 to 45 mol %.

The alcohol component may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following structural formula (A):

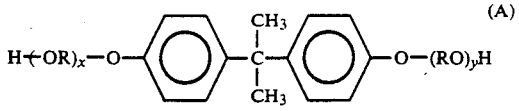

(A)

wherein R represents an ethylene group or a propylene group, x and y are each an integer of one or more, and an average value of x+y is 2 to 10; and a diol represented by the following structural formula (B):

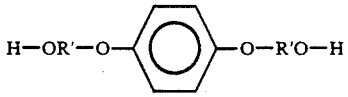

(B)

wherein R' represents $-CH_2CH_2-$,

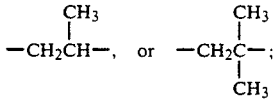

and polyhydric alcohols such as glycerol, sorbitol and sorbitan.

A dibasic carboxylic acid that comprises 50 mol % or more in the whole acid components may include benzene dicarboxylic acids or anhydrides thereof such as phthalic acid, terephthalic acid, isophthalic acid and phthalic anhydride; alkyldicarboxylic acids such as succinic acid, adipic acid, sebacic acid and azelaic acid, or anhydrides thereof, and also succinic acid substituted with an alkyl group having 6 to 18 carbon atoms, or anhydrides thereof. A tri- or more basic carboxyl acid may include trimellitic acid, pyromellitic acid and benzophenonetetracarboxylic acid, or anhydrides thereof.

Those having an unsaturated double bond may also include unsaturated dicarboxylic acids such as fumaric acid, maleic acid, citraconic acid, itaconic acid and dodecenylsuccinic acid, or anhydrides thereof.

What are particularly preferred in working the present invention are, as the alcohol component of the polyester resin, the bisphenol derivative represented by the above formula (A): as the acid component, phthalic acid, terephthalic acid, isophthalic acid or an anhydride thereof, succinic acid, trimellitic acid, or an anhydride thereof; and as those having an unsaturated double bond, fumaric acid, maleic acid and maleic anhydride. The acid having an unsaturated double bond should preferably be contained in an amount of not less than 1% by weight, and more preferably not less than 5% by weight.

The toner for the heat fixing in the present invention can be applied to either one-component developers or two component developers. In the two-component developer the toner can be applied in a wide range from monochromes to full-colors.

In order for the properties of the toner according to the present invention to be well exhibited, when the toner is used for full-color electrophotography, the polymer of domain particles used in the binder resin should have a number average molecular weight (Mn)

of preferably from 1,500 to 40,000, and more preferably from 3,500 to 30,000, and a weight average molecular weight (Mw) of preferably from 3,000 to 300,000, and more preferably from 5,000 to 100,000; and the resin that forms the matrix should have a number average molecular weight (Mn) of preferably from 1,500 to 20,000, and more preferably from 3,000 to 10,000, and a weight average molecular weight (Mw) of preferably from 3,000 to 50,000, and more preferably from 5,000 to 30,000. When used as the one-component type or used for monochromes, the polymer of domain particles used in the binder resin should have a number average molecular weight (Mn) of preferably from 3,000 to 150,000, and more preferably from 5,000 to 100,000, and a weight average molecular weight (Mw) of preferably from 6,000 to 1,000,000, and more preferably from 10,000 to 700,000; and the resin that forms the matrix should have a number average molecular weight (Mn) of preferably from 2,000 to 50,000, and more preferably from 4,000 to 30,000, and a weight average molecular weight (Mw) of preferably from 6,000 to 250,000, and more preferably from 10,000 to 150,000.

The polymer synthesized from the vinyl monomers can be obtained by a conventionally commonly known method, including, for example, a method in which solution or suspension polymerization is carried out using a peroxide as an initiator. The polyester resin can also be obtained by conventionally commonly known condensation polymerization.

As methods for making the binder resin have the domain-matrix structure, using the resins for the matrix and domain particles respectively obtained by the above method, it is very difficult to produce a uniform and fine domain-matrix structure only if the materials ar merely dry-blended and melt-kneaded.

As a result of extensive studies made by the present inventors, they have succeeded in giving a uniform and fine domain-matrix structure by the following method: The respective resins obtained by polymerization are weighed in the specific weight ratio, and then melted by heating, followed by mixing with stirring in the state of a solution, i.e., in a molten state. With further heating and elevation of temperature, the blend solution is compatibilized. After having been compatibilized, the solution is rapidly cooled to give a blend resin. This method makes it possible to control the domain particles to have a small and uniform size.

After the resin for domain particles has been prepared by polymerization using a non-polar solvent, the resin that forms the matrix is prepared by polymerization in the presence of the resin for domain particles According to this method, the resin for domain particles is blended in a micro-dispersed state, so that the domain particle size can be made small.

In reverse to the above method, it is also possible to first prepare the resin for matrix by polymerization and thereafter prepare the resin for domain particles by polymerization. As another method for preparation, it is also possible to use a method in which bulk polymerization is carried out, which is stopped at a certain rate of reaction to take out unreacted monomers, and a polymer dissolved therein is subjected to suspension polymerization or solution polymerization. In this instance, the carboxyl group-containing monomers react at a rate higher than other vinyl monomers, and hence may be used at the stage of bulk polymerization, but it is more preferable to use a method in which the resin that forms the matrix is prepared by bulk polymerization and thereafter the resin that forms the domain particles is synthesized by solution polymerization.

Another method is available in which the respective resins prepared by polymerization are dissolved in a non-polar solvent (the domain-matrix structure can be given even with use of a polar solvent, but the domain particle size become larger), and then blended in the state of solution with heating and vigorous stirring. In the present invention, it is very important to control the domain particles to have a small size. Accordingly, in the case of blending, it is effective to make shear force stronger when the resins are blended with stirring, but compatibility of the resin that forms the matrix with the resin that forms the domain particles can be improved when blended in the state of a high temperature, thereby making it possible to make the domain particle size smaller. The solvent may be removed in this state, followed by rapid cooling. Thus, it is possible to produce the uniform and fine domain-matrix structure.

The domain particle size depends on the state of dissociation of carboxyl groups. Hence, in the case of blending, although it is certainly effective to raise temperature or make shear force stronger when the materials are blended, it is also possible to make the size much smaller by adding an aid that does not react with a small quantity of water, alcohol such as methanol or carboxyl groups and is capable of more dissociating the carboxyl groups.

The present inventors have also grasped that the domain particle size can be smaller and also the domain particle size distribution can be more uniform as the monomers having carboxyl group have a more uniform compositional distribution in the polymer. This means that the resins described above can be obtained by a method in which the monomers having carboxyl groups are added little by little when the resin for domain particles is prepared by polymerization.

The method by which the resins P1 and P2 are chemically bonded may include a method in which the resin P1 and resin P2 are dissolved in a suitable solvent and thereafter, for example, (1) the remaining double bonds are cross linked using only a peroxide such as benzoyl peroxide or (2) they are cross-linked using a peroxide such as benzoyl peroxide or other radical polymerization initiator and a vinyl monomer or a cross-linkable monoer of a divinyl type (e.g., divinyl benzene), and a method in which a peroxide such as benzoyl peroxide and/or a vulcanizing agent and/or vulcanizing accelerator usually used for rubbers or plastics are previously mixed when the resins, colorant, magnetic powder, etc. are melt-kneaded, and they are cross-linked in the course of the melt-kneading.

As the cross-linkable metal compound used in the present invention, those containing any of the following metal ions can be used. Suitable monovalent metal ions may include $Na^+$, $Li^+$, $K^+$, $Cs^+$, $Ag^+$, $Hg^+$ and $Cu^+$. Divalent metal ions may include $Be^{2+}$, $Mg^{2+}$, $Ca^{2+}$, $Hg^{2+}$, $Sn^{2+}$, $Pb^{2+}$, $Fe^{2+}$, $Co^{2+}$, $Ni^{2+}$ and $Zn^{2+}$. Trivalent metal ions may include $Al^{3+}$, $Sc^{3+}$, $Fe^{3+}$, $Co^{3+}$, $Ni^{3+}$, $Cr^{3+}$ and $\gamma^{3+}$. Of the compounds containing the metal ions as described above, those which are decomposable can give better results. This is presumably because in those which are decomposable the metal ions in the compounds are more readily bonded to the carboxyl groups in the polymers as a result of thermal decomposition.

Of the cross-linkable metal compounds, organic metal compounds have a superior compatibility with or dispersibility to the polymers, so that the crosslinking attributable to the reaction with the metal compounds more uniformly proceeds, thus giving better results. With regard to $Na^+$, $K^+$, $Li^+$, even their hydroxides have rich reactivity, and can give good results.

Of the organic metal compounds as shown above, those containing an organic compound rich in properties of vaporization or sublimation as a ligand or a counter ion are particularly useful. Of the organic compounds capable of forming a ligand or a counter ion together with a metal ion, those having the above properties may include salicylic acid or derivatives thereof as exemplified by salicylic acid, salicylamide, salicylamine, salicylaldehyde, salicylosalicylic acid and ditertiarybutylsalicylic acid, β-diketones as exemplified by acetylacetone and propionacetone, and low-molecular carboxylates as exemplified by acetate and propionate.

In the toner according to the present invention, a release agent can be used for the purpose of improving anti-offset properties.

The release agent used in the present invention may include those having a melt-starting temperature (a temperature at which the release agent begins to melt) of not lower than 40° C. or above, and preferably not lower than 50° C., and also i) having at least two melting points in a temperature range of from 50° to 250° C., and preferably from 70° to 200° C., as measured using a DSC, or ii) comprising two or more kinds of those having different melting points one another in that range. This is because a release agent with a melt-starting temperature of lower than 40° C. may make blocking resistance poor, and those with plural melting points in the temperature range of from 50° to 250° C. can exhibit a release effect over a broader range of from a low temperature to a high temperature. A more preferable method of using the release agent with respect to the binder resin used in the present invention is to use in combination, two or more kinds of release agents having different melting points and comprised of a release agent having no polar group and a release agent having a polar group. This is because, when the binder resin of the present invention is used, most of non-polar release agents are present in the resin that forms the matrix and, on the other hand, most of release agents with polar groups are present in the resin that forms the domain particles, and hence the release effect can be obtained in both the resin that forms the matrix and the resin that forms the domain particles. Thus, one kind of release agent may be used without any problem if it can be present in both the resin that forms the matrix and the resin that forms the domain particles, and also has a plurality of melting points in the temperature range of from 50° to 250° C.

The release agent having no polar group, used in the present invention, may include the following: Aliphatic hydrocarbon waxes such as low-molecular weight polyethylene, low-molecular weight polypropylene, microcrystalline wax and paraffin wax, and oxides of aliphatic hydrocarbon waxes such as polyethylene oxide wax or block copolymers of these; waxes mainly composed of a fatty acid ester, such as carnauba wax, sazole wax and montan wax; and fatty acid esters part or the whole of which has been deoxidated, such as deoxidated carnauba wax. The release agent having a polar group, used in the present invention, may include the following: Saturated straight-chain fatty acids such as palmitic acid, stearic acid and montanic acid; unsaturated fatty acids such as brandinic acid and eleostearic acid; saturated alcohols such as stearyl alcohol, aralkyl alcohol, behenyl alcohol, carnaubyl alcohol, ceryl alcohol and melissyl alcohol; polyhydric alcohols such as sorbitol, fatty acid amides such as linolic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide, N,N'-distearylisophthalic acid amide; aliphatic acid metal salts (those commonly called metal soaps) such as calcium stearate, calcium laurate, zinc stearate and magnesium stearate; waxes obtained by grafting fatty acid hydrocarbon waxes using vinyl monomers such as styrene or acrylic acid; partially esterified compounds of fatty acids and polyhydric alcohols, such as behenic acid monoglyceride., and methyl-esterified compounds having a hydroxyl group, obtained by hydrogenation of vegetable fats and oils.

The release agent used in the present invention should preferably be in an amount of from 0.1 part by weight to 20 parts by weight, and preferably from 0.5 part by weight to 10 parts by weight, based on 100 parts by weight of the binder resin. This is because use of the release agent in an amount more than 20 parts by weight tends to bring about a lowering of blocking resistance or high-temperature offset resistance, and use thereof in an amount less than 0.1 part by weight may give less release effect.

These release agents can be incorporated into the binder resin by a method in which a resin is dissolved in a solvent, and to the resulting resin solution, after its temperature is raised, they are added and mixed with stirring, or a method in which they are mixed at the time of kneading.

It is possible to impart charge control properties to toner particles, using a metal complex. Such a metal complex (a charge control agent) may include azo type metal complexes represented by the following formula (I).

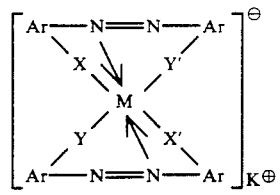

Formula (I)

wherein M represents a coordination central metal such as Cr, Co, Ni, Mn or Fe, having the coordination number of 6; Ar represents an aryl group such as a phenyl group and a naphthyl group, which may have a substitutent, which substituent may include a nitro group, a halogen atom, a carboxyl group, an anilide group and an alkyl group or alkoxyl group having 1 to 18 carbon atoms; X, X', Y and Y' each represent —O—, —CO—, —NH— or —NR—, where R represents an alkyl group having 1 to 4 carbon atoms; and K⊕ represents a hydrogen ion, a sodium ion, a potassium ion, an ammonium ion or an aliphatic ammonium ion.

Examples of the complex are shown below.

Complex (I)-1
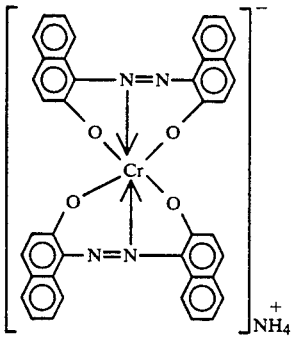
Complex (I)-2
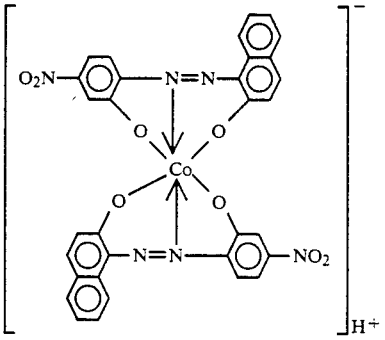
Complex (I)-3
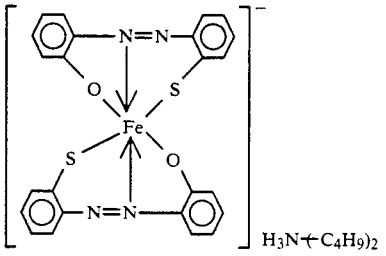
Complex (I)-4
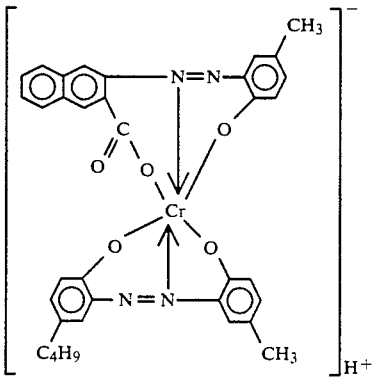
Complex (I)-5
-continued
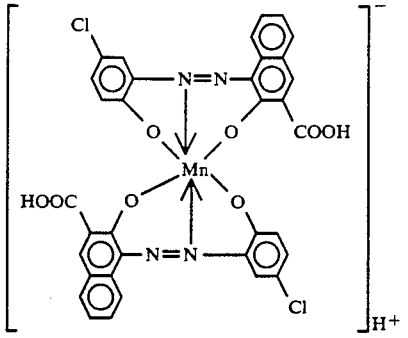
Basic organic acid metal complexes represented by the following formula (II).
Formula (II)
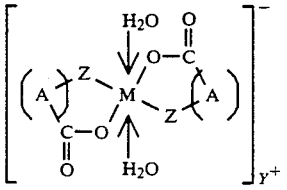
wherein M represents a coordination central metal such as Cr, Co, Ni, Mn or Fe, having the coordination number of 6; A represents a structure selected from those represented by the following formulas (1) to (9):
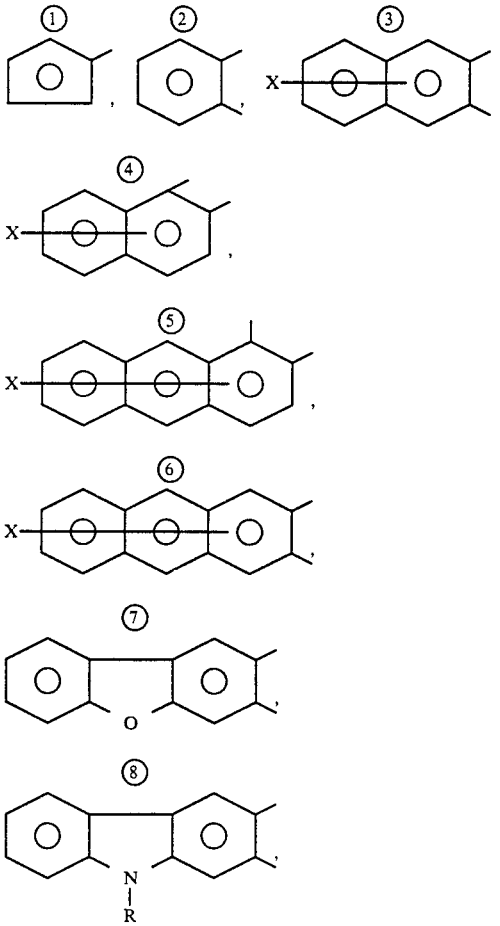

-continued

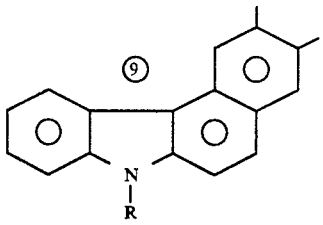

wherein the structure of formula (2) may have a substituent such as an alkyl group; X in formulas (4), (5) and (6) represents a hydrogen atom, a halogen atom or a nitro group; R in formulas (8) and (9) represents a hydrogen atom, an alkyl group or alkenyl group having 1 to 18 carbon atoms; $Y^+$ represents a hydrogen ion, a sodium ion, a potassium ion, an ammonium ion or an aliphatic ammonium ion; and Z represents —C— or

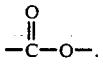

Examples of the complex represented by formula (II) are shown below.

Complex (II)-1

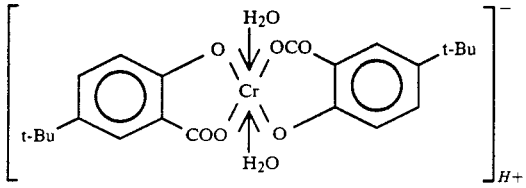

Complex (II)-2

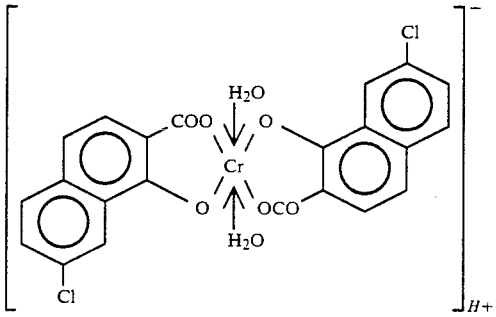

Complex (II)-3

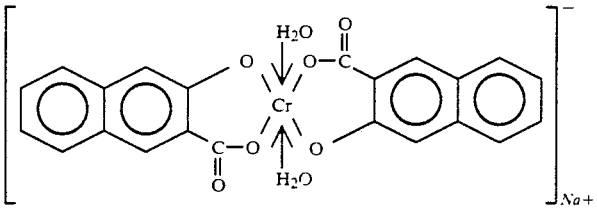

Complex (II)-4

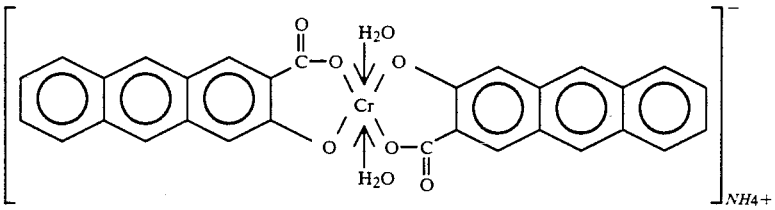

Complex (II)-5

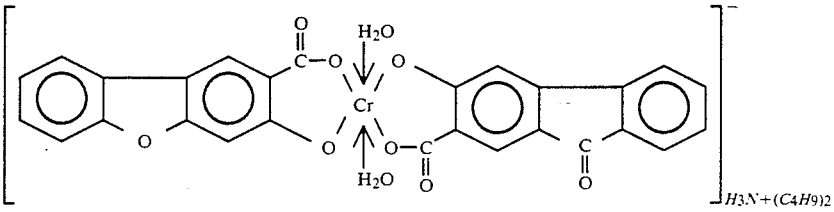

-continued

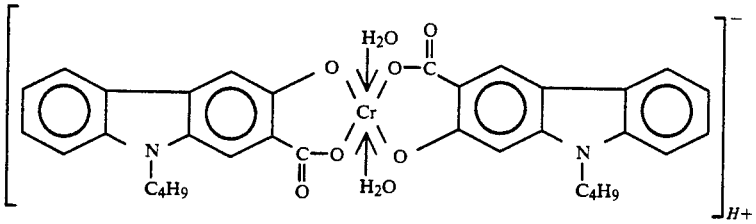

Complex (II)-6

These metal complexes can be used alone or in combination of two or more kinds.

The amount in which the metal complex is added to toner particles may vary depending on the type of the binder resin used in the toner, whether or not a carrier is used in combination, the type of a pigment that colors the toner, and the reactivity of the metal complex with the binder resin. Including those unreacted, it should be added in an amount of from 0.01 part by weight to 20 parts by weight, and more preferably from 0.05 part by weight to 10 parts by weight, based on 100 parts by weight of the binder resin.

The above metal complex may be reacted with the binder resin at the time of melt kneading, or may be reacted with it after the binder resin is dissolved in a suitable solvent, followed by addition of the metal complex, setting reaction conditions, e.g., raising temperature.

In the present invention, in instances in which a larger charge is required when the above charge control agent is used, toner particles may be made to hold conductive fine powder on their surfaces and also the fine powder may be buried to the insides by 0.05 μm or more from the surfaces, whereby the charges of the toner can be increased.

With such constitution, when a developer and a charging member are in contact with each other, the conductive fine powder on the outermost layer of a toner particle and the charging member are triboelectrically charged, and the charge moved from the charging member passes through the conductive fine powder to reach the charge control agent present inside the toner particle, so that charges required for development can be obtained. This has been confirmed to remakably occur particularly in an environment of high temperature and high humidity.

As a method of making the toner particles to hold the conductive fine powder on their surfaces, the conductive fine powder may be statically adhered to the toner particle surfaces by, for example, gentle stirring, and then a mechanical impact force may be applied thereto, so that the conductive fine powder can be brought into the state that its particles are struck into, and held on, toner particle surfaces.

This conductive fine powder may preferably have an average particle diameter of not larger than 2 μm, and particularly preferably not larger than 1 μm. A conductive fine powder with an average particle diameter of larger than 2 μm may make light-transmission properties poor when fixed to OHPs.

In order for such fine powder to be effective, it must be held in the state that part of its particle protrudes from the surface of a toner particle. More specifically, it must be held in the state that its particle is buried in the inside of the toner particle by 0.05 μm or more from the surface thereof. This is a state that, as shown in FIG. 1, where R represents particle diameter of a particle 22 of the conductive fine powder and D represents depth of its part buried in a toner particle 21, the ratio of D/R is from 0.025 to 0.95. This state can be readily confirmed by observing the boundaries of leaves of toner particles, using a transmission type electron microscope or the like.

In the present invention, it is preferred that from 1% to 50% of the surface area of each toner particle is covered with the conductive fine powder struck into it. A coverage larger than this range may cause a lowering of fixing performance and, on the other hand, a coverage smaller than this range may give no effect of charge injection from the charging member into the charge control agent present inside the toner particles.

Such conductive fine powder may include metal oxides as exemplified by titanium oxide, aluminum oxide and zirconium oxide, strontium titanate, and titanium nitride.

In order for the toner according to the present invention to be used in one-component developers, the toner may be incorporated with a magnetic powder. Such a magnetic powder may include materials capable of being magnetized when placed in a magnetic field, as exemplified by powders of ferromagnetic metals such as iron, cobalt and nickel, and alloy or compounds such as magnetite, hematite and ferrite. This magnetic powder may be contained in an amount of from 15 to 70% by weight based on the weight of the toner.

Regardless of the one-component developers or two-component developers, carbon black. titanium white or other all sorts of pigment and/or dye can be used as the colorant.

For example, in instances in which the toner according to the present invention is used as a magnetic color toner, the dye may include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6. The pigment may include chrome yellow, cadmium Yellow, mineral fast yellow, antimony yellow, Naphthol Yellow S, Hanza Yellow G, Permanent Yellow NCG, Tartrazine Yellow Lake, chrome orange, molybdenum orange, Permanent Orange GTR, Pyrazolone Orange, Benzidine Orange G, cadmium red, Permanent Red 4R, Watching Red calcium salt, eosine lake, Brilliant Carmine 3B, manganese violet. Fast Violet B, Methyl Violet Lake prussian blue, cobalt blue, alkali blue lake, Victoria blue lake, Phthalocyanine Blue, Fast Sky Blue, Indanethlene Blue BC, Chrome green, chromium oxide, Pigment Green B, Malachite Green Lake and Final Yellow Green G.

In instances in which the toner according to the present invention is used as a toner for two-component full-color developers, the colorant may include the following pigments and dyes.

A magenta color pigment may include C.I. pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90 112, 114, 122, 123, 163, 202, 206, 207, 209; C.I. pigment Violet 19; and C.I. Vat Red 1, 2, 10, 13, 15, 23, 29, 35.

These pigments may be used alone. In view of image quality of full-color images, it is preferred to use the dye and the pigment in combination so that the sharpness of images can be improved.

A magenta dye may include oil-soluble dyes such as C.I. Solvent Red 1, 3, 8, 23, 24, 25, 27, 30, 49, 81, 82, 83, 84, 100, 109, 121, C.I. Disperse Red 9; C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As other coloring pigment, a cyan color pigment may include C.I. Pigment Blue 2, 3, 15, 16, 17, C.I. Vat Blue 6, C.I. Acid Blue 45, or a copper phthalocyanine pigment comprised of a phthalocyanine skeleton substituted thereon with 1 to 5 pthalimidomethyl groups, having the structure represented by the following structural formula (C).

(C)

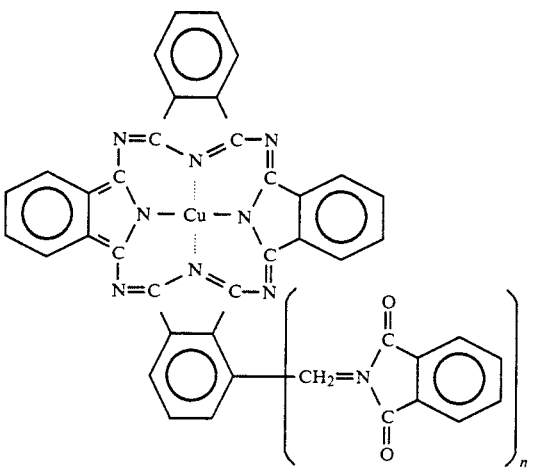

n = 1~5

A yellow color pigment may include C.I. Pigment Yellow 1, 2, 3, 4, 5, 6, 7, 10, 11, 12, 13, 14, 15, 16, 17, 23, 65, 73, 83, and C.I. Vat Yellow 1, 3, 20.

The colorant may be used in an amount of from 0.1 part by weight to 60 parts by weight, and preferably from 0.5 part by weight to 50 parts by weight, based on 100 parts by weight of the binder resin.

In the toner according to the present invention, there are no limitations on whether it is negatively chargeable or positively chargeable. In the case when a negatively chargeable toner is prepared, a negative charge control agent may preferably be added for the purpose of stabilizing negatively chargeable properties. The negative charge control agent may include, for example, phenol resins, carboxyl group-containing resins such as polymethacrylic acid, a styrene/acrylic acid copolymer, a styrene/methacrylic acid copolymer and a maleic acid-added styrene-butadiene copolymer and resins having a carboxyl group or —OH group at a polymer chain terminal upon condensation polymerization such as polyester.

In the case when a polyester resin is used as the matrix of the binder resin, it is more preferably used in negatively chargeable toners taking account of the charge properties of the matrix, in view of the advantages of making the most of its properties.

In the case when a positively chargeable toner is prepared, a charge control agent capable of exhibiting positive chargeability may preferably be added to the toner. The positive charge control agent may include Nigrosine compounds, triphenylmethane compounds, Rhodamine compounds and polyvinylpyridine. In the case when color toners are prepared, it is possible to use a binder resin incorporated as monomers with 0.1 to 40 mol % of an amino-containing carboxylate such as dimethylaminomethyl methacrylate capable of exhibiting positive chargeability, or to use colorless or pale-color positive charge control agent having no influence on the color tones of the toners. Tho colorless or pale-color positive charge control agent may include, for example, quaternary ammonium salts represented by the following structural formulas (D) and (E).

(D)

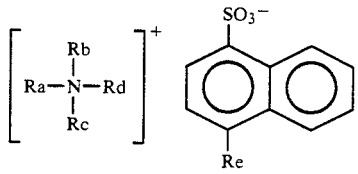

wherein Ra, Rb, Rc and Rd each represent an alkyl group having 1 to 10 carbon atoms, or a phenyl group represented by

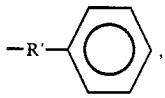

wherein R' represent an alkyl group having 1 to 5 carbon atoms; and Re represents —H, —OH, —COOH or an alkyl group having 1 to 5 carbon atoms.

(E)

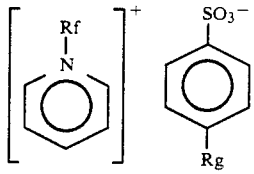

wherein Rf represents an alkyl group having 1 to 5 carbon atoms, and Rg represents —H, —OH, —COOH or an alkyl group having 1 to 5 carbon atoms.

Of the quaternary ammonium salts represented by the above structural formulas (D) and (E), it is particularly preferred to use positive charge control agents represented by the following structural formulas (D-1), (D-2) and (E-1), in view of the advantage that they can exhibit a good chargeability with less evironment dependence.

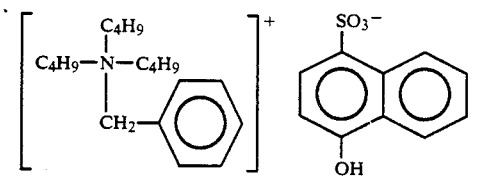
(D-1)

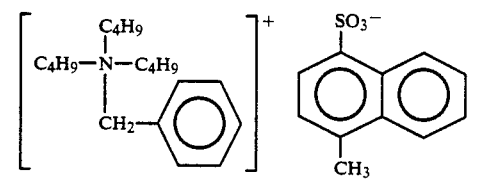
(D-2)

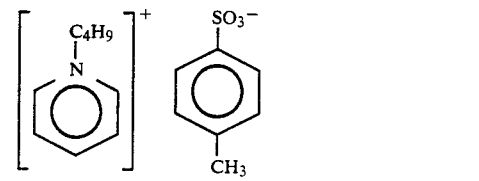
(E-1)

In the case when the amino-containing carboxylate such as dimethylaminomethyl methacrylate capable of exhibiting positive chargeability is used as the resin component of the binder resin in the positively chargeable toner, the positive charge control agent and the negative charge control agent can be used in combination if necessary. In the case of the negatively chargeable toner, the negative charge control agent should preferably be used in an amount of from 0.1 part by weight to 15 parts by weight, and more preferably from 0.5 part by weight to 10 parts by weight, based on 100 parts by weight of the binder resin.

In the case when the amino-containing carboxylate such as dimethylaminomethyl methacrylate capable of exhibiting positive chargeability is not used as the resin component of the binder resin in the positively chargeable toner, the positive charge control agent should preferably be used in an amount of from 0.1 part by weight to 15 parts by weight, and more preferably from 0.5 part by weight to 10 parts by weight, based on 100 parts by weight of the binder resin. In the case when the amino-containing carboxylates are used, the positive charge control agent and/or negative charge control agent should preferably be used in an amount of from 0 to 10 parts by weight, and more preferably from 0 to 8 parts by weight, based on 100 parts by weight of the binder resin, if necessary for the purpose of giving a good chargeability with less environment dependence.

The toner of the present invention may also contain a fluidity improver for the purpose of improving the fluidity of the toner.

As the fluidity improver used in the present invention, any agent can be used so long as its addition to colorant-containing organic resin particles can bring about an increase in fluidity when compared before and after its use.

For example, the fluidity improver may include fluorine-containing resin powders such as fine vinylidene fluoride powder and fine polytetrafluoroethylene powder; fatty acid metal salts such as zinc stearate, calcium stearate and lead stearate; metal oxides such as zinc oxide; and fine powders such as wet process silica, dry process silica, and treated silica obtained by subjecting any of them to particle surface treatment using a surface treatment agent such as a silane coupling agent, a titanium coupling agent and silicone oil.

A preferred fluidity improver is a fine powder produced by vapor phase oxidation of a silicon halide, and refers to those called dry process silica or fumed silica, which can be produced by conventionally known techniques. For example, it is a process that utilizes heat decomposition oxidation reaction in the oxyhydrogen flame of silicon tetrachloride gas. The reaction basically proceeds as follows.

$$SiCl_4+2H_2+O_2 \rightarrow SiO_2+4HCl$$

In this preparation step, it is also possible to use a metal halide such as aluminum chloride or titanium chloride together with the silicon halide to give a composite fine powder of silica and other metal oxide. The fine silica powder of the present invention includes these, too.

The fluidity improver may preferably have a particle diameter ranging from 0.001 to 2 $\mu$ as average primary particle diameter. It is more preferable to use fine silica powder with a particle diameter ranging from 0.002 to 0.2 $\mu$.

Commercially available fine silica powders usable in the present invention, produced by the vapor phase oxidation of the silicon halide, include, for example, those which are on the market under the following trade names. Aerosil 130, 200, 300, 380, TT600, MOX80, MOx170, COK84 (Aerosil Japan, Ltd.); Ca-O-SiL M-5, MS-7, MS-75, HS-5, EH-5 (CABOT CO.); Wacker HDK N 20, V15, N20E, T30, T40 (WACKER-CHEMIE GMBH); D-C Fine Silica (Dow-Corning Corp.); and Fransol (Fransil Co.).

In the present invention, it is more preferred to use a treated fine silica powder, obtained by applying a hydrophobic treatment to the fine silica powder produced by gaseous phase oxidation of the silicon halide. In the treated fine silica powder, particularly preferred is a fine silica powder so treated as to have a hydrophobicity in the range of from 30 to 80 as measured by methanol titration.

As a method for the hydrophobic treatment, the fine silica powder can be made hydrophobic by its chemical treatment with a treatment such as an organic silicon compound capable of reacting with, or being physically adsorbed on, the silica fine powder.

A preferred method includes a method in which the fine silica powder produced by vapor phase oxidation of a silicon halide is treated with an organic silicon compound.

The organic silicon compound may include hexamethyldisilazane, trimethylsilane. trimethylchlorosilane, trimethylethoxysilane, dimethyldichlorosilane, methyltrichlorosilane, allyldimethylchlorosilane, allylphenyldichlorosilane, benzyldimethylohlorosilane, bromomethyldimethylchlorosilane, $\alpha$-chloroethyltriohlorosilane, $\beta$-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyl-disiloxane, and a dimethylpolysiloxane having 2 to 12 siloxane units per molecule and containing a hydroxyl group bonded to each Si in the units positioned at the terminals. These may be used alone or in the form of a mixture of two or more kinds.

The treated fine silica powder may have a particle diameter ranging from 0.003 to 0.1 μ, which can be preferably used. Commercially available products may include TALANOX-500 (Talco Co.) and AEROSIL R-972 (Nippon Aerosil Co., Ltd.).

With regard to the positively chargeable toner, positively chargeable fine silica powder may be used without any difficulty so that not only its fluidity can be improved but also a good chargeability with less environment dependence can be achieved. In order to obtain such positively chargeable fine silica powder, it may be treated with a coupling agent or silicone oil containing an amino group. Such a treatment agent may include aminosilane coupling agents as exemplified by the following:

$H_2NCH_2CH_2CH_2Si(OCH_3)_3$ $H_2NCH_2CH_2CH_2Si(OC_2H_5)_3$ $H_2NCH_2CH_2CH_2\overset{CH_3}{\overset{|}{Si}}(OCH_3)_3$ $H_2NCH_2CH_2NHCH_2CH_2CH_2\overset{CH_3}{\overset{|}{Si}}(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_3C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NHCH_2CH_2CH_2Si(OCH_3)_3$ $H_3COCOCH_2CH_2NHCH_2CH_2NHCH_2CH_2CH_2Si(OCH_3)_3$

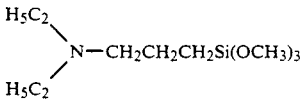

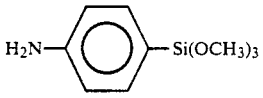

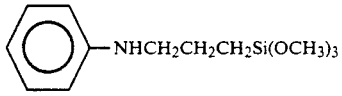

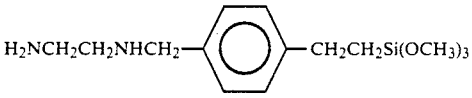

-continued

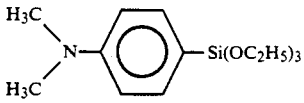

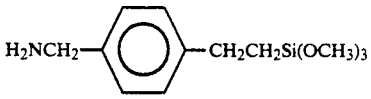

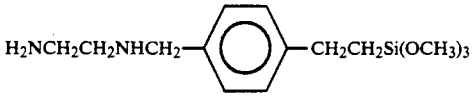

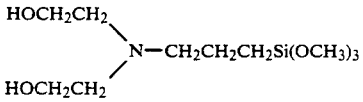

$(H_2CO)_3SiCH_2CH_2CH_2—NHCH_2$

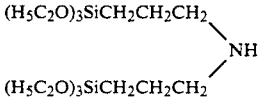

$H_2CNHCH_2CH_2CH_2Si(OC_2H_5)_3$ $H_2N(CH_2CH_2NH)_2CH_2CH_2CH_2Si(OCH_3)_3$ $H_3C—NHCONHC_3H_6Si(OCH_3)_3$

As for the silicone oil, an amino-modified silicone oil is used which has a partial structure having an amino group on the side chain as represented by the following structural formula (G).

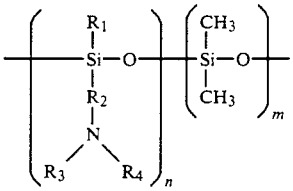

(G)

wherein $R_1$ represents a hydrogen atom, an alkyl group, an aryl group or an alkoxyl group; $R_2$ represents an alkylene group or a phenylene group; and $R_3$ and $R_4$ each represent a hydrogen atom, an alkyl group or an aryl group. The above alkyl group, aryl group, alkylene group and phenylene group may each contain amine, and may also have a substituent such as a halogen so long as the chargeability is not damaged. The letter symbols m and n each represent a positive integer.

The silicone oil having such an amino group can be exemplified by the following:

| Trade name | Viscosity at 25° C. (cps) | Amine equivalent |
|---|---|---|
| SF8417 (Toray Silicone Co., Ltd.) | 1,200 | 3,500 |

-continued

| Trade name | Viscosity at 25° C. (cps) | Amine equivalent |
|---|---|---|
| KF393 (Shin-Etsu Chemical Co., Ltd.) | 60 | 360 |
| KF857 (Shin-Etsu Chemical Co., Ltd.) | 70 | 830 |
| KF860 (Shin-Etsu Chemical Co., Ltd.) | 250 | 7,600 |
| KF861 (Shin-Etsu Chemical Co., Ltd.) | 3,500 | 2,000 |
| KF862 (Shin-Etsu Chemical Co., Ltd.) | 750 | 1,900 |
| KF864 (Shin-Etsu Chemical Co., Ltd.) | 1,700 | 3,800 |
| KF865 (Shin-Etsu Chemical Co., Ltd.) | 90 | 4,400 |
| KF369 (Shin-Etsu Chemical Co., Ltd.) | 20 | 320 |
| KF383 (Shin-Etsu Chemical Co., Ltd.) | 20 | 320 |
| X-22-3680 (Shin-Etsu Chemical Co., Ltd.) | 90 | 8,800 |
| X-22-380D (Shin-Etsu Chemical Co., Ltd.) | 2,300 | 3,800 |
| X-22-3801C (Shin-Etsu Chemical Co., Ltd.) | 3,500 | 3,800 |
| X-22-3810B | 1,300 | 1,700 |

In the foregoing, the amine equivalent refers to the equivalent per amine (g/equiv), which is a value obtained by dividing the molecular weight by the amine number per molecule.

The fine silica powder treated with such coupling agent or silicone oil containing an amino group may preferably be further subjected to hydrophobic treatment using the organic silicon compound previously described, and then put into use.

In instances in which the toner according to the present invention is used in two-component developers, a carrier plays an important roll, which is used so as for the toner to be well effective. The carrier that can be used in the present invention may include, for example, surface-oxidized or -unoxidized particles of metals such as iron, nickel, copper, zinc, cobalt, manganese, chromium and rare earth elements, or alloys or oxides of any of these, and ferrites. There are no particular limitations on the method of preparing them.

The system in which particle surfaces of the carrier described above are coated with a resin is particularly preferable in the J/B development process. As methods therefor, it is possible to use any conventionally known methods such as a method in which a coating material such as resin is dissolved or suspended in a solvent and then the solution or suspension is adhered to the carrier particles by coating, and a method in which they are merely mixed in the form of powder.

The material to be adhered to the carrier particle surfaces, though variable depending on the material for toners, can be exemplified by polytetrafluoroethylene, moncohlorotrifluoroethylene polymer, polyvinylidene fluoride, silicone resin, polyester resin, metal complexes of di-tertbutylsalicylic acid, styrene resins, acrylic resins, polyamide, polyvinyl butyral, Nigrosine, aminoacrylate resin, basic dyes or lakes thereof, fine silica powder, and fine alumina powder, any of which can be used alone or in plurality. Examples are by no means limited to these.

The amount in which the above compound is used for the treatment may be appropriately so determined that the carrier can satisfy the above conditions. In general, such a compound may be used in an amount of from 0.1 to 30% by weight, and preferably from 0.5 to 20% by weight, in total weight based on the weight of the carrier used in the present invention Any of these carriers may preferably have an average particle diameter of from 10 to 100 μm, and more preferably from 20 to 70 μm.

As a particularly preferred embodiment, the carrier may include Cu-Zn-Fe three-component ferrites whose particle surfaces are coated with a combination of resins such as a fluorine resin and a styrene resin, as exemplified by a mixture of polyvinylidene fluoride with styrene-methyl methacrylate resin, polytetrafluoroethylene with styrene-methyl methacrylate resin, or a fluorine copolymer with a styrene copolymer, mixed in a proportion of from 90:10 to 20:80, and preferably from 70:80 to 30:70, and which are coated ferrite carriers so coated in a coating weight of from 0.01 to 5% by weight, and preferably from 0.1 to 1% by weight, on the basis of total weight, containing 70% by weight of carrier particles of 250 mesh-pass and 400 mesh-on and having the average particle diameter as described above. The fluorine copolymer can be exemplified by a vinylidene fluoride/tetrafluoroethylene copolymer (10:90 to 90:10). The styrene copolymer can be exemplified by a styrene/2-ethylhexyl acrylate copolymer (20:80 to 80:20) and a styrene/2-ethylhexyl acrylate/-methyl methacrylate copolymer (20 to 60:5 to 30:10 to 50). The foregoing coated ferrite carriers have a sharp particle size distribution, can' give a triboelectric chargeability preferable for the toner according to the present invention, and are effective for more improving electrophotographic performances In the case when the two-component developer is prepared by mixture of the toner according to the present invention, the toner may be mixed in an amount of from 2 to 15% by weight, preferably from 4 to 13% by weight, in terms of toner concentration in the developer, within the range of which good results can be obtained. A toner concentration less than 2% by weight gives a diffculty in practical use because of a low image density, and on the other hand a toner concentration more than 15% by weight may result in an increase in fogging or in-machine toner scatter to shorten the service life of the developer.

Methods of measurement in the present invention will be described below.

(1) Measurement of Glass Transition Temperature Tg

In the present invention, the glass transition point is measured using a differential scanning calorimeter (DSC measuring device), DSC-7 (manufactured by Perkin-Elmer Inc.). A sample to be measured is precisely weighed in a quantity of 5 to 20 mg, and preferably 10 mg.

The sample to be measured is put in an aluminum pan. Using an empty aluminum pan as a reference, the measurement is carried out in an environment of normal temperature and normal humidity at a measuring temperature range between 30° C. and 200° C., raised at a rare of 10° C./min. During this temperature rise, an endothermic peak of the main peak in the range of temperatures 40° C. to 100° C. is obtained. The point at which the line at a middle point of the base lines before and after appearance of the endothermic peak and the differential thermal curve intersect is regarded as the glass transition point Tg in the present invention.

(2) Measurement of Molecular Weight

In the present invention, the molecular weight on the chromatogram obtained by GPC (gel permeation chromatography) are measured under the following conditions.

Columns are stabilized in a heat chamber of 40° C. To the columns kept at this temperature, THF (tetrahydrofuran) as a solvent is flowed at a flow rate of 1 ml per minute, and 50 μl to 200 μl of a THF sample solution of a resin prepared to have a sample concentration of from 0.05 to 0.6% by weight is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use, for example, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toyo Soda Manufacturing Co., Ltd.. and to use at least about 10 standard polystyrene samples. An RI (refractive index) detector is used as a detector.

Columns should be used in combination of a plurality of commercially available polystyrene gel columns so that the regions of molecular weights of from $10^3$ to $2\times10^6$ can be accurately measured. For example, they may preferably comprise a combination of μ-Styragel 500, $10^3$, $10^4$ and $10^5$, available from Waters Co.; a combination of Shodex KF-80M, KF-801, 803, 804 and 805, or a combination of KA-802, 803, 804 and 805, available from Showa Denko K. K.; or a combination of TSKgel G1000H, G2000H, G2500H, G3000H, G4000H, G5000H, G6000H, G7000H and GMH, available from Toyo Soda Manufacturing Co., Ltd.

(3) Acid Value

The acid value is important as a value that precisely indicates in a short time the state of progress of esterification. Inspection of the esterification is commonly started from acid vlaue of about 80 and terminated at a value between about 20 to 50 as occasion demands. Herein, the acid value refers to the number of milligrams of potassium hydroxide required to neutralize carboxyl groups contained in 1 g of a sample. Thus, this means that the acid value indicates the number of terminal groups. Its measurement is carried out in the following way.

In a 200 to 300 ml Erlenmeyer flask, the sample is weighed in a quantity of from 2 to 10 g, and 50 ml of a mixed solvent of methanol and toluene in 30:70 is added thereto to dissolve the resin. If the solubility is poor, a small amount of acetone may be added. Using a mixed indicator of 0.1% Bromothymol Blue and Phenol Red, titration is carried out with a previously standardized N/10 potassium hydroxide-alcohol solution. On the basis of the consumption of the alcohol-potassium solution, the acid value is determined according to the following calculation.

$$\textit{Acid value} = KOH\ (\textit{ml number}) \times N \times 56.1/\textit{weight of sample}$$

(wherein N is a factor of N/10KOH)

(4) Average Particle Diameter of Domain Particles

In the present invention, the average particle diameter of domain particles is measured, for example under the following conditions. About 0.1 g of binder resin is put on a glass plate, and is softened by means of a hot plate. After the binder resin has been softened, 2 to 3 droplets of Rhodamine dye dissolved in ethanol are dropped. Immediately after the dye has been dropped, a glass cover is put thereon, which is kept held down to prepare a thin-layer binder resin/Rhodamin dye sample. (In the case when the resin that forms the domain particles is comprised of the polymer having carboxyl groups and the resin that forms the matrix is comprised of the polymer having no carboxyl group, the Rhodamine dye dissolved in ethanol is attracted to the carboxyl groups, so that the domain particles are selectively colored. In the case when the resin that forms the matrix is comprised of the polymer having carboxyl groups and the resin that forms the domain particles is comprised of the polymer having no carboxyl group, the Rhodamine dye dissolved in ethanol selectively colors the matrix. Furthermore, in the case when the vinyl resin is used as the resin that forms the domain particles and the polyester is used as the resin that forms the matrix, the matrix in which he polyester is used is more deeply colored than the domain particles in which the vinyl resin is used.)

This sample is observed with an optical microscope (×1,000), and photographs that cover at least four visual fields are taken at random. In these photographs thus taken, particles that can be visually distinguished are measured for their particle diameters. An average value of the particle diameters measured by the above method is determined according to the following expression to find the average particle diameter d of the domain particles.

$$(d_1+d_2+\ldots+D_n)/n=d$$

When this method can not be applied, there is another method in which, using osmic acid or rhuthenic acid as the dye, the domain particles are dyed in the same manner as the above, and then, after leaves are prepared, the state of dispersion of domain particles is observed using a transmission type electron microscope, followed by measurement of an average particle diameter of the domain particles according to the same method as the above.

(5) Measurement of Triboelectric Charges

Figure 2:
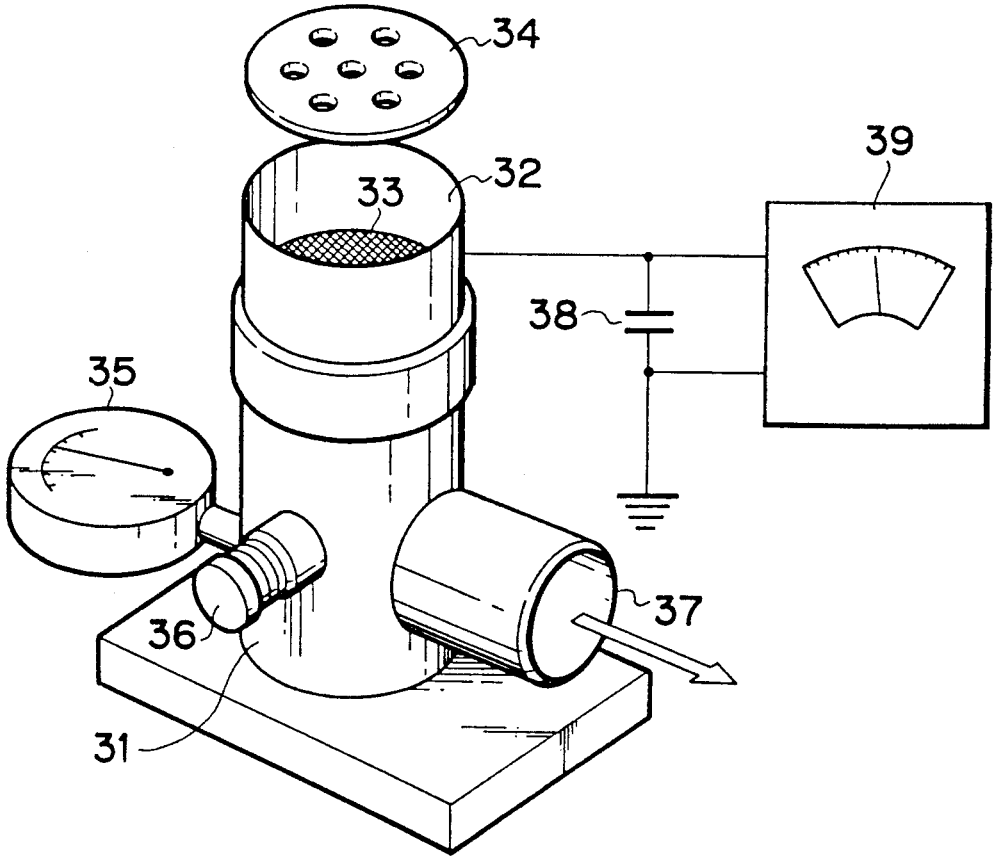
FIG. 2 illustrates an apparatus for measuring quantity of triboelectricity, used in the present invention.
Figure 3:
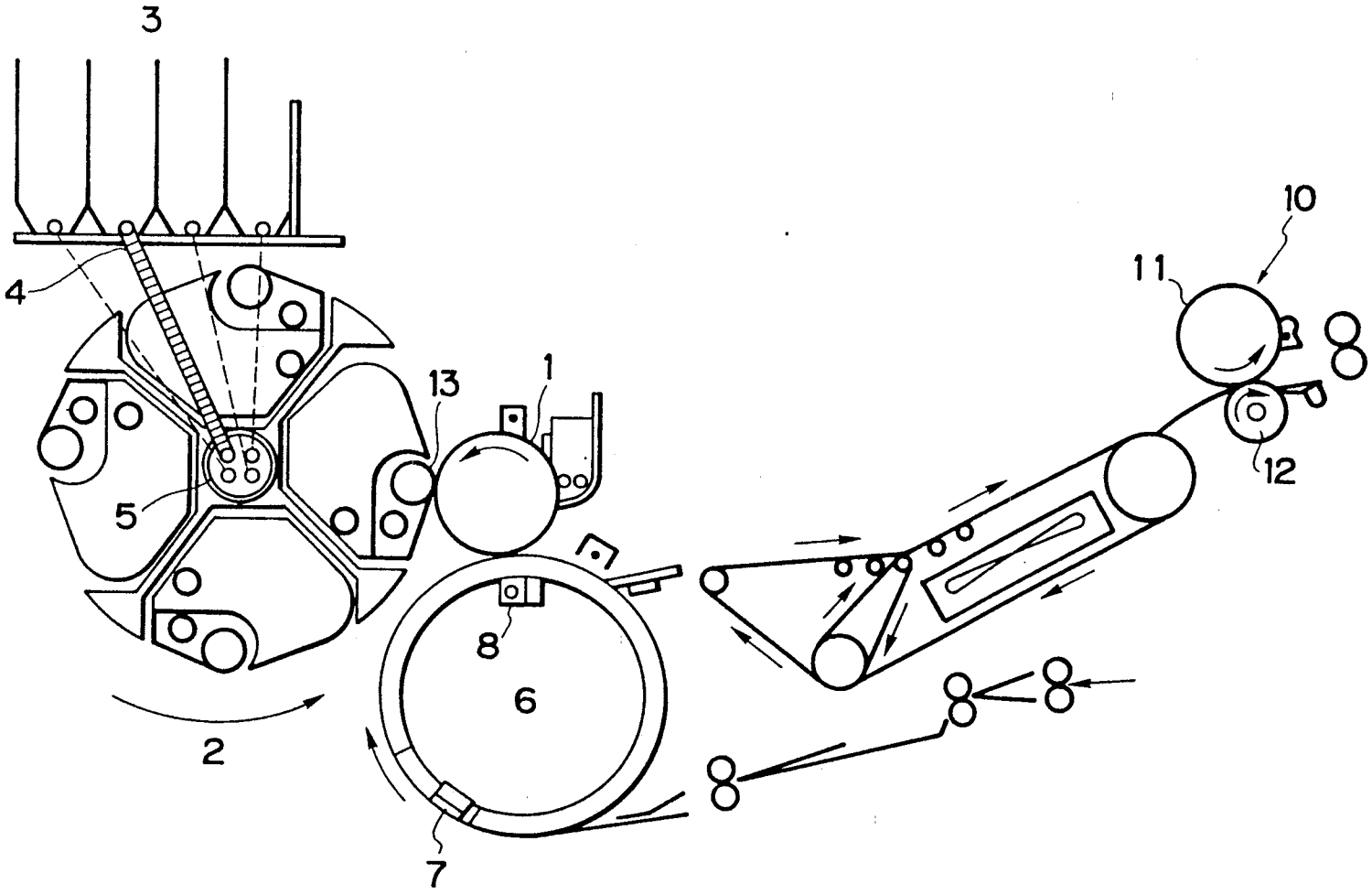
FIG. 3 cross-sectionally illustrates an example of the constitution of the image forming apparatus according to the present invention.

FIG. 2 illustrates an apparatus for measuring the quantity of triboelectricity. First, a mixture of i) particles the quantity of triboelectricity of which is to be measured and ii) magnetic particles used in a developer is prepared. They are mixed in a proportion of 5 parts by weight of the former particles to 95 parts by weight of the magnetic particles in the case of the toner and colorant-containing fine particles, and in a proportion of 2 parts by weight of the former particles to 98 parts by weight of the magnetic particles in the case of fluidity-providing agents.

The particles the quantity of triboelectricity of which is to be measured and the magnetic particles are placed in a measurement environment, and left to stand for 12 hours or more. Thereafter, these are put in a bottle made of polyethylene, and thoroughly mixed with stirring.

Next, the mixture of the particles the quantity of triboelectricity of which is to be measured and the magnetic particles is put in a measuring container 32 made of a metal at the bottom of which a conductive screen 33 of 500 meshes (the size is appropriately changeable so as for the magnetic particles not to pass) is provided, and the container is covered with a plate 34 made of a metal. The total weight of the measuring container 32 in this state is weighed and is expressed as $W_1$ (g). Next, in a suction device 31 (made of an insulating material at least at the apart coming into contact with the measuring container 32), air is sucked from a suction opening 37 and an air-flow control valve 36 is operated to control the pressure indicated by a vacuum indicator 35 to be 250 mmHg. In this state, suction is sufficiently carried out (preferably for about 2 minutes) to remove the toner by suction. The potential indicated by a potentiometer 39 at this time is expressed as V (volt). Herein, the numeral 38 denotes a capacitor, whose capacitance is expressed as C (μF). The total weight of the measuring container after completion of the suction is also weighed and is expressed as $W_2$ (g). The quantity of triboelectricity (μc/g) of the toner is calculated as shown by the following expression.

$$T\,(\mu c/g) = \frac{C \times V}{W_1 - W_2}$$

The present inventors have found that the anti-offset properties can be more improved by a method wherein, in a fixing device comprised of a fixing roller and a pressure roller, i) when a blank sheet of paper is passed through the rollers the sheet is outputted in the direction inclined toward the pressure roller side with respect to the direction perpendicular to a line connecting the center of the fixing roller and the center of the pressure roller, and also ii) a developer making use of the resin composition of the present invention is used in combination with the device.

Use of this fixing device and the developer making use of the resin composition of the present invention makes it possible to obtain copied images with a good color reproduction and to dramatically improve the durability of the fixing roller.

The fixing device used in the present invention may be so designed that when a blank sheet of paper is passed the sheet is outputted in the direction inclined toward the pressure roller side with respect to the direction perpendicular to a line connecting the center of the fixing roller 11 and the center of the pressure roller 12. Thus it is possible to more improve anti-offset properties (see FIG. 4).

Figure 4:
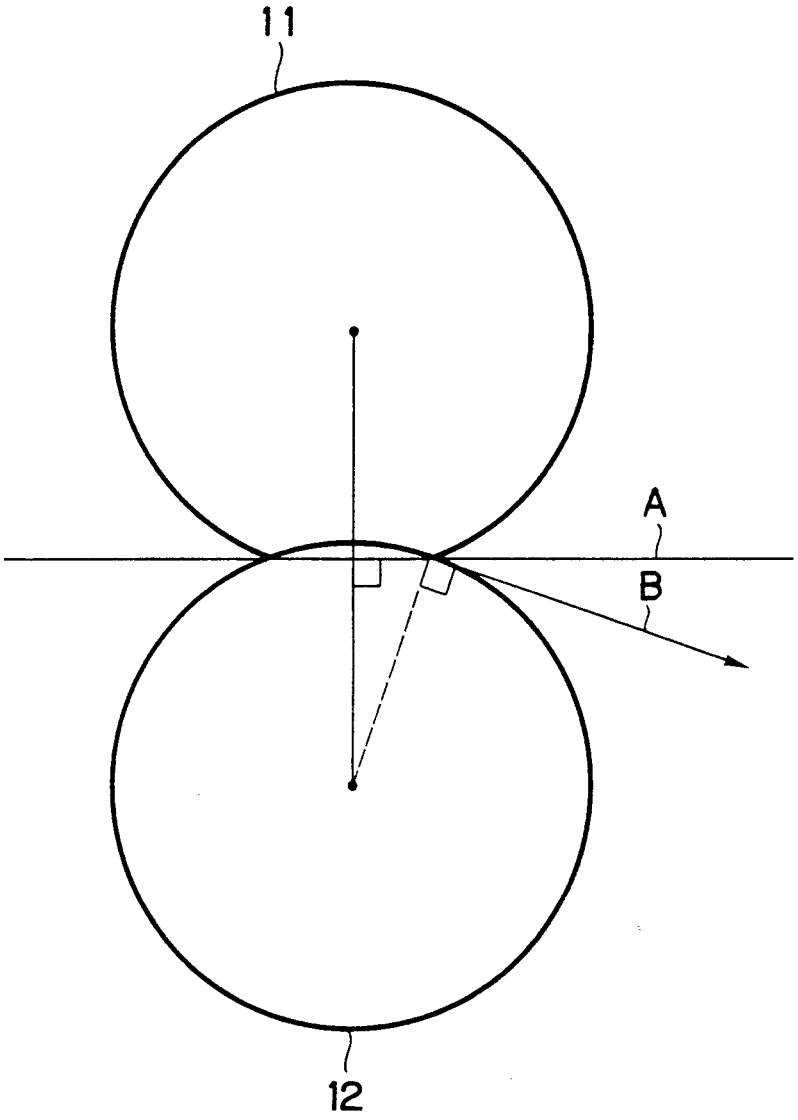
FIG. 4 is a view to show the positional relationship between a fixing roller and a pressure roller at a fixing zone in which a transfer medium is outputted in the direction inclined toward the pressure roller side.
Figure 5:
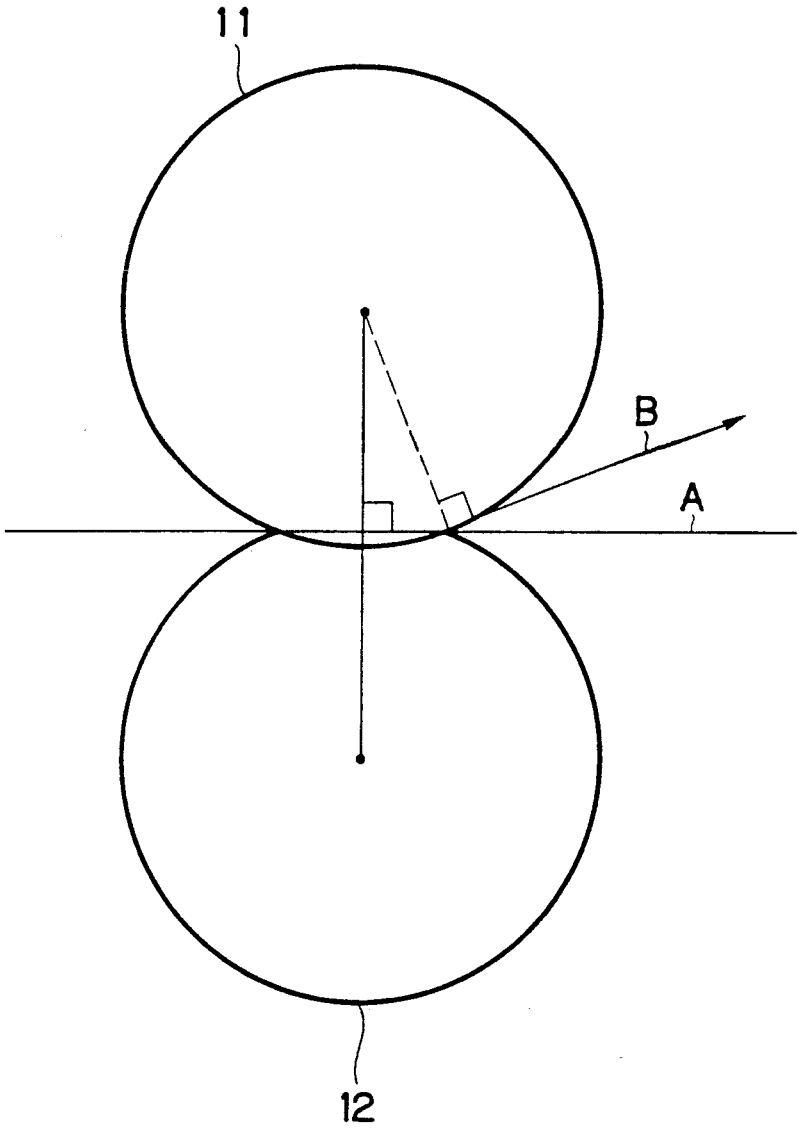
FIG. 5 is a view to show the positional relationship between a fixing roller and a pressure roller at a fixing zone in which a transfer medium is outputted in the direction inclined toward the fixing roller side.

In FIGS. 4 and 5, A denotes perpendicular line with respect to line connecting the center of the fixing roller and the center of the pressure roller and B denotes blank paper output direction.

The paper output direction can be controlled to be on the pressure roller side, for example, in the following way:

(1) The pressure roller is made to have a hardness higher than the hardness of the fixing roller. The pressure roller can be made to have such a higher hardness by a method including i) a method in which an elastic material fitted to the mandrel is made to have a higher hardness than that of the fixing roller and ii) a method in which, when the same elastic material as that of the fixing roller is used, the elastic material layer is made thinner than that of the fixing roller to provide a hard one as the roller; and (2) The fixing roller is made to have a larger diameter than the diameter of the pressure roller.

A heating device may be fitted not only on the side of the fixing roller but also on the side of the pressure roller, so that the anti-offset properties can be more improved than the instance where it is fitted only on the side of the fixing roller.

The fixing device in which such a method is employed may include a roller comprising as the fixing roller an elastic material comprised of a silicone rubber, which is of an RTV (room-temperature vulcanization) type or LTV (low-temperature vulcanization) type, and a roller having a double-layer structure, provided with an HTV layer as a lower layer so that the rubber may be less swelled by a fixing oil and an RTV or LTV layer as an upper layer so that the wetting to the fixing oil can be improved. The rubber of the fixing roller should have a hardness (JIS-A; in the case of two layers, a hardness in total of the two layers) of 30° to 70°, and preferably 35° to 60°, and a layer thickness of preferably from 0.5 mm to 5 mm, and more preferably 1.0 mm to 3.5 mm. The rubber of the pressure roller should preferably have a hardness of not less than 40°, and more preferably not less than 50°.

The diameter of the fixing roller can not be made so large since it is demanded to make copying machines smaller in size. An excessively small diameter of the fixing roller can not provide a sufficient nip between rolls and hence can not allow the toner to sufficiently melt, resulting in a poor color mixing performance or making it necessary to drop the fixing speed in order to achieve a good color mixing performance. Hence, it is preferable for the fixing roller and the pressure roller each to have a roller diameter of from 40 mmϕ to 80 mmϕ.

The image forming method and apparatus will be described below with reference to FIGS. 6 to 9, taking as an example an image forming apparatus for developing a latent image formed on a negatively charged latent image bearing member, using a one-component developer comprising a positively chargeable magnetic toner. The image forming method and apparatus of the present invention may include not only those making use of the one-component developer but also those making use of the two-component developer.

Figure 6:
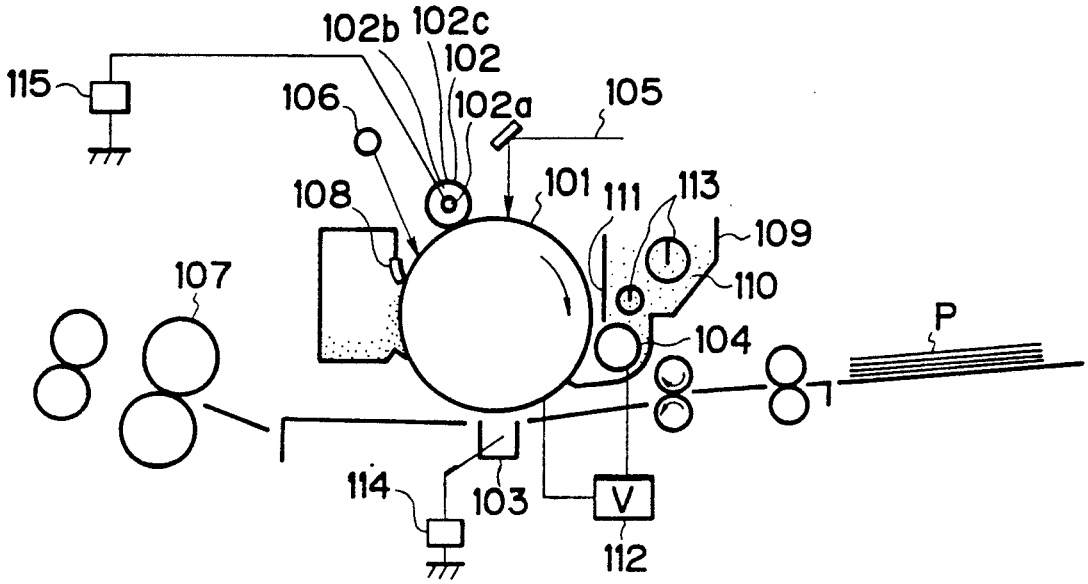
FIG. 6 schematically illustrates an example of the image forming apparatus of the present invention FIG. 7 schematically illustrates an example of the charging means according to the present invention.

In FIG. 6, reference numeral 102 denotes a charging roller which is a charging means brought into contact with a latent image bearing member 101 at a given pressure, and is comprised of, as shown in FIG. 6, a metal mandrel **102*a*, a conductive rubber layer 102*b* provided thereon, and further provided on its external surface a surface layer 102*c*, a release film. The conductive rubber layer may preferably have a thickness of from 0.5 to 10 mm, and preferably from 1 to 5 mm. The surface layer 102*c* comprises a release film. It is preferred to provide this release film so that a softening agent can be prevented from exuding from the conductive rubber layer 102*b*** to the part at which the electrostatic image bearing member which is a chargeable member (photosensitive member) comes into contact. Hence, it becomes possible to prevent any smeared image from being caused by the photosensitive member turned to have a low resistance as a result of the adhesion of the softening agent to the photosensitive member, to prevent chargeability from being lowered by the filming of remaining toner to the photosensitive member, and also to prevent charge efficiency from being lowered.

Use of the conductive rubber layer in the charging roller also makes it possible to keep sufficient contact between the charging roller and the photosensitive member, and also causes no charge insufficiency.

The release film may preferably have a thickness of not more than 30 μm, and preferably from 10 to 30 μm. The lower limit of the thickness of the film may be smaller so long as no peel or turn-up may occur, and can be considered to be about 5 μm.

As materials for the release film, a nylon resin PVDF (polyvinylidene fluoride) and PVDC (polyvinylidene chloride) may be used. As materials for a photosensitive layer of the latent image bearing member 101, it is possible to use OPC, amorphous silicon, selenium or ZnO. In particular, in the case when the amorphous silicon is used in the photosensitive member, smeared images may seriously occur when even a slight quantity of the softening agent of the conductive rubber layer 102*b* has been adhered to the photosensitive layer of the latent image bearing member 101, compared with the case when other materials are used. Hence, it can be more effective to provide such an insulative coating on the outside of the conductive rubber layer.

It is one of preferred embodiments that, e.g., Hydrin rubber that may undergo less environmental variations is formed between the conductive rubber layer and the release film surface layer so that leakage to the photosensitive member can be prevented.

Reference numeral 115 denotes a power source which applies a voltage to the charging roller 102, and supplies a given voltage to the metal mandrel 102*a* of the charging roller 102. Reference numeral 103 denotes a transferring charger serving as a transfer means. A given bias voltage is applied to the transferring charger from a constant-voltage power source 114. As conditions for the bias, it is preferred for a current value to be from 0.1 to 50 μA and for a voltage value (absolute value) to be from 500 to 4,000 V.

The surface of the OPC photosensitive member which is the latent image bearing member 101 is, for example, negatively charged by the operation of the charging roller 102 serving as the charging means, having a power source (voltage applying means) 115, and the charged surface is exposed to light by optical image exposure as a latent image forming means 105 to form an electrostatic latent image. The latent image thus formed is developed using a positively chargeable toner-containing one-component developer 110 held in a developing assembly 109 equipped with a non-magnetic developing sleeve 104 serving as a toner carrying member in which a magnetic blade 111 made of iron and a magnet 140 are provided. The developing sleeve 104 is comprised of a stainless steel sleeve (SUS304) having a diameter of 50 mm and a plurality of traced concavities In the developing zone, an AC bias, a pulse bias and/or a DC bias is/are applied across a conductive substrate of the latent image bearing member 101 and the developing sleeve 104 through a bias applying means 112. A transfer paper P is fed and delivered to a transfer zone, where the transfer paper P is electrostatically charged from its back surface (the surface opposite to the latent image bearing member) through a transfer charging assembly 103, so that the developed image (toner image) on the surface of the latent image bearing member 101 is electrostatically transferred to the transfer paper P. The transfer paper P separated from the latent image bearing member 101 is subjected to fixing using a heat-pressure roller fixing unit 107 serving as a fixing means so that the toner image on the transfer paper P can be fixed.

The developer 110 remaining on the latent image bearing member 101 after the transfer step is removed by the operation of a cleaning assembly 108 having a cleaning blade. After the cleaning, the residual charges on the latent image bearing member 101 is eliminated by erase exposure 106, and thus the procedure again starting from the charging step using the contact charging assembly 102 is repeated.

Figure 8:
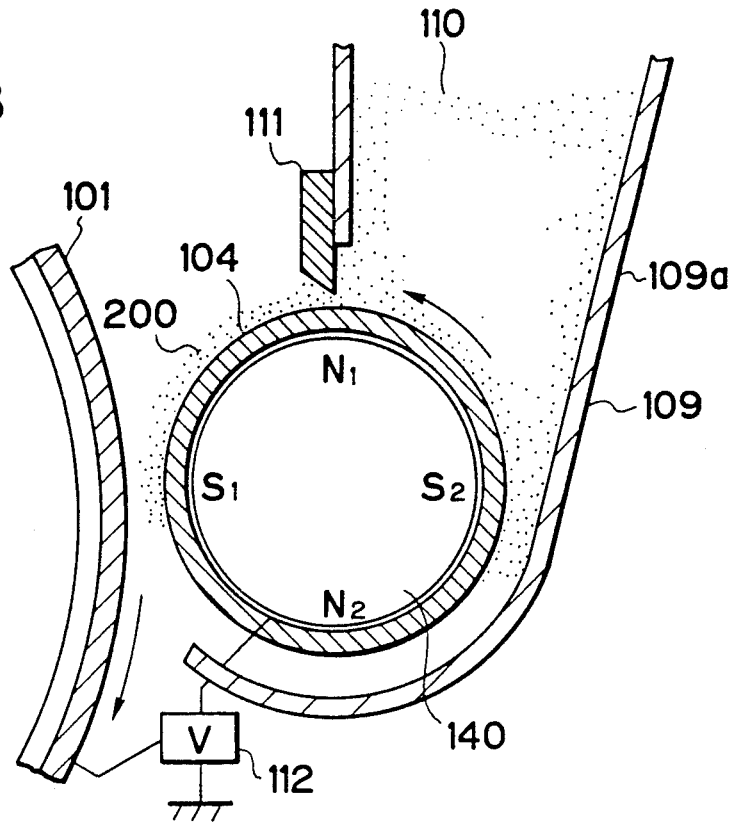
FIG. 8 is a partial enlarged view of the apparatus shown in FIG. 6 to illustrate a developing step.

FIG. 8 is a partially enlarged view of FIG. 6, to illustrate the developing step. The latent image bearing member 101 comprises the OPC photosensitive layer and the conductive substrate as previously described, and is rotated in the direction of an arrow. In the developing zone, the developing sleeve 104, a non-magnetic cylinder, which is the developer carrying member, is rotated so as to move in the same direction as the direction in which the latent image bearing member 101 is rotated. In the inside of the developing sleeve 104, a multi-polar permanent magnet 140 (magnet roll) serving as a magnetic field generating means is provided in an unrotatable state. The multi-polar permanent magnet 140 is preferably set to have magnetic poles consisting of $N_1$: 500 to 900 gausses, $N_2$: 600 to 1,100 gausses, $S_1$: 800 to 1,500 gausses and $S_2$: 400 to 800 gausses. The developer 110 held in the developing assembly 109 is coated on the surface of the developing sleeve 104, and, for example, plus triboelectric charges are imparted to the developer because of the friction between the surface of the sleeve 104 and the developer 110. A magnetic doctor blade 111 made of iron is disposed in proximity (with a space of from 50 μm to 500 μm) to the surface of the cylinder and also opposingly to one of the magnetic pole positions of the multi-polar permanent magnet 140. Thus, the thickness of a toner layer 200 can be controlled to be small (from 30 μm to 300 μm) and uniform so that a toner layer smaller in thickness than the gap between the latent image bearing member 101 and developer carrying member 104 in the developing zone can be formed in a non-contact state. The rotational speed of this developing severe 104 is regulated so that the peripheral speed of the sleeve can be substantially equal or close to the speed of the peripheral speed of the latent image bearing member 101. As the magnetic doctor blade 111, a permanent magnet may be used in place of iron to form an opposing magnetic pole. In the developing zone, the AC bias or pulse bias may be applied through a bias power source 112 serving as the bias applying means, across the developing sleeve 104 and the surface of the latent image bearing member 101. As bias conditions, the AC bias may preferably have a Vpp of from 1,500 to 2,300 V and a frequency (f) of from 900 to 1,600 Hz, and the DC bias, a DC of from −100 to −350 V.

When the developer 110 is moved in the developing zone formed at the part the developing sleeve (the developer carrying member) 104 and the latent image bearing member 101 become closest and in the vicinity thereof, the developer 110 is moved to the side of the latent image bearing member 101 in a to-and-fro movement between the developing sleeve 104 and the latent image bearing member 101 by the electrostatic force of the electrostatic image bearing member surface of the latent image bearing member 101 and the action of the AC bias or pulse bias.

In place of the magnetic doctor blade 111 an elastic blade formed of an elastic material such as silicone rubber may be used so that the layer thickness of the toner layer 200 can be controlled by pressing it against the surface of the latent image bearing member 101 and the toner layer having a given thickness may be formed on the developing sleeve 104.

As for the photosensitive layer of the latent image bearing member 101, the OPC photosensitive member or drum may be replaced with an insulating drum for electrostatic recording or a photoconductive drum having a layer of a photoconductive insulating material such as $\alpha$-Se, CdS, $ZnO_2$ or $\alpha$-Si, any of which can be appropriately selected and used according to developing conditions.

Figure 7:
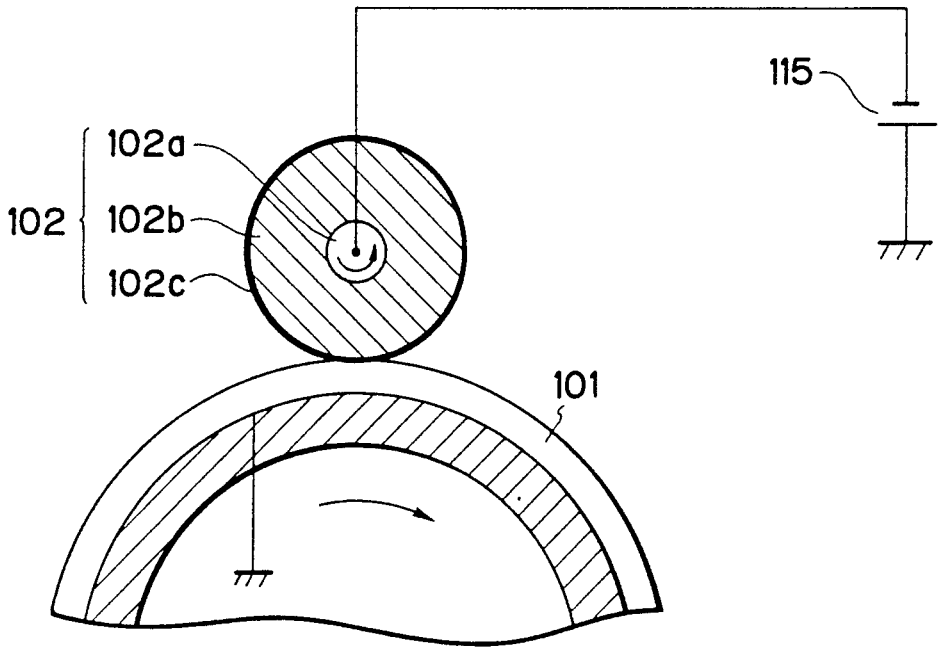
Figure 9:
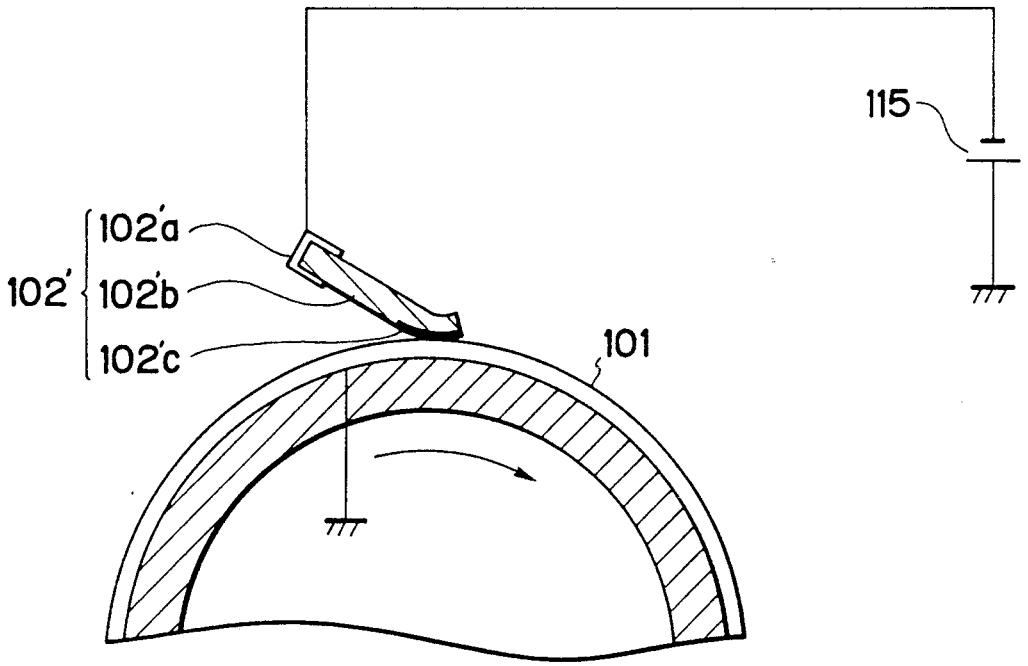
FIG. 9 schematically illustrates another example of the charging means according to the present invention.

FIG. 9 illustrates another embodiment of the charging means that can be used in place of the charging roller shown in FIG. 7. This charging means comprises a blade-shaped contact charging member 102'. This blade-shaped contact charging member 102' also has the same layer structure as the charging roller 102, and is comprised of a holding metal member 102'a to which a voltage is applied, a conductive rubber member 102'b supported by the holding metal member 102'a, and a surface layer 102'c serving as the release film, provided at the part where the conductive rubber layer 102'b comes into contact with the latent image bearing member 101. This embodiment can give the same operation and effect as the charging roller 102.

In the examples described above, the roller-shaped or blade-shaped member is used as the charging member. Without limitation thereto, the present invention can also be carried out using a member with a different shape.

The charging means 102 described above can also be used as a transfer means by bringing it into contact with the latent image bearing member 101 in the state the transfer paper P is held between them.

In the image forming method and apparatus described above, a commonly available charging device which causes the surface of the latent image bearing member 101 to be statically charged by corona discharging can also be used in place of the charging means for negatively (or positively) charging the surface of the latent image bearing member 101.

In the case when the corona charging means is used, ozone is generated in a large quantity, and hence it is preferred to provide an ozone filter or the like.

The resin composition having the domain-matrix structure according to the present invention comprises the resin P1 that constitutes the domain particles and the resin P2 that constitutes the matrix. The resin P1 has a glass transition temperature Tg1 of from 0° C. to 60° C., the resin P2 has a glass transition temperature Tg2 of from 40° C. to 90° C., provided that the glass transition temperature Tg2 of the resin P2 is at least 5° C. higher than the glass transition temperature Tg1 of the resin P1, and the domain particles has an average particle diameter of not larger than 5 $\mu$m. Thus, the resin composition, the toner for developing electrostatic images which makes use of the resin composition, the image fixing method and image forming method which make use of the toner for developing electrostatic images are effective in the following points.

(1) They can achieve low-temperature fixing, and also enjoy a broad fixing temperature range.

(2) The toner has a good storage stability and fluidity, causes no agglomeration, and also has a superior impact resistance.

(3) They give good charge performance and also promise always stable chargeability during use, making it possible to obtain sharp and fog-free images.

(4) Toner images having been fixed using the full-color toners can have smooth fixed-image surfaces not causing irregular reflection of light to hinder color reproduction.

(5) They enable formation of a full-color image having color-mixing performance, not affecting a lower toner layer having a different color tone.

(6) They can well prevent high-temperature offset and give a broad fixing temperature range.

(7) They can achieve anti-offset properties that can be maintained throughout repeated paper feed for fixing.

EXAMPLE

The present invention will be described below in greater detail by giving Examples, by which the present invention is by no means limited. In the following, "part(s)" and "%" refer to "part(s) by weight" and "% by weight", respectively, unless particularly mentioned.

| Resin Preparation Example 1 (Melt Blend of Resins) Polymerization of Resin for Domain Particles | |
|---|---|
| Styrene | 92 g |
| n-Butyl acrylate | 78 g |
| Monobutyl maleate (half ester) | 15 g + 15 g (after 4 hrs) |
| Benzoyl peroxide | 15 g |
| Toluene | 500 g |

Using the above materials, polymerization reaction was carried out at 85° C. for 10 hours. In order to make uniform the compositional distribution in the polymer, the monobutyl maleate was divided into two portions and added by 15 g at the initiation of the polymerization and 4 hours after the initiation, to carry out the reaction. As a result, a copolymer (resin-a) was obtained, having a number average molecular weight (Mn) of 4,600, a weight average molecular weight (Mw) of 13,000, a glass transition temperature (Tg) of 31.9° C. and an acid value of 57.0.

| Polymerization of Resin for Matrix | |
|---|---|
| Styrene | 243 g |
| n-Butyl acrylate | 57 g |
| Benzoyl peroxide | 22.5 g |
| Toluene | 750 g |

Using the above materials, polymerization reaction was carried out at 85° C. for 16 hours. As a result, a copolymer (resin-b) was obtained, having a number average molecular weight (Mn) of 5,400, a weight average molecular weight (Mw) of 15,000, a glass transition temperature (Tg) of 58.5° C. and an acid value of 0.

Next, after the polymerization reaction, polymers having been dried were respectively weighed so as for the resin-a and resin-b to be in a ratio of 3:7, and then the resin-a and resin-b were blended. The blend solution was kept at a temperature of 150° C. and vigorously stirred, followed by rapid cooling to give binder resin 1. This binder resin 1 had a domain average particle diameter of 2 μm. Values of the respective physical properties are shown in Table 1.

| Resin Preparation Example 2 (Polymerization in the Presence of Resin) Polymerization of Resin for Domain Particles | |
|---|---|
| Styrene | 104 g |
| n-Butyl acrylate | 66 g |
| Monobutyl maleate (half ester) | 30 g |
| Benzoyl peroxide | 15 g |
| Toluene | 500 g |

Using the above materials, polymerization reaction was carried out at 85° C. for 10 hours to give a copolymer having a number average molecular weight (Mn) of 5,300, a weight average molecular weight (Mw) of 16,000, a glass transition temperature (Tg) of 42.8° C. and an acid value of 60.0. Next, in this resin solution, polymerization for obtaining the resin for matrix was carried out in the following way.

| Polymerization of Resin for Matrix | |
|---|---|
| Styrene | 165 g |
| n-Butyl acrylate | 35 g |
| Benzoyl peroxide | 15 g |
| Toluene | 500 g |

The above materials were added to the above resin solution, and polymerization reaction was further carried out at 85° C. for 16 hours. As a result, a copolymer was obtained, having a number average molecular weight (Mn) of 5,700 and a weight average molecular weight (Mw) of 15,000. This was dried to give binder resin 2. This binder resin 2 had a domain average particle diameter of 1.5 μm. A resin obtained by polymerizing only the resin materials for matrix had a number average molecular weight (Mn) of 6,300, a weight average molecular weight (Mw) of 14,000, a glass transition temperature (Tg) of 59.0° C. and an acid value of 0. Values of the respective physical properties are shown in Table 1.

RESIN PREPARATION EXAMPLES 3 TO 8

Binder resins 3 to 8 were synthesized in the same manner as in Resin preparation Example 1 or 2 except for changing the amount of the initiator and the monomer weight proportions in Resin Preparation Example 1 or 2. Values of the physical properties of binder resins 3 to 8 thus synthesized and preparation methods used are shown in Table 1.

COMPARATIVE RESIN PREPARATION EXAMPLES 1 to 6

Polymers were obtained by solution polymerization. The resulting polymers as shown in Table 2 are designated as comparative binder resins A, B, D and E. The resulting two kinds of polymers (resin-I and resin-II) as shown in Table 2 were melt-blended to give comparative binder resins C and F.

Monomer composition and values of physical properties of each of the above comparative binder resins A to F are shown in Table 2.

TABLE 1

| Resin prep. Example | Binder resin | Domain particle diam. (μm) | Domain/matrix acid values | Domain/matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 1 | 1 | 2.0 | 57.0/0 | 30/70 | 31.9 | 4,600 | 13,000 | 58.5 | 5,400 | 15,000 | (X) |
| 2 | 2 | 1.5 | 60.0/0 | 50/50 | 42.8 | 5,300 | 16,000 | 59.0 | 6,300 | 14,000 | (Y) |
| 3 | 3 | 0.3 | 62.0/0 | 30/70 | 23.5 | 8,000 | 20,500 | 60.5 | 6,000 | 16,000 | (Y) |
| 4 | 4 | 3.5 | 40.0/0 | 50/50 | 35.6 | 12,000 | 28,000 | 59.5 | 6,500 | 20,000 | (X) |
| 5 | 5 | 4.0 | 50.0/0 | 30/70 | 36.0 | 65,000 | 450,000 | 63.5 | 7,000 | 20,000 | (X) |
| 6 | 6 | 1.0 | 45.0/0 | 50/50 | 43.4 | 48,000 | 350,000 | 61.3 | 10,000 | 25,000 | (Y) |
| 7 | 7 | 0.1 | 32.5/0 | 30/70 | 25.8 | 52,000 | 375,000 | 83.0 | 8,000 | 21,000 | (Y) |
| 8 | 8 | 1.2 | 48.0/0 | 50/50 | 32.5 | 55,000 | 400,000 | 62.3 | 8,800 | 30,400 | (X) |

(X): Melt blend
(Y): Polymerization in the presence of resin

TABLE 2

| (1) | (2) | Resin-I Tg | Resin-I Mn | Resin-I Mw | Resin-II Tg | Resin-II Mn | Resin-II Mw | Resin-I/Resin-II Blend ratio* | Binder resin acid value | Monomer composition |
|---|---|---|---|---|---|---|---|---|---|---|
| 1 | A | 30.5 | 5,000 | 13,000 | — | — | — | — | 60.0 | St-BA-MBM |
| 2 | B | 60.0 | 5,500 | 14,000 | — | — | — | — | 0 | St-BA |
| 3 | C | 31.0 | 5,000 | 13,000 | 59.0 | 5,800 | 16,000 | 30/70 | 0 | St-BA/St-BA |
| 4 | D | 30.0 | 50,000 | 380,000 | — | — | — | — | 62.0 | St-BA-MBM |
| 5 | E | 65.0 | 10,000 | 27,000 | — | — | — | — | 0 | St-BA |
| 6 | F | 33.0 | 45,000 | 370,000 | 62.5 | 7,500 | 21,000 | 30/70 | 0 | St-BA/St-BA |

(1): Comparative Resin Preparation Example
(2): Comparative binder resin
*Melt-blended
St: Styrene
BA: n-Butyl acrylate
MBM: Monobutyl maleate

| Example 1 | |
|---|---|
| Binder resin 1 | 100 parts |
| Styrene/methacrylic acid copolymer | 5.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 μm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine. As a result, color mixture was possible in a fixing temperature range of from 120° C. to 220° C.

Using the above two-component developer, image reproduction was tested with use of CLC-500. As a result, no offset to the fixing roller occurred at all even after copying on 10,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 3.

EXAMPLES 2 TO 4, COMPARATIVE EXAMPLES 1 TO 3

Two-component developers were prepared in the same manner as in Example 1 except that the binder resin 1 was replaced with the binder resins 2 to 4 and the comparative binder resins A to C, respectively. The tests were carried out in the same way. Results obtained are shown in Table 3.

TABLE 3

| Example: | Binder resin | Color mixing temperature range | Running sheet number: Offset to fixing roll | (1) | (2) | (3) | (4) |
|---|---|---|---|---|---|---|---|
| 1 | 1 | 120–220° C. | 10,000 sh.: A | A | A | A | A |
| 2 | 2 | 120–220° C. | 10,000 sh.: A | A | A | A | A |
| 3 | 3 | 115–220° C. | 15,000 sh.: A | A | A | A | A |
| 4 | 4 | 120–210° C. | 15,000 sh.: A | A | A | A | A |
| Comparative Example: | (Comparative binder resin) | | | | | | |
| 1 | A | 85–105° C. | —*: C | A | BC | A | C |
| 2 | B | 150–175° C. | 1,000 sh.**: C | AB | A | B | A |
| 3 | C | 145–180° C. | —*: C* | A | BC | A | C |

(1): Color reproduction
(2): Transport performance
(3): Light transmission properties
(4): Blocking resistance
*Blocking occurred to make the running impossible.
**Offset occurred.
Remarks: Evaluation was made according to five rank system (A, AB, B, BC, C: from "good" to "poor").

| Example 5 | |
|---|---|
| Binder resin 5 | 100 parts |
| Magnetic iron oxide | 70 parts |
| Nigrosine | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was added as a fluidity improver. A one-component developer was thus prepared.

Using this one-component developer thus prepared, unfixed images were obtained with use of a copier NP-4835, manufactured by Canon Inc., and were tested for their fixing performance using an external fixing machine. As a result, fixing was possible in a fixing temperature range of from 120° C. to 250° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 1 to find it good. Results obtained are shown in Table 4.

EXAMPLES 6 TO 8, COMPARATIVE EXAMPLES 4 TO 6

One-component developers were prepared in the same manner as in Example 5 except that the binder resin 5 was replaced with the binder resins 6 to 8 and the comparative binder resins D to F, respectively. The tests were carried out in the same way. Results obtained are shown in Table 4.

TABLE 4

| Example: | Binder Resin | Fixing temperature range | Running sheet number: Offset to fixing roll | Blocking resistance |
|---|---|---|---|---|
| 5 | 5 | 110–250° C. | 100,000 sheets: A | A |
| 6 | 6 | 110–240° C. | 100,000 sheets: A | A |
| 7 | 7 | 105–240° C. | 100,000 sheets: A | A |
| 8 | 8 | 110–250° C. | 100,000 sheets: A | A |
| Comparative Example: | (Comparative binder resin) | | | |
| 4 | D | 85–95° C. | —*: C | C |
| 5 | E | 140–160° C. | 1,000 sheets**: C | A |
| 6 | F | 145–175° C. | —*: C | C |

*Blocking occurred to make the running impossible.
**Offset occurred.
Remarks: Evaluation was made according to five rank system (A, AB, B, BC, C: from "good" to "poor").

| Resin Preparation Example 9 (Melt Blend of Resins) Polymerization of Resin for Domain Particles | |
|---|---|
| Styrene | 88 g |
| n-Butyl acrylate | 76 g |
| Monobutyl maleate (half ester) | 15 g + 15 g (after 4 hrs) |
| Benzoyl peroxide | 10 g |
| Toluene | 500 g |

Using the above materials, polymerization reaction was carried out at 85° C. for 10 hours. In order to make uniform the compositional distribution in the polymer, the monobutyl maleate was divided into two portions and added by 15 g at the initiation of the polymerization and 4 hours after the initiation, to carry out the reaction. As a result, a copolymer (resin-c) was obtained, having a number average molecular weight (Mn) of 5,200, a weight average molecular weight (Mw) of 13,500, a glass transition temperature (Tg) of 32.4° C. and an acid value of 50.0.

| Polymerization of Resin for Matrix | |
|---|---|
| Styrene | 246 g |
| n-Butyl acrylate | 48 g |
| Benzoyl peroxide | 20.5 g |
| Toluene | 750 g |

Using the above materials. polymerization reaction was carried out at 85° C. for 16 hours. As a result, a copolymer (resin-d) was obtained, having a number average molecular weight (Mn) of 5,700, a weight average molecular weight (Mw) of 14,600, a glass transition temperature (Tg) of 59.5° C. and an acid value of 0.

Next, after the polymerization reaction, polymers having been dried were respectively weighed so as for the resin-c and resin-d to be in a ratio of 3:7, and then the resin-c and resin-d were blended. The blend solution was kept at a temperature of 160° C. and vigorously stirred, followed by rapid cooling to give binder resin 9. This binder resin 9 had a domain average particle diameter of 2.6 μm. Values of the respective physical properties are shown in Table 5.

| Resin Preparation Example 10 (Polymerization in the Presence of Resin) Polymerization of Resin for Matrix | |
|---|---|
| Styrene | 163 g |

-continued

| Resin Preparation Example 10 (Polymerization in the Presence of Resin) Polymerization of Resin for Matrix | |
|---|---|
| n-Butyl acrylate | 28 g |
| Benzoyl peroxide | 13 g |
| Toluene | 500 g |

Using the above materials, polymerization reaction was carried out at 85° C. for 10 hours to give a copolymer having a number average molecular weight (Mn) of 5,800, a weight average molecular weight (Mw) of 15,300, a glass transition temperature (Tg) of 60.0° C. and an acid value of 0. Next, in this resin solution, polymerization for obtaining the resin for domain particles was carried out in the following way.

| Polymerization of Resin for Domain Particles | |
|---|---|
| Styrene | 105 g |
| n-Butyl acrylate | 77 g |
| Monobutyl maleate (half ester) | 32 g |
| Benzoyl peroxide | 15 g |
| Toluene | 500 g |

The above materials were added to the above resin solution, and polymerization reaction was further carried out at 85° C. for 16 hours. As a result, a copolymer was obtained, having a number average molecular weight (Mn) of 5,600 and a weight average molecular weight (Mw) of 15,000. This was dried to give binder resin 10. This binder resin 10 had a domain average particle diameter of 1.2 μm. A resin obtained by polymerizing only the resin materials for domain particles had a number average molecular weight (Mn) of 5,300. a weight average molecular weight (Mw) of 15,000, a glass transition temperature (Tg) of 39.5° C. and an acid value of 53.0. Values of the respective physical properties are shown Table 5.

RESIN PREPARATION EXAMPLES 11 AND 12

Binder resins 11 and 12 were synthesized in the same manner as in Resin Preparation Example 9 or 10 except for changing the amount of the initiator and the monomer weight proportions in Resin Preparation Example 9 or 10. Values of the physical properties of binder resins 11 and 12 thus synthesized and preparation methods used are shown in Table 5.

COMPARATIVE RESIN PREPARATION EXAMPLES 7 TO 9

Polymers were obtained by solution polymerization. The resulting polymers as shown in Table 6 are designated as comparative binder resins G and H. The resulting two kinds of polymers (resin-I and resin-II) as shown in Table 6 were melt-blended to give comparative binder resin I.

Monomer composition and values of physical properties of each of the above comparative binder resins G to I are shown in Table 6.

TABLE 5

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 9 | 9 | 2.6 | 50.0/0.0 | 30/70 | 32.4 | 5,200 | 13,500 | 59.5 | 5,700 | 14,600 | (X) |
| 10 | 10 | 1.2 | 53.0/0.0 | 50/50 | 39.5 | 5,300 | 15,000 | 60.0 | 5,800 | 15,300 | (Y) |
| 11 | 11 | 0.4 | 40.0/0.0 | 30/70 | 25.0 | 8,400 | 21,000 | 62.0 | 6,600 | 17,400 | (Y) |
| 12 | 12 | 3.0 | 48.0/0.0 | 50/50 | 36.0 | 11,100 | 23,100 | 58.5 | 6,700 | 21,200 | (X) |

(X): Melt blend
(Y): Polymerization in the presence of resin

TABLE 6

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 7 | G | 32.5 | 5,200 | 12,800 | — | — | — | — | 60.0 | St-BA-MBM |
| 8 | H | 60.4 | 5,800 | 18,000 | — | — | — | — | 0 | St-BA |
| 9 | I | 31.5 | 5,200 | 13,800 | 58.5 | 5,600 | 17,000 | 30/70 | 0 | St-BA/St-BA |

(1): Comparative Resin Preparation Example
(2): Comparative binder resin
*Melt-blended
St: Styrene
BA: n-Butyl acrylate
MBM: Monobutyl maleate

| Example 9 | |
|---|---|
| Binder resin 9 | 100 parts |
| Styrene/methacrylic acid copolymer | 4.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 μm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 5.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine. A fixing roller used therein was comprised of RTV/HTV silicone rubber double layers, having a rubber layer thickness of 2.0 mm, a hardness of 45° and a roller diameter of 40 mm. A pressure roller used therein was comprised of a fluorine type rubber roller having a hardness of 50°, a rubber layer thickness of 1.0 mm and a roller diameter of 40 mm. A heating device was fitted to both the fixing roller and the pressure roller. In a blank paper feed test the paper output direction was inclined toward the pressure roller side.

In the test using such a fixing device, color mixture was possible in a fixing temperature range of from 115° C. to 220° C.

Using this above two-component developer, image reproduction was tested with use of CLC-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 7.

EXAMPLES 10 TO 12, COMPARATIVE EXAMPLES 7 TO 9

Two-component developers were prepared in the same manner as in Example 9 except that the binder resin 9 was replaced with the binder resins 10 to 12 and the comparative binder resins G to I, respectively. The tests were carried out in the same way. Results obtained are shown in Table 7.

EXAMPLE 13

Tests were carried out in the same manner as in Example 9 except that the fixing device used in Example 9 was replaced with a fixing device in which a fixing roller used was comprised of RTV/HTV silicone rubber double layers, having a rubber layer thickness of 2.0 mm, a hardness of 65° and a roller diameter of 40 mm, a pressure roller used was comprised of a fluorine type rubber roller, having a hardness of 50°, a rubber layer thickness of 1.0 mm and a roller diameter of 40 mm, a heating device was fitted only to the fixing roller, and in a blank paper feed test the paper output direction was inclined toward the fixing roller side. Results obtained are shown in Table 7.

TABLE 7

| | | Color mixing temperature range | Running sheet number: Offset to fixing roll | (1) | (2) | (3) | (4) |
|---|---|---|---|---|---|---|---|
| Example: | Binder resin | | | | | | |
| 9 | 9 | 115-220° C. | 20,000 sh.: A | A | A | A | A |
| 10 | 10 | 115-220° C. | 20,000 sh.: A | A | A | A | A |
| 11 | 11 | 115-220° C. | 30,000 sh.: A | A | A | A | A |
| 12 | 12 | 115-215° C. | 30,000 sh.: A | A | A | A | A |
| Comparative Example: | (Comparative binder resin) | | | | | | |
| 7 | G | 90-110° C. | —*: C | A | BC | A | C |
| 8 | H | 145-170° C. | 1,000 sh.**: C | AB | A | B | A |
| 9 | I | 130-150° C. | —*: C* | A | BC | A | C |
| Example: | | | | | | | |
| 13 | 9 | 135-230° C. | 10,000 sh.***: AB | A | A | A | A |

(1): Color reproduction
(2): Transport performance
(3): Light transmission properties
(4): Blocking resistance
*Blocking occurred to make the running impossible.
**Offset occurred.
***No faulty image occurred, but offset toner was adhered to the web for the fixing roller.
Remarks: Evaluation was made according to five rank system
(A, AB, B, BC, C: from "good" to "poor").

| Resin Preparation Example 13 (Melt Blend of Resins) Polymerization of Resin for Domain Particles | |
|---|---|
| Styrene | 94 g |
| n-Butyl acrylate | 82 g |
| Monobutyl maleate (half ester) | 15 g + 15 g (after 4 hrs) |
| Benzoyl peroxide | 12 g |
| Toluene | 500 g |

Using the above materials, polymerization reaction was carried out at 85° C. for 10 hours. In order to make uniform the compositional distribution in the polymer, the monobutyl maleate was divided into two portions and added by 15 g at the initiation of the polymerization and 4 hours after the initiation to carry out the reaction. As a result, a copolymer (resin-e) was obtained, having a number average molecular weight (Mn) of 4,800, a weight average molecular weight (Mw) of 13,300, a glass transition temperature (Tg) of 32.1° C. and an acid value of 50.0.

| Polymerization of Resin for Matrix | |
|---|---|
| Styrene | 240 g |
| n-Butyl acrylate | 60 g |
| Benzoyl peroxide | 21.5 g |
| Toluene | 750 g |

Using the above materials, polymerization reaction was carried out at 85° C. for 16 hours. As a result, a copolymer (resin-f) was obtained, having a number average molecular weight (Mn) of 5,200, a weight average molecular weight (Mw) of 14,300, a glass transition temperature (Tg) of 57.2° C. and an acid value of 0.

Next, after the polymerization reaction, polymers having been dried were respectively weighed so as for the resin-e and resin-f to be in a ratio of 3:7, and then the resin-e and resin-f were blended. The blend solution was kept at a temperature of 160° C. and vigorously stirred, followed by rapid cooling to give binder resin 13. This binder resin 13 had a domain average particle diameter of 2.2 μm. Values of the respective physical properties are shown in Table 8.

| Resin Preparation Example 14 (Polymerization in the Presence of Resin) Polymerization of Resin for Domain Particles | |
|---|---|
| Styrene | 108 g |
| n-Butyl acrylate | 70 g |
| Monobutyl maleate (half ester) | 34 g |
| Benzoyl peroxide | 15 g |
| Toluene | 500 g |

Using the above materials, polymerization reaction was carried out at 85° C. for 10 hours to give a copolymer having a number average molecular weight (Mn) of 5,600, a weight average molecular weight (Mw) of 16,500, a glass transition temperature (Tg) of 41.5° C. and an acid value of 62.0. Next, in this resin solution, polymerization for obtaining the resin for matrix was carried out in the following way.

| Polymerization of Resin for Matrix | |
|---|---|
| Styrene | 168 g |
| n-Butyl acrylate | 32 g |
| Benzoyl peroxide | 15 g |
| Toluene | 500 g |

The above materials were added to the above resin solution, and polymerization reaction was further carried out at 85° C. for 16 hours. As a result, a copolymer was obtained, having a number average molecular weight (Mn) of 6,200 and a weight average molecular weight (Mw) of 15,700. This was dried to give binder resin 14. This binder resin 14 had a domain average particle diameter of 1.3 μm. A resin obtained by polymerizing only the resin materials for matrix had a number average molecular weight (Mn) of 6,500, a weight average molecular weight (Mw) of 15,500, a glass transition temperature (Tg) of 60.1° C. and an acid value of 0. Values of the respective physical properties are shown in Table 8.

RESIN PREPARATION EXAMPLES 15 & 16

Binder resins 15 and 16 were synthesized in the same manner as in Resin Preparation Example 13 or 14 except for changing the amount of the initiator and the monomer weight proportions in Resin Preparation Example 13 or 14. Values of the physical properties of binder resins 15 and 16 thus synthesized and preparation methods used are shown in Table 8.

COMPARATIVE RESIN PREPARATION EXAMPLES 10-12

Polymers were obtained by solution polymerization. The resulting polymers as shown in Table 9 are designated as comparative binder resins J and K. The resulting two kinds of polymers (resin-I and resin-II) as shown in Table 9 were melt-blended to give comparative binder resin L.

Monomer composition and values of physical properties of each of the above comparative binder resins J to L are shown in Table 9.

TABLE 8

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 13 | 13 | 2.2 | 50.0/0 | 30/70 | 32.1 | 4,800 | 13,300 | 57.2 | 5,200 | 14,300 | (X) |
| 14 | 14 | 1.3 | 62.0/0 | 50/50 | 41.5 | 5,600 | 16,500 | 60.1 | 6,500 | 15,500 | (Y) |
| 15 | 15 | 0.5 | 45.0/0 | 30/70 | 24.0 | 8,200 | 20,800 | 62.2 | 6,800 | 17,600 | (Y) |
| 16 | 16 | 2.5 | 25.0/0 | 50/50 | 35.0 | 10,000 | 22,800 | 61.3 | 6,800 | 23,000 | (X) |

(X): Melt blend
(Y): Polymerization in the presence of resin

TABLE 9

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 10 | J | 31.0 | 5,500 | 13,600 | — | — | — | — | 61.8 | St-BA-MBM |
| 11 | k | 59.7 | 5,300 | 13,700 | — | — | — | — | 0 | St-BA |
| 12 | L | 32.0 | 5,400 | 14,100 | 59.5 | 5,900 | 17,900 | 30/70 | 0 | St-BA/St-BA |

(1): Comparative Resin Preparation Example
(2): Comparative binder resin
*Melt-blended
St: Styrene
BA: n-Butyl acrylate
MBM: Monobutyl maleate

| Example 14 | |
|---|---|
| Binder resin 13 | 100 parts |
| Chromium complex of di-tert-butylsalicylic acid | 4.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 μm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 5.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine. A fixing roller used therein was comprised of RTV/HTV silicone rubber double layers, having a rubber layer thickness of 1.8 mm, a hardness of 40° and a roller diameter of 40 mm. A pressure roller used therein was comprised of a fluorine type rubber roller, having a hardness of 50°, a rubber layer thickness of 1.3 mm and a roller diameter of 40 mm. A heating device was fitted to both the fixing roller and the pressure roller. In a blank paper feed test, the paper output direction was inclined toward the pressure roller side.

In the test using such a fixing device, color mixture was possible in a fixing temperature range of from 110° C. to 220° C.

Using the above two-component developer, image reproduction was tested with use of CLC-500. As a result, no offset to the fixing roller occurred at all even after copying on 25,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 10.

EXAMPLES 15 TO 17, COMPARATIVE EXAMPLES 10-12

Two-component developers were prepared in the same manner as in Example 14 except that the binder resin 13 was replaced with the binder resins 14 to 16 and the comparative binder resins J to L, respectively. The tests were carried out in the same way. Results obtained are shown in Table 10.

EXAMPLE 18

Tests were carried out in the same manner as in Example 14 except that the fixing device used in Example 14 was replaced with a fixing device in which a fixing roller used was comprised of RTV/HTV silicone rubber double layers, having a rubber layer thickness of 2.0 mm, a hardness of 65° and a roller diameter of 40 mm, a pressure roller used was comprised of a fluorine type rubber roller, having a hardness of 50°, a rubber layer thickness of 1.0 mm and a roller diameter of 40 mm, a heating device was fitted only to the fixing roller, and in a blank paper feed test the paper output direction was inclined toward the fixing roller side. Results obtained are shown in Table 10.

TABLE 10

| | | Color mixing temperature range | Running sheet number: Offset to fixing roll | (1) | (2) | (3) | (4) |
|---|---|---|---|---|---|---|---|
| Example: | Binder resin | | | | | | |
| 14 | 13 | 110-220° C. | 25,000 sh.: A | A | A | A | A |
| 15 | 14 | 110-220° C. | 25,000 sh.: A | A | A | A | A |
| 16 | 15 | 110-220° C. | 35,000 sh.: A | A | A | A | A |
| 17 | 16 | 110-215° C. | 35,000 sh.: A | A | A | A | A |
| Comparative Example: | (Comparative binder resin) | | | | | | |
| 10 | J | 95-115° C. | —*: C | A | BC | A | C |
| 11 | K | 135-175° C. | 1,000 sh.**: C | AB | A | B | A |
| 12 | L | 130-155° C. | —*: C | A | BC | A | C |
| Example: | | | | | | | |
| 18 | 13 | 125-200° C. | 10,000 sh.: AB | A | A | A | A |

(1): Color reproduction
(2): Transport performance
(3): Light transmission properties
(4): Blocking resistance
*Blocking occurred to make the running impossible.
**Offset occurrred
***No faulty image occurred, but offset toner was adhered to the web for the fixing roller.
Remarks: Evaluation was made according to five rank system
(A, AB, B, BC, C: from "good" to "poor").

| Resin Preparation Example 17 (Melt Blend of Resins) Polymerization of Resin for Domain Particles | |
|---|---|
| Styrene | 92 parts |
| n-Butyl acrylate | 78 parts |
| Monobutyl maleate (half ester) | 15 parts + 15 parts (after 4 hrs) |
| Benzoyl peroxide | 12 parts |
| Toluene | 500 parts |

Using the above materials, polymerization reaction was carried out at 85° C. for 10 hours. In order to make uniform the compositional distribution in the polymer, the monobutyl maleate was divided into two portions and added by 15 parts at the initiation of the polymerization and 4 hours after the initiation, to carry out the reaction. As a result, a copolymer (resin-g) was obtained, having a number average molecular weight (Mn) of 5,000, a weight average molecular weight (Mw) of 13,000, a glass transistion temperature (Tg) of 32.0° C. and an acid value of 56.0.

| Polymerization of Resin for Matrix | |
|---|---|
| Styrene | 243 parts |
| n-Butyl acrylate | 57 parts |

-continued

| Polymerization of Resin for Matrix | |
|---|---|
| Benzoyl peroxide | 22.5 parts |
| Toluene | 750 parts |

Using the above materials, polymerization reaction was carried out at 85° C. for 16 hours. As a result, a copolymer (resin-h) was obtained, having a number average molecular weight (Mn) of 5,500, a weight average molecular weight (Mw) of 15,000, a glass transition temperature (Tg) of 59.0° C. and an acid value of 0.

Next, after the polymerization reaction, polymers having been dried were respectively weighed so as for the resin-g and resin-h to be in a ratio of 3:7, and then the resin-g and resin-h were blended. The blend solution was kept at a temperature of 150° C. and vigorously stirred, followed by rapid cooling to give binder resin 17.

This binder resin 17 had a domain average particle diameter of 1.5 μm. Values of the respective physical properties are shown in Table II.

| Resin Preparation Example 18 (Polymerization in the Presence of Resin) Polymerization of Resin for Matrix | |
|---|---|
| Styrene | 165 parts |
| n-Butyl acrylate | 35 parts |
| Benzoyl peroxide | 15 parts |
| Toluene | 500 parts |

Using the above materials, polymerization reaction was carried out at 85° C. for 10 hours to give a copolymer having a number average molecular weight (Mn) of 5,800, a weight average molecular weight (Mw) of 15,000, a glass transition temperature (Tg) of 60.5° C. and an acid value of 0. Next, in this resin solution. polymerization for obtaining the resin for domain particles was carried out in the following way.

| Polymerization of Resin for Domain | |
|---|---|
| Styrene | 104 parts |
| n-Butyl acrylate | 66 parts |
| Monobutyl maleate | 30 parts |

-continued

| Polymerization of Resin for Domain | |
|---|---|
| Benzoyl peroxide | 15 parts |
| Toluene | 500 parts |

The above materials were added to the above resin solution, and polymerization reaction was further carried out at 85° C. for 16 hours. As a result, a copolymer was obtained, having a number average molecular weight (Mn) of 5,400 and a weight average molecular weight (Mw) of 16,000. This was dried to give binder resin 18. This binder resin 18 had a domain average particle diameter of 0.5 μm. A resin obtained by polymerizing only the resin materials for domain had a number average molecular weight (Mn) of 5,500, a weight average molecular weight (Mw) of 14,000, a glass transition temperature (Tg) of 38.0° C. and an acid value of 54.0. Values of the respective physical properties are shown in Table 11.

RESIN PREPARATION EXAMPLES 19 & 20

Binder resins 19 and 20 were synthesized in the same manner as in Resin Preparation Example 17 or 18 except for changing the amount of the initiator and the monomer weight proportions in Resin Preparation Example 17 or 18. Values of the physical properties of binder resins 19 and 20 thus synthesized and preparation methods used are shown in Table 11.

COMPARATIVE RESIN PREPARATION EXAMPLES 13-18

Polymers were obtained by solution polymerization. The resulting polymers as shown in Table 12 are designated as comparative binder resins M, N, P and Q. The resulting two kinds of polymers (resin-I and resin-II) as shown in Table 12 were melt-blended to give comparative binder resins O and R.

Monomer composition and values of physical properties of each of the above comparative binder resins M to R are shown in Table 12.

TABLE 11

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 17 | 17 | 1.5 | 56.0/0 | 30/70 | 32.0 | 5,000 | 13,000 | 59.0 | 5,500 | 15,000 | (X) |
| 18 | 18 | 0.5 | 54.0/0 | 50/50 | 38.0 | 5,500 | 14,000 | 60.5 | 5,800 | 15,000 | (Y) |
| 19 | 19 | 2.5 | 40.0/0 | 30/70 | 28.0 | 60,000 | 430,000 | 63.5 | 8,000 | 20,000 | (X) |
| 20 | 20 | 2.0 | 45.0/0 | 50/50 | 43.4 | 48,000 | 380,000 | 61.3 | 10,000 | 25,000 | (Y) |

(X): Melt blend
(Y): Polymerization in the presence of resin

TABLE 12

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 13 | M | 30.5 | 5,000 | 12,500 | — | — | — | — | 60.0 | St-BA-MBM |
| 14 | N | 60.0 | 6,000 | 16,000 | — | — | — | — | 0 | St-BA |
| 15 | O | 31.5 | 5,000 | 12,000 | 61.0 | 5,700 | 16,000 | 30/70 | 0 | St-BA/St-BA |
| 16 | P | 31.0 | 60,000 | 450,000 | — | — | — | — | 62.0 | St-BA-MBM |
| 17 | Q | 65.0 | 11,000 | 28,000 | — | — | — | — | 0 | St-BA |
| 18 | R | 31.0 | 65,000 | 440,000 | 63.0 | 9,000 | 25,000 | 30/70 | 0 | St-BA/St-BA |

(1): Comparative Resin Preparation Example
(2): Comparative binder resin
*Melt-blended
St: Styrene
BA: n-Butyl acrylate
MBM: Monobutyl maleate

| Example 19 | |
|---|---|
| Binder resin 17 | 100 parts |
| Chromium complex of di-tert-butylsalicylic acid | 4.0 parts |
| Copper phthalocyanine pigment represented by structural formula (C) | 5.0 parts |
| Calcium laurate (melting points: peaks at 106, 125 142 and 160° C.; melt-starting temperature: 80° C.) | 2.0 parts |
| Low-molecular weight polyethylene wax (melting point 123° C.; melt-starting temperature: 75' C.) | 2.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 μm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine. As a result, color mixture was possible in a fixing temperature range of from 125° C. to 220° C.

Using the above two-component developer, image reproduction was tested with use of CLC-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 13.

EXAMPLE 20

Two-component developers were prepared in the same manner as in Example 19 except that the binder resin 17 was replaced with the binder resin 18 and the low-molecular weight polyethylene wax was replaced with 2 parts of ethylenebislauric acid amide (melting points: 102/52° C.; melt-starting temperature: 90° C.). The tests were carried out in the same way. Results obtained are shown in Table 13.

COMPARATIVE EXAMPLES 13 TO 15

Two-component developers were prepared in the same manner as in Example 19 except that the binder resin 17 was replaced with the comparative binder resins M to O, respectively, and the release agent (low-molecular weight polyethylene) was not used. The tests were carried out in the same way. Results obtained are shown in Table 13.

TABLE 13

| | | Color mixing temperature range | Running sheet number: Offset to fixing roll | (1) | (2) | (3) | (4) | Release agent | |
|---|---|---|---|---|---|---|---|---|---|
| Example: | Binder Resin | | | | | | | | |
| 19 | 17 | 125-220° C. | 20,000 sh.: A | A | A | A | A | Low-molecular weight polyethylene | 2 parts |
| | | | | | | | | Calcium laurate | 2 parts |
| 20 | 18 | 125-220° C. | 20,000 sh.: A | A | A | A | A | Low-molecular weight polyethylene | 2 parts |
| | | | | | | | | Ethylenebislauric acid amide | 2 parts |
| Comparative Example: | (Comparative binder resin) | | | | | | | | |
| 13 | M | 85-100° C. | —*: C | A | BC | A | C | None | |
| 14 | N | 140-165° C. | 1,000 sh.**: C | AB | A | B | A | None | |
| 15 | O | 125-160° C. | —*: C | A | BC | A | C | None | |

(1): Color reproduction
(2): Transport performance
(3): Light transmission properties
(4): Blocking resistance
*Blocking occurred to make the running impossible.
**Offset occurred.
Remarks:
Evaluation was made according to five rank system
(A, AB, B, BC, C: from "good" to "poor").

| Example 21 | |
|---|---|
| Binder resin 19 | 100 parts |
| Magnetic iron oxide | 70 parts |
| Nigrosine | 2 parts |
| Low-molecular weight polyethylene (melting point: 110° C.; melt-starting temperature: 95° C.) | 2 parts |
| Ethylenebislauric acid amide | 2 parts |

The above materials were melt-kneaded using a roll mill, and the kneaded product was cooled, followed by crushing pulverizing and classification to give a black magnetic toner. Based on 100 parts by weight of the resulting black magnetic toner, 0.6 part by weight of positively chargeable dry process silica powder having been made hydrophobic was externally added as a fluidity improver. A one-component developer was thus prepared.

Using this one-component developer thus prepared, unfixed images were obtained with use of a copier NP-4835, manufactured by Canon Inc., and were tested for their fixing performance using an external fixing machine. As a result, fixing was possible in a fixing temperature range of from 130° C. to 250° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 19 to find it good. Results obtained are shown in Table 14.

EXAMPLE 22

A one-component developer was prepared in the same manner as in Example 21 except that the binder resin 19 was replaced with the binder resin 20 and the release agent (low-molecular weight polyethylene) was replaced with 2 parts of low-molecular weight polypropylene (melting point: 150° C.; melt-starting temperature: 110° C.) and 2 parts of a straight chain alkyl alcohol having a number average molecular weight of 700 (melting point: 105° C.; melt-starting temperature: 70° C.). The tests were carried out in the same way. Results obtained are shown in Table 14.

COMPARATIVE EXAMPLES 16 TO 18

One-component developers were prepared in the same manner as in Example 21 except that the binder resin 19 was replaced with the comparative binder resins P to R, respectively, and the release agent (low-molecular weight polyethylene) was not used. The tests were carried out in the same way. Results obtained are shown in Table 14.

TABLE 14

| | | Fixing temperature range | Running sheet number: Offset to fixing roll | Blocking resistance | Release agent |
|---|---|---|---|---|---|
| Example: | Binder Resin | | | | |
| 21 | 19 | 130–250° C. | 100,000 sheets: A | A | (1) |
| 22 | 20 | 120–230° C. | 100,000 sheets: A | A | (2) |
| Comparative Example: | (Comparative binder resin) | | | | |
| 16 | P | 85–105° C. | —*: C | C | None |
| 17 | Q | 135–165° C. | 1,000 sheets**: C | A | None |
| 18 | R | 135–160° C. | —*: C | C | None |

*Blocking occurred to make the running impossible.
**Offset occurred.
(1) Low-molecular weight polyethylene: 2 parts
Ethylenebislauric acid amide: 2 parts
(2) Low-molecular weight polypropylene: 2 parts
Straight-chain alkyl alcohol (Mn: 700): 2 parts
Remarks: Evaluation was made according to five rank system
(A, AB, B, BC, C: from "good" to "poor").

Resin Preparation Example 21
(Melt Blend of Resins)
Polymerization of Resin for Domain Particles

| | |
|---|---|
| Styrene | 96 parts |
| n-Butyl acrylate | 74 parts |
| Monobutyl maleate (half ester) | 15 parts + 15 parts (after 4 hrs) |
| Benzoyl peroxide | 14 parts |
| Toluene | 500 parts |

Using the above materials, polymerization reaction was carried out at 85° C. for 10 hours. In order to make uniform the compositional distribution in the polymer, the monobutyl maleate was divided into two portions and added by 15 parts at the initiation of the polymerization and 4 hours after the initiation, to carry out the reaction. As a result, a copolymer (resin-i) was obtained, having a number average molecular weight (Mn) of 5,200, a weight average molecular weight (Mw) of 13,000, a glass transition temperature (Tg) of 31.5° C. and an acid value of 52.0.

Polymerization of Resin for Matrix

| | |
|---|---|
| Styrene | 249 parts |
| n-Butyl acrylate | 51 parts |
| Benzoyl peroxide | 22.8 parts |
| Toluene | 750 parts |

Using the above materials, polymerization reaction was carried out at 85° C. for 16 hours. As a result, a copolymer (resin-j) was obtained having a number average molecular weight (Mn) of 5,800, a weight average molecular weight (Mw) of 15,500, a glass transition temperature (Tg) of 60.5° C. and an acid value of 0.

Next, after the polymerization reaction, polymers having been dried were respectively weighed so as for the resin-i and resin-j to be in a ratio of 3:7. and then the resin-i and resin-j were blended. The blend solution was kept at a temperature of 150° C. and vigorously stirred, followed by rapid cooling to give binder resin 21.

This binder resin 21 had a domain average particle diameter of 2.0 μm. Values of the respective physical properties are shown in Table 15.

Resin Preparation Example 22
(Polymerization in the Presence of Resin)
Polymerization of Resin for Matrix

| | |
|---|---|
| Styrene | 162 parts |
| n-Butyl acrylate | 33 parts |
| Benzoyl peroxide | 15 parts |
| Toluene | 500 parts |

Using the above materials, polymerization reaction was carried out at 85° C. for 10 hours to give a copolymer having a number average molecular weight (Mn) of 6,100, a weight average molecular weight (Mw) of 16,000, a glass transition temperature (Tg) of 61.8° C. and an acid value of 0. Next, in this resin solution, polymerization for obtaining the resin for domain particles was carried out in the following way.

Polymerization of Resin for Domain Particles

| | |
|---|---|
| Styrene | 108 parts |
| n-Butyl acrylate | 72 parts |
| Monobutyl maleate (half ester) | 27 parts |
| Benzoyl peroxide | 15 parts |
| Toluene | 500 parts |

The above materials were added to the above resin solution, and polymerization reaction was further carried out at 85° C. for 16 hours. As a result, a copolymer was obtained, having a number average molecular weight (Mn) of 5,900 and a weight average molecular weight (Mw) of 15,200. This was dried to give binder resin 22 This binder resin 22 had a domain average particle diameter of 1.0 μm. A resin obtained by polymerizing only the resin materials for domain had a number average molecular weight (Mn) of 5,600, a weight average molecular weight (Mw) of 13,800, a glass transition temperature (Tg) of 36.5° C. and an acid value of 48.0. Values of the respective physical properties are shown in Table 15.

COMPARATIVE RESIN PREPARATION EXAMPLES 19-21

Polymers were obtained by solution polymerization. The resulting polymers as shown in Table 16 are designated as comparative binder resins S and T. The resulting two kinds of polymers (resin-I and resin-II) as shown in Table 16 were melt-blended to give comparative binder resin U.

Monomer composition and values of physical properties of each of the above comparative binder resins S to U are shown in Table 16.

TABLE 15

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 21 | 21 | 2.0 | 52.0/0 | 30/70 | 31.5 | 5,200 | 13,000 | 60.5 | 5,800 | 15,500 | (X) |
| 22 | 22 | 1.0 | 48.0/0 | 50/50 | 36.5 | 5,600 | 13,800 | 61.3 | 6,100 | 16,000 | (Y) |

(X): Melt blend
(Y): Polymerization in the presence of resin

TABLE 16

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 19 | S | 32.0 | 5,100 | 13,200 | — | — | — | — | 60.5 | St-BA-MBM |
| 20 | T | 61.0 | 6,000 | 17,000 | — | — | — | — | 0 | St-BA |
| 21 | U | 30.5 | 5,500 | 13,500 | 61.0 | 6,000 | 16,500 | 30/70 | 0 | St-BA/St-BA |

(1): Comparative Resin Preparation Example
(2): Comparative binder resin
*Melt-blended
St: Styrene
BA: n-Butyl acrylate
MBM: Monobutyl maleate

| Example 23 | |
|---|---|
| Binder resin 21 | 100 parts |
| Chromium complex of di-tert-butylsalicylic acid | 4.0 parts |
| Copper phthalocyanine pigment represented by structural formula (C) | 5.0 parts |
| Calcium laurate (melting points: peaks at 106, 125, 142 and 160° C.; melt-starting temperature: 80° C.) | 2.0 parts |
| Low-molecular weight polyethylene wax (melting point: 123° C. melt-starting temperature: 75° C.) | 2.0 parts |

The above materials were melt-kneaded using a roll mill, and the kneaded product was cooled followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 pm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 5.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine. A fixing roller used therein was comprised of RTV/HTV silicone rubber double layers, having a rubber layer thickness of 1.8 mm, a hardness of 40° and a roller diameter of 40 mm. A pressure roller used therein was comprised of a fluorine type rubber roller, having a hardness of 50°, a rubber layer thickness of 1.3 mm and a roller diameter of 40 mm. A heating device was fitted to both the fixing roller and the pressure roller. In a blank paper feed test, the paper output direction was inclined toward the pressure roller side.

As a result, color mixture was possible in a fixing temperature range of from 110° C. to 220° C.

Using the above two-component developer, image reproduction was tested with use of CLC-500. As a result, no offset to the fixing roller occurred at all even after copying on 40,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 17.

EXAMPLE 24

A two-component developer was prepared in the same manner as in Example 23 except that the binder resin 21 was replaced with the binder resin 22 and the release agent (low-molecular weight polyethylene) was replaced with 2 parts of ethylenebislauric acid amide (melting points: 102° C., 152° C. melt-starting temperature: 90° C.) and 2 parts of low-molecular weight polyethylene. The tests were carried out in the same way. Results obtained are shown in Table 17.

COMPARATIVE EXAMPLES 19 TO 22

Two-component developers were prepared in the same manner as in Example 23 except that the binder resin 21 was replaced with the comparative binder resins S to U, respectively, and the release agent (low-molecular weight polyethylene) was not used. The tests were carried out in the same way. Results obtained are shown in Table 17.

EXAMPLE 25

Tests were carried out in the same manner as in Example 23 except that the fixing device used in Example 23 was replaced with a fixing device in which a fixing roller used was comprised of RTV/HTV silicone rubber double layers, having a rubber layer thickness of 2.0 mm, a hardness of 65° and a roller diameter of 40 mm, a pressure roller used was comprised of a fluorine type rubber roller, having a hardness of 50°, a rubber layer thickness of 1.0 mm and a roller diameter of 40 mm, a heating device was fitted only to the fixing roller, and in a blank paper feed test the paper output direction was inclined toward the fixing roller side. Results obtained are shown in Table 17.

TABLE 17

| | | Color mixing temperature range | Running sheet number: Offset to fixing roll | (1) | (2) | (3) | (4) | Release agent | |
|---|---|---|---|---|---|---|---|---|---|
| Example: | Binder Resin | | | | | | | | |
| 23 | 21 | 110–220° C. | 40,000 sh.: A | A | A | A | A | Low-molecular weight polyethylene | 2 parts |
| | | | | | | | | Calcium laurate | 2 parts |
| 24 | 22 | 110–220° C. | 40,000 sh.: A | A | A | A | A | Low-molecular weight polyethylene | 2 parts |
| | | | | | | | | Ethylenebis lauric acid amide | 2 parts |
| Comparative Example: | (Comparative binder resin) | | | | | | | | |
| 19 | S | 95–120° C. | —*: C | A | BC | A | C | None | |
| 20 | T | 130–170° C. | 1,000 sh.**: C | AB | A | B | A | None | |
| 21 | U | 130–150° C. | —*: C | A | BC | A | C | None | |
| Example: | | | | | | | | | |
| 25 | 21 | 125–200° C. | 10,000 sh.***: A | A | A | A | A | Low-molecular weight polyethylene | 2 parts |
| | | | | | | | | Calcium laurate | 2 parts |

(1): Color reproduction
(2): Transport performance
(3): Light transmission properties
(4): Blocking resistance
*Blocking occurred to make the running impossible.
**Offset occurred.
***No faulty image occurred, but offset toner was adhered to the web for the fixing roller.
Remarks:
Evaluation was made according to five rank system
(A, AB, B, BC, C: from "good" to "poor").

Resin Preparation Example 23
(Melt Blend of Resins)
Polymerization of Resin for Domain Particles

| | |
|---|---|
| Styrene | 120 g |
| Stearyl methacrylate | 80 g |
| Benzoyl peroxide | 15 g |
| Toluene | 500 g |

Using the above materials. polymerization reaction was carried out at 85° C. for 10 hours. As a result, a copolymer (resin-k) was obtained, having a number average molecular weight (Mn) of 5,000, a weight average molecular weight (Mw) of 11,000, a glass transition temperature Tg of 33.0° C. and an acid value of 0.

Polymerization of Resin for Matrix

| | |
|---|---|
| Styrene | 105 g |
| n-Butyl acrylate | 65 g |
| Monobutyl maleate (half ester) | 30 g |
| Benzoyl peroxide | 15 g |
| Toluene | 500 g |

Using the above materials, polymerization reaction was carried out at 85° C. for 16 hours. As a result, a copolymer (resin-l) was obtained, having a number average molecular weight (Mn) of 5,200, a weight average molecular weight (Mw) of 13,500, a glass transition temperature (Tg) of 61.0° C. and an acid value of 60.0.

Next, after the polymerization reaction, polymers having been dried were respectively weighed so as for the resin-k and resin-l to be in a ratio of 3:7, and then the resin-k and resin-l were melt-blended and then vigorously stirred, followed by drying to give binder resin 23.

This binder resin 23 had a domain average particle diameter of 3.0 μm. Values of the respective physical properties are shown in Table 18.

Resin Preparation Example 24
(Polymerization in the Presence of Resin)
Polymerization of Resin for Matrix

| | |
|---|---|
| Styrene | 105 g |
| n-Butyl acrylate | 65 g |
| Monobutyl maleate (half ester) | 30 g |
| Benzoyl peroxide | 15 g |
| Toluene | 500 g |

Using the above materials, polymerization reaction was carried out at 85° C. for 16 hours to give a copolymer having a number average molecular weight (Mn) of 6,000, a weight average molecular weight (Mw) of 14,000, a glass transition temperature (Tg) of 62.0° C. and an acid value of 62.5. Next, in this resin solution, polymerization for obtaining the resin for domain particles was carried out in the following way.

Polymerization of Resin for Domain Particles

| | |
|---|---|
| Styrene | 120 g |
| Stearyl methacrylate | 80 g |
| Benzoyl peroxide | 15 g |
| Toluene | 500 g |

The above materials were added to the above resin solution, and polymerization reaction was further carried out at 85° C. for 16 hours. As a result, a copolymer was obtained, having a number average molecular weight (Mn) of 5,800 and a weight average molecular weight (Mw) of 13,500. This was dried to give binder resin 24. This binder resin 24 had a domain average particle diameter of 3.5 μm. A resin obtained by polymerizing only the resin materials for domain had a number average molecular weight (Mn) of 5,200, a weight average molecular weight (Mw) of 12,000, a glass transition temperature (Tg) of 34.0° C. and an acid value of 0. Values of the respective physical properties are shown in Table 18.

RESIN PREPARATION EXAMPLES 25 & 26

Binder resins 25 and 26 were synthesized in the same manner as in Resin Preparation Example 23 or 24 except for changing the amount of the initiator and the monomer weight proportions in Resin Preparation Example 23 or 24. Values of the physical properties of binder resins 25 and 26 thus synthesized and preparation methods used are shown in Table 18.

COMPARATIVE RESIN PREPARATION EXAMPLES 22-27

Polymers were obtained by solution polymerization. The resulting polymers as shown in Table 19 are designated as comparative binder resins V W, Y and Z. The resulting two kinds of polymers (resin-I and resin-II) as shown in Table 19 were melt-blended to give comparative binder resins X and AA.

Monomer composition and values of physical properties of each of the above comparative binder resins V to X and AA are shown in Table 19.

TABLE 18

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 23 | 23 | 3.0 | 0/60.0 | 30/70 | 33.0 | 5,000 | 11,000 | 61.0 | 5,200 | 13,500 | (X) |
| 24 | 24 | 3.5 | 0/62.5 | 50/50 | 34.0 | 5,200 | 12,000 | 62.0 | 6,000 | 14,000 | (Y) |
| 25 | 25 | 2.0 | 0/50 | 50/50 | 37.0 | 45,000 | 330,000 | 63.0 | 8,000 | 25,000 | (Y) |
| 26 | 26 | 3.0 | 0/55 | 30/70 | 41.0 | 40,000 | 340,000 | 65.0 | 10,000 | 30,000 | (X) |

(X): Melt blend
(Y): Polymerization in the presence of resin

TABLE 16

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 22 | V | 33.0 | 5,000 | 11,000 | — | — | — | — | 0 | St-MS |
| 23 | W | 61.0 | 5,200 | 13,500 | — | — | — | — | 60.0 | St-BA-MBM |
| 24 | X | 33.0 | 5,000 | 11,000 | 62.5 | 5,800 | 13,500 | 50/50 | 0 | St-MS/St-BA |
| 25 | Y | 35.0 | 45,000 | 300,000 | — | — | — | — | | St-MS |
| 26 | Z | 63.5 | 12,000 | 40,000 | — | — | — | — | 50.5 | St-BA-MBM |
| 27 | AA | 35.0 | 45,000 | 300,000 | 62.0 | 11,000 | 35,000 | 50/50 | 0 | St-MS/St-BA |

(1): Comparative Resin Preparation Example
(2): Comparative binder resin
*Melt-blended
St: Styrene
MS: Stearyl methacrylate
BA: n-Butyl acrylate
MBM: Monobutyl maleate

| Example 26 | |
|---|---|
| Binder resin 23 | 100 parts |
| Chromium complex of di-tert-butylsalicylic acid | 4.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 μm: 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using this two-component developer thus prepared, unfixed images were obtained only by development and transfer with use of a full-color copier CLC-500. manufactured by Canon Inc., and were tested for their fixing performance using an external fixing machine.

As a result, color mixture was possible in a fixing temperature range of from 130° C. to 220° C.

Using the above two-component developer, image reproduction was tested with use of CLC-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 20.

EXAMPLE 27, COMPARATIVE EXAMPLES 22 TO 24

Two-component developers were prepared in the same manner as in Example 26 except that the binder resin 23 was replaced with the binder resin 24 and the comparative binder resins V to X, respectively. The tests were carried out in the same way. Results obtained are shown in Table 20.

TABLE 20

| | | Color mixing temperature range | Running sheet number: Offset to fixing roll | (1) | (2) | (3) | (4) |
|---|---|---|---|---|---|---|---|
| Example: | Binder Resin | | | | | | |
| 26 | 23 | 130–220° C. | 20,000 sh.: A | A | A | A | A |
| 27 | 24 | 130–210° C. | 20,000 sh.: A | A | A | A | A |
| Comparative Example: | (Comparative binder resin) | | | | | | |
| 22 | V | 80–110° C. | —*: C | A | C | A | C |
| 23 | W | 160–190° C. | 500 sh.**: C | B | A | B | A |
| 24 | X | 140–180° C. | —*: C | B | BC | B | C |

(1): Color reproduction
(2): Transport performance
(3): Light transmission properties
(4): Blocking resistance
*Blocking occurred to make the running impossible.
**Offset occurred.
Remarks: Evaluation was made according to five rank system
(A, AB, B, BC, C: from "good" to "poor").

| Example 28 | |
|---|---|
| Binder resin 25 | 100 parts |
| Magnetic iron oxide | 70 parts |
| Chromium complex of di-tert-butylsalicylic acid | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of dry process silica powder having been made hydrophobic was externally added as a fluidity improver. A one-component developer was thus prepared.

Using this one-component developer thus prepared, unfixed images were obtained with use of a copier NP-8580, manufactured by Canon Inc., and were tested for their fixing performance using an external fixing machine. As a result, fixing was possible in a fixing temperature range of from 120° C. to 240° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 26 to find it good. Results obtained are shown in Table 21.

EXAMPLE 29, COMPARATIVE EXAMPLES 25 TO 28

One-component developers were prepared in the same manner as in Example 28 except that the binder resin 25 was replaced with the binder resin 26 and the comparative binder resins Y, Z and AA, respectively. The tests were carried out in the same way. Results obtained are shown in Table 21.

TABLE 21

| | | Fixing temperature range | Running sheet number: Offset to fixing roll | Blocking resistance |
|---|---|---|---|---|
| Example: | Binder Resin | | | |
| 28 | 25 | 120–240° C. | 100,000 sheets: A | A |
| 29 | 26 | 120–220° C. | 100,000 sheets: A | A |
| Comparative Example: | (Comparative binder resin) | | | |
| 25 | Y | 90–120° C. | —*: C | C |
| 26 | Z | 170–190° C. | 1,000 sheets**: C | A |
| 27 | AA | 130–170° C. | —*: C | C |

*Blocking occurred to make the running impossible.
**Offset occurred.
Remarks: Evaluation was made according to five rank system
(A, AB, B, BC, C: from "good" to "poor").

| Resin Preparation Example 27 (Melt Blend of Resins) Polymerization of Resin for Domain Particles | |
|---|---|
| Styrene | 120 g |
| n-Butyl acrylate | 80 g |
| Benzoyl peroxide | 15 g |
| Toluene | 500 g |

Using the above materials, polymerization reaction was carried out at 85° C. for 10 hours. As a result, a copolymer (resin-m) was obtained, having a number average molecular weight (Mn) of 4,600 a weight average molecular weight (Mw) of 12,000, a glass transition temperature (Tg) of 32.0° C. and an acid value of 0.

| Polymerization of Resin for Matrix | |
|---|---|
| Styrene | 170 g |
| Butadiene | 30 g |
| Benzoyl peroxide | 15 g |
| Toluene | 500 g |

Using the above materials, polymerization reaction was carried out at 85° C. for 16 hours. After the reaction, 20 g of maleic anhydride was added to carry out the reaction of addition to butadiene unsaturated portions, followed by addition of a small amount of water to effect ring opening. As a result, a copolymer (resin-n) was obtained, having a number average molecular weight (Mn) of 7,000, a weight average molecular weight (Mw) of 21,000, a glass transition temperature (Tg) of 60.0° C. and an acid value of 42.0.

Next, after the polymerization reaction, polymer-toluene solutions were respectively weighed so as for the resin-m and resin-n to be in a ratio of 3:7, and then the resin-m and resin-n were melt-blended, and then vigorously stirred, followed by drying to give binder resin 27.

This binder resin 27 had a domain average particle diameter of 2.5 μm. Values of the respective physical properties are shown in Table 22.

RESIN PREPARATION EXAMPLE 28

Polymerization in the Presence of Resin

Using the same amounts of monomers as in Resin Preparation Example 27, the resin for domain particles was prepared by polymerization. Thereafter, the resin materials for matrix particles were polymerized in the presence of the above resin in their weight ratio of 50/50. After the reaction was completed, 20 g of maleic anhydride was added to carry out addition reaction, followed by addition of a small amount of water to effect ring opening. Binder resin 28 was thus obtained.

The resin for domain particles used here was sampled in a small quantity to make measurement. As a result, it had a number average molecular weight (Mn) of 5,000, a weight average molecular weight (Mw) of 12,000, a glass transition temperature (Tg) of 33° C. and an acid value of 0. Under the same conditions as used here, the resin materials for matrix were polymerized to carry out addition of maleic acid. As a result, the resulting polymer had a number average molecular weight (Mn) of 6,800 and a weight average molecular weight (Mw) of 21,000, a glass transition temperature (Tg) of 59.5° C. and an acid value of 41.0. This binder resin 28 had a domain average particle diameter of 3.5 μm. Values of the respective physical properties are shown in Table 22.

RESIN PREPARATION EXAMPLES 29 & 30

Binder resins 29 and 30 were synthesized in the same manner as in Resin Preparation Example 27 or 28 except for changing the amount of the initiator and the monomer weight proportions in Resin Preparation Example 27 or 28. Values of the physical properties of binder resins 29 and 30 thus synthesized and preparation methods used are shown in Table 22.

COMPARATIVE RESIN PREPARATION EXAMPLES 28-33

Polymers were obtained by solution polymerization. The resulting polymers as shown in Table 25 are designated as comparative binder resins BB, CC, EE and FF. The resulting two kinds of polymers (resin-I and resin-II) as shown in Table 25 were melt-blended to give comparative binder resins DD and GG. Monomer composition and values of physical properties of each of the above comparative binder resins BB to GG are shown in Table 23.

TABLE 22

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 27 | 27 | 2.5 | 0/42.0 | 30/70 | 32.0 | 4,600 | 12,000 | 60.0 | 7,000 | 21,000 | (X) |
| 28 | 28 | 3.5 | 0/41.0 | 50/50 | 33.0 | 5,000 | 12,000 | 59.5 | 6,800 | 21,000 | (Y) |
| 29 | 29 | 2.0 | 0/50.0 | 30/70 | 37.0 | 45,000 | 370,000 | 60.0 | 8,500 | 28,000 | (Y) |
| 30 | 30 | 2.5 | 0/45.0 | 50/50 | 45.0 | 38,000 | 390,000 | 65.0 | 10,000 | 35,000 | (X) |

(X): Melt blend
(Y): Polymerization in the presence of resin

TABLE 23

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 28 | BB | 32.0 | 4,600 | 12,000 | — | — | — | — | 0 | St-BA |
| 29 | CC | 60.0 | 7,000 | 21,000 | — | — | — | — | 42.0 | St-BD-MA |
| 30 | DD | 32.0 | 4,600 | 100 | 60.0 | 7,500 | 20,000 | 50/50 | 0 | St-BA/St-BD |
| 31 | EE | 37.0 | 45,000 | 370,000 | — | — | — | — | 0 | St-BA |
| 32 | FF | 60.0 | 8,500 | 28,000 | — | — | — | — | 50.0 | St-BD-MA |
| 33 | GG | 37.0 | 38,000 | 330,000 | 62.0 | 10,000 | 33,000 | 50/50 | 0 | St-BA/St-BD |

(1): Comparative Resin Preparation Example
(2): Comparative binder resin
*Melt-blended
St: Styrene
BA: n-Butyl acrylate
BD: Butadiene
MA: Maleic acid

| Example 30 | |
|---|---|
| Binder resin 27 | 100 parts |
| Aluminum complex of di-tert-butylsalicylic acid | 4.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on parts of the resulting blue toner, 0.5 part of fine silica powder treated with hexamethyldisilazane, serving as a fluidity improver, and 0.2 part of fine aluminum oxide powder were externally added.

Thereafter, the same procedure as in Example 26 was repeated to give a two-component developer, and the fixing test was carried out.

As a result, color mixture was possible in a fixing temperature range of from 130° C. to 220° C.

Using the above two-component developer, image reproduction was tested with use of CLO-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 24.

EXAMPLE 31, COMPARATIVE EXAMPLES 28 TO 30

Two-component developers were prepared in the same manner as in Example 30 except that the binder resin 27 was replaced with the binder resin 28 and the comparative binder resins BB to DD, respectively. The tests were carried out in the same way. Results obtained are shown in Table 24.

TABLE 24

| | | Color mixing temperature range | Running sheet number: Offset to fixing roll | (1) | (2) | (3) | (4) |
|---|---|---|---|---|---|---|---|
| Example: | Binder Resin | | | | | | |
| 30 | 27 | 130-220° C. | 20,000 sh.: A | A | A | A | A |
| 31 | 28 | 135-210° C. | 20,000 sh.: A | A | A | A | A |
| Comparative Example: | (Comparative binder resin) | | | | | | |
| 28 | BB | 75-105° C. | —*: C | A | C | A | C |
| 29 | CC | 165-195° C. | 1,000 sh.**: C | B | A | B | A |
| 30 | DD | 140-170° C. | —*: C | B | BC | B | C |

(1): Color reproduction
(2): Transport performance
(3): Light transmission properties
(4): Blocking resistance
*Blocking occurred to make the running impossible.
**Offset occurred.
Remarks: Evaluation was made according to five rank system (A, AB, B, BC, C: from "good" to "poor").

| Example 32 | |
|---|---|
| Binder resin 29 | 100 parts |
| Magnetic iron oxide | 70 parts |

-continued

| Example 32 | |
|---|---|
| Chromium complex of di-tert-butylsalicylic acid | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of dry process silica powder having been made hydrophobic was externally added as a fluidity improver. A one-component developer was thus prepared.

Using this one-component developer thus prepared, unfixed images were obtained with use of a copier NP-8580, manufactured by Canon Inc., and were tested for their fixing performance using an external fixing machine. As a result, fixing was possible in a fixing temperature range of from 30° C. to 240° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 26 to find it good. Results obtained are shown in Table 25.

EXAMPLE 33, COMPARATIVE EXAMPLES 31 to 33

One-component developers were prepared in the same manner as in Example 32 except that the binder resin 29 was replaced with the binder resin 30 and the comparative binder resins EE to GG, respectively. The tests were carried out in the same way. Results obtained are shown in Table 25.

TABLE 25

| | | Fixing temperature range | Running sheet number: Offset to fixing roll | Blocking resistance |
|---|---|---|---|---|
| Example: | Binder Resin | | | |
| 32 | 29 | 130-240° C. | 100,000 sheets: A | A |
| 33 | 30 | 125-230° C. | 100,000 sheets: A | A |
| Comparative Example: | (Comparative binder resin) | | | |
| 31 | EE | 80-110° C. | —*: C | C |
| 32 | FF | 160-190° C. | 1,000 sheets**: C | A |

TABLE 25-continued

| | | Fixing temperature range | Running sheet number: Offset to fixing roll | Blocking resistance |
|---|---|---|---|---|
| 33 | GG | 140–170° C. | —*: C | C |

*Blocking occurred to make the running impossible.
**Offset occurred.
Remarks: Evaluation was made according to five rank system (A, AB, B, BC, C: from "good" to "poor").

| Resin Preparation Example 31 (Cross-linking in Resin Solution) Polymerization of Resin for Domain Particles | |
|---|---|
| Styrene | 140 g |
| Butadiene | 60 g |
| Benzoyl peroxide | 15 g |
| Toluene | 500 g |

Using the above materials, polymerization reaction was carried out at 85° C. for 15 hours. As a result, a copolymer (resin-o) was obtained, having a number average molecular weight (Mn) of 5,200, a weight average molecular weight (Mw) of 13,000 and a glass transition temperature (Tg) of 31.0° C.

Polymerization of Resin for Matrix

Ethylene glycol, propoxidated bis-phenol, terephthalic acid and fumaric acid were subjected to condensation reaction. As a result, a polyester (resin-p) was obtained, having a number average molecular weight (Mn) of 4,000, a weight average molecular weight (Mw) of 18,000 and a glass transition temperature (Tg) of 60.0° C.

Next, the resin solutions were respectively weighed so as for the resin-o and resin-p to be in a ratio of 3:7, and then the resin-o and resin-p were melt-blended. At this stage, 0.1 g of benzoyl peroxide was further added, and the blend solution was set to a temperature of 80° C. to carry out the reaction for 5 hours. Binder resin 31 was thus obtained.

This binder resin 31 had a domain average particle diameter of 2.8 μm. Values of the respective physical properties are shown in Table 26.

RESIN PREPARATION EXAMPLE 26

Resin for Cross-linking During Kneading

In Resin Preparation Example 31, the resin solutions were melt-blended without cross-linking, and the resulting blend solution was dried to give binder resin 32. This binder resin 32 had a domain average particle diameter of 2.0 μm. Values of the respective physical properties are shown in Table 26.

RESIN PREPARATION EXAMPLES 33 & 34

Binder resins 33 and 34 were synthesized in the same manner as in Resin Preparation Example 31 or 32 except for changing the amount of the initiator and the monomer weight proportions in Resin Preparation Example 31 or 32. Values of the physical properties of binder resins 33 and 34 thus synthesized and preparation methods used are shown in Table 26.

COMPARATIVE RESIN PREPARATION EXAMPLES 34–39

Polymers were obtained by solution polymerization. The resulting polymers as shown in Table 27 are designated as comparative binder resins HH, II, KK and LL. The resulting two kinds of polymers (resin-I and resin-II) as shown in Table 27 were melt-blended to give comparative binder resins JJ and MM. Monomer composition and values of physical properties of each of the above comparative binder resins HH to MM are shown in Table 27.

TABLE 26

| Resin prep. Example | Binder resin | Domain particle diam. (μm) | Domain/matrix blend ratio | Domain Tg | Domain Mn | Domain Mw | Matrix Tg | Matrix Mn | Matrix Mw | Resin preparation method |
|---|---|---|---|---|---|---|---|---|---|---|
| 31 | 31 | 2.8 | 30/70 | 31.0 | 5,200 | 13,000 | 60.0 | 4,000 | 18,000 | (XA) |
| 32 | 32 | 2.0 | 30/70 | 31.0 | 5,200 | 13,000 | 60.0 | 4,000 | 18,000 | (YA) |
| 33 | 33 | 3.5 | 50/50 | 38.0 | 50,000 | 380,000 | 62.0 | 5,800 | 19,000 | (XA) |
| 34 | 34 | 3.0 | 50/50 | 38.0 | 50,000 | 380,000 | 62.0 | 5,800 | 19,000 | (YA) |

(XA): Cross-linked in solution
(YA): Uncross-linked (cross-linked during kneading)

TABLE 27

| (1) | (2) | Resin-I Tg | Resin-I Mn | Resin-I Mw | Resin-II Tg | Resin-II Mn | Resin-II Mw | Resin-I/Resin-II Blend ratio* | Monomer composition |
|---|---|---|---|---|---|---|---|---|---|
| 34 | HH | 31.0 | 5,200 | 13,000 | — | — | — | — | St-BD |
| 35 | II | 61.0 | 6,000 | 15,000 | — | — | — | — | Polyester |
| 36 | JJ | 31.0 | 5,000 | 13,000 | 63.5 | 6,500 | 18,000 | 30/70 | St-BD/Polyester |
| 37 | KK | 38.0 | 5,000 | 3800,000 | — | — | — | — | St-BD |
| 38 | LL | 63.0 | 6,000 | 18,500 | — | — | — | — | Polyester |

TABLE 27-continued

| (1) | (2) | Resin-I Tg | Resin-I Mn | Resin-I Mw | Resin-II Tg | Resin-II Mn | Resin-II Mw | Resin-I/Resin-II Blend ratio* | Monomer composition |
|---|---|---|---|---|---|---|---|---|---|
| 39 | MM | 38.0 | 50,000 | 380,000 | 62.0 | 6,000 | 17,000 | 50/50 | St-BD/Polyester |

(1): Comparative Resin Preparation Example
(2): Comparative binder resin
*Melt-blended
St: Styrene
BD: Butadiene

| Example 34 | |
|---|---|
| Binder resin 31 | 100 parts |
| Aluminum complex of di-tert-butylsalicylic acid | 4.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

As a carrier, a Cu-Zn-Fe ferrite carrier (average particle diameter: 45 μm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature rang of from 130° C. to 210° C.

Using the above two-component developer, image reproduction was tested with use of CLC-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking Of toner to confirm that no changes were seen at all, showing a good fluidity. Results obtained are shown in Table 28.

EXAMPLE 35

Two-component developers were prepared in the same manner as in Example 34 except that he binder resin 31 was replaced with the binder resin 32 and 0.3 part of benzoyl peroxide and 0.1 part of zinc oxide were added, to effect cross-linking during kneading. The tests were carried out in the same way. Results obtained are shown in Table 28.

COMPARATIVE EXAMPLES 34 to 36

Two-component developers were prepared in the same manner as in Example 34 except that the binder resin 31 was replaced with the comparative binder resins HH to JJ, respectively. The tests were carried out in the same way. Results obtained are shown in Table 28.

TABLE 28

| | | Color mixing temperature range | Running sheet number: Offset to fixing roll | (1) | (2) | (3) | (4) |
|---|---|---|---|---|---|---|---|
| Example: | Binder Resin | | | | | | |
| 34 | 31 | 130-210° C. | 20,000 sh.: A | A | A | A | A |
| 35 | 32 | 125-200° C. | 20,000 sh.: A | A | A | A | A |
| Comparative Example: | (Comparative binder resin) | | | | | | |
| 34 | HH | 70-100° C. | —*: C | A | C | A | C |
| 35 | II | 165-195° C. | 1,000 sh.**: C | A | A | AB | A |
| 36 | JJ | 150-170° C. | —*: C | B | BC | AB | C |

(1): Color reproduction
(2): Transport performance
(3): Light transmission properties
(4): Blocking resistance
*Blocking occurred to make the running impossible.
**Offset occurred.
Remarks: Evaluation was made according to five rank system (A, AB, B, BC, C: from "good" to "poor").

| Example 36 | |
|---|---|
| Binder resin 33 | 100 parts |
| Magnetic iron oxide | 70 parts |
| Chromium complex of di-tert-butylsalicylic acid | 2 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was externally added as a fluidity improver. A one-component developer was thus prepared.

Using this one-component developer thus prepared, unfixed images were obtained with use of a copier NP-8580, manufactured by Canon Inc., and were tested for their fixing performance using an external fixing machine. As a result, fixing was possible in a fixing temperature range of from 130° C. to 230° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 34 to find it good. Results obtained are shown in Table 29.

EXAMPLE 37

A one-component developer was prepared in the same manner as in Example 36 except that the binder resin 33 was replaced with the binder resin 34 and 0.3 part of benzoyl peroxide and 0.2 part of zinc oxide were added. The tests were carried out in the same way. Results obtained are shown in Table 29.

COMPARATIVE EXAMPLES 37 TO 39

One-component developers were prepared in the same manner as in Example 36 except that the binder resin 33 was replaced with the comparative binder resins KK to MM, respectively. The tests were carried out in the same way. Results obtained are shown in Table 29.

TABLE 29

| | | Fixing temperature range | Running sheet number: Offset to fixing roll | Blocking resistance |
|---|---|---|---|---|
| Example: | Binder Resin | | | |
| 36 | 33 | 130-230° C. | 100,000 sheets: A | A |
| 37 | 34 | 135-230° C. | 100,000 sheets: A | A |
| Comparative Example: | (Comparative binder resin) | | | |
| 37 | KK | 80-95° C. | —*: C | C |
| 38 | LL | 160-180° C. | 2,000 sheets**: C | A |
| 39 | MM | 150-180° C. | —*: C | C |

*Blocking occurred to make the running impossible.
**Offset occurred.
Remarks: Evaluation was made according to five rank system (A, AB, B, BC, C: from "good" to "poor").

| Resin Preparation Example 35 (Melt blend of Resins) Polymerization of Resin for Domain Particles | |
|---|---|
| Styrene | 140 g |
| Butadiene | 60 g |
| Benzoyl peroxide | 15 g |
| Toluene | 500 g |

Using the above materials, polymerization reaction was carried out at 85° C. for 10 hours. After the reaction, 20 g of maleic anhydride was added to carry out addition reaction, followed by addition of a small amount of water to effect ring-opening. As a result, a copolymer (resin-q was Obtained, having a number average molecular weight (Mn) of 4,800, a weight average molecular weight (Mw) of 13,000, a glass transition temperature (Tg) of 33.5° C. and an acid value of 41.0.

Polymerization of Resin for Matrix

Ethylene glycol, propoxidated bis-phenol, terephthalic acid and fumaric acid were subjected to condensation reaction. As a result, a polyester (resin-r) was obtained, having a number average molecular weight (Mn) of 3,700, a weight average molecular weight (Mw) of 16,000, glass transition temperature (Tg) of 59.5° C. and an acid value of 8.5.

Next, the resin solutions were respectively weighed so as for the resin-q and resin-r to be in a ratio of 3:7, and then the resin-q and resin-r were melt-blended. At this stage, 0.1 g of benzoyl peroxide was further added, and the blend solution was set at a temperature of 80° C. to carry out the reaction for

| Example 40 | |
|---|---|
| Binder resin 37 | 100 parts |
| Magnetic iron oxide | 70 parts |
| Chromium complex of di-tert-butylsalicylic acid | 2 parts |

5 hours. Binder resin 35 was thus obtained.

This binder resin 35 had a domain average particle diameter of 1.0 μm. Values of the respective physical properties are shown in Table 30.

RESIN PREPARATION EXAMPLE 36

Resin for Cross-linking During Kneading

In Resin Preparation Example 35, the resin solutions were melt-blended without cross-linking, and the resulting blend solution was dried to give binder resin 36. This binder resin 36 had a domain average particle diameter of 0.8 μm. Values of the respective physical properties are shown in Table 30.

RESIN PREPARATION EXAMPLES 37 AND 38

Binder resins 37 and 38 were synthesized in the same manner as in Resin Preparation Example 35 or 36 except for changing the amount of the initiator and the monomer weight proportions in Resin Preparation Example 35 or 36. Values of the physical properties of binder resins 37 and 38 thus synthesized and preparation methods used are shown in Table 30.

COMPARATIVE RESIN PREPARATION EXAMPLES 40-45

Polymers were obtained by solution polymerization. The resulting polymers as shown in Table 31 are designated as comparative binder resins NN, OO, QQ and RR. The resulting two kinds of polymers (resin-I and resin-II) as shown in Table 31 were melt-blended to give comparative binder resins PP and SS. Monomer composition and values of physical properties of each of the above comparative binder resins NN to SS are shown in Table 31.

TABLE 30

| Resin prep. Example | Binder resin | Domain particle diam. (μm) | Domain/ matrix acid values | Domain/ matrix blend ratio | Domain Tg | Domain Mn | Domain Mw | Matrix (polyester) Tg | Matrix (polyester) Mn | Matrix (polyester) Mw | Resin preparation method |
|---|---|---|---|---|---|---|---|---|---|---|---|
| 35 | 35 | 1.0 | 41.0/8.5 | 30/70 | 33.5 | 4,800 | 13,000 | 59.5 | 3,700 | 16,000 | (XA) |
| 36 | 36 | 0.8 | 41.0/8.5 | 30/70 | 33.5 | 4,800 | 13,000 | 59.5 | 3,700 | 16,000 | (YA) |
| 37 | 37 | 1.2 | 55.0/6.0 | 50/50 | 31.0 | 45,000 | 270,000 | 63.5 | 6,000 | 21,000 | (XA) |
| 38 | 38 | 1.5 | 55.0/6.0 | 50/50 | 31.0 | 45,000 | 270,000 | 63.5 | 6,000 | 21,000 | (YA) |

(XA): Cross-linked in solution
(YA): Uncross-linked (cross-linked during kneading)

TABLE 31

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 40 | NN | 33.5 | 4,500 | 12,000 | — | — | — | — | 41.0 | St-BD-MA |
| 41 | OO | 60.0 | 6,000 | 15,000 | — | — | — | — | 8.0 | Polyester |
| 42 | PP | 31.0 | 4,700 | 13,000 | 61.5 | 5,500 | 13,500 | 30/70 | 40.0<br>6.5 | St-BD-MA/<br>Polyester |
| 43 | QQ | 30.0 | 50,000 | 230,000 | — | — | — | — | 57.0 | St-BD-MA |
| 44 | RR | 58.5 | 7,000 | 22,000 | — | — | — | — | 5.0 | Polyester |
| 44 | SS | 32.0 | 52,000 | 270,000 | 61.0 | 7,500 | 23,000 | 50/50 | 54.5<br>6.0 | St-BD-MA/<br>Polyester |

(1): Comparative Resin Preparation Example
(2): Comparative binder resin
*Melt-blended
St: Styrene
BD: Butadiene
MA: Maleic acid

| Example 38 | |
|---|---|
| Binder resin 35 | 100 parts |
| Aluminum complex of di-tert-butylsalicylic acid | 4.0 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

Thereafter, the same procedure as in Example 31 was repeated to give a two-component developer, and the fixing test was carried out. As a result, color mixture was possible at a fixing temperature range of from 130° to 220° C.

Using this two-component developer, image reproduction was tested with use of CLC-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 32.

EXAMPLE 39

Two-component developers were prepared in the same manner as in Example 38 except that the binder resin 35 was replaced with the binder resin 36 and 0.3 part of benzoyl peroxide and 0.1 part of zinc oxide were added, to effect cross linking during kneading. The tests were carried out in the same way. Results obtained are shown in Table 32.

COMPARATIVE EXAMPLES 40 TO 42

Two-component developers were prepared in the same manner as in Example 38 except that the binder resin 35 was replaced with the comparative binder resins NN to PP, respectively. The tests were carried out in the same way. Results obtained are shown in Table 32.

TABLE 32

| | | Color mixing temperature range | Running sheet number: Offset to fixing roll | (1) | (2) | (3) | (4) |
|---|---|---|---|---|---|---|---|
| Example: | Binder Resin | | | | | | |
| 38 | 35 | 130–200° C. | 20,000 sh.: A | A | A | A | A |
| 39 | 36 | 130–200° C. | 20,000 sh.: A | A | A | A | A |
| Comparative Example: | (Comparative binder resin) | | | | | | |
| 40 | NN | 80–100° C. | —*: C | A | C | A | C |
| 41 | OO | 165–195° C. | 2,000 sh.**: C | A | A | AB | A |

TABLE 32-continued

| | | Color mixing temperature range | Running sheet number: Offset to fixing roll | (1) | (2) | (3) | (4) |
|---|---|---|---|---|---|---|---|
| 42 | JJ | 145-190° C. | —*: C | A | BC | B | C |

(1): Color reproduction
(2): Transport performance
(3): Light transmission properties
(4): Blocking resistance
*Blocking occurred to make the running impossible.
**Offset occurred.
Remarks: Evaluation was made according to five rank system (A, AB, B, BC, C: from "good" to "poor").

The above materials were melt-kneaded using a roll mill, and the kneaded product was cooled, followed by crushing, pulverizing and classification to give a black magnetic toner. Based on 100 parts by eight of the resulting black magnetic toner, 0.6 part by weight of positively chargeable dry process silica powder having been made hydrophobic was externally added as a fluidity improver. A one-component developer was thus prepared.

Using this one-component developer thus prepared, unfixed images were obtained with use of a copier NP-8580, manufactured by Canon Inc., and were tested for their fixing performance using an external fixing machine. As a result, fixing was possible in a fixing temperature range of from 130° C. to 230° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 34 to find it good. Results obtained are shown in Table 33.

EXAMPLE 41

A one-component developer was prepared in the same manner as in Example 40 except that the binder resin 37 was replaced with the binder resin 38 and 0.3 part of benzoyl peroxide and 0.2 part of zinc oxide were added, to effect cross-linking during kneading. The tests were carried out in the same way. Results obtained are shown in Table 33.

COMPARATIVE EXAMPLES 43 to 45

One-component developers were prepared in the same manner as in Example 40 except that the binder resin 37 was replaced with the comparative binder resins QQ to SS, respectively. The tests were carried out in the same way. Results obtained are shown in Table 33.

TABLE 33

| | | Fixing temperature range | Running sheet number: Offset to fixing roll | Blocking resistance |
|---|---|---|---|---|
| Example: | Binder Resin | | | |
| 40 | 37 | 130-230° C. | 100,000 sheets: A | A |
| 41 | 38 | 130-240° C. | 100,000 sheets: A | A |
| Comparative Example: | (Comparative binder resin) | | | |
| 43 | QQ | 85-105° C. | —* : C | C |
| 44 | RR | 160-190° C. | 3,000 sheets**: C | A |
| 45 | SS | 150-180° C. | —*: C | C |

*Blocking occurred to make the running impossible.
**Offset occurred.
Remarks: Evaluation was made according to five rank system (A, AB, B, BC, C: from "good" to "poor").

| Resin Preparation Example 39 (Melt blend of Resins) Polymerization of Resin for Domain Particles | |
|---|---|
| Styrene | 90 g |
| n-Butyl acrylate | 80 g |
| Monobutyl maleate (half ester) | 15 g + 15 g (after 4 hrs) |
| Benzoyl peroxide | 15 g |
| Toluene | 500 g |

Using the above materials, polymerization reaction was carried out at 85° C. for 10 hours. In order to make uniform the compositional distribution in the polymer, the monobutyl maleate was divided into two portions and added by 15 g at the initiation of the polymerization and 4 hours after the initiation. to carry out the reaction. As a result, a copolymer (resin-s) was obtained, having a number average molecular weight (Mn) of 4,700, a weight average molecular weight (Mw) of 12,000, a glass transition temperature (Tg) of 30.5° C. and an acid value of 62.5.

Polymerization of Resin for Matrix

Ethylene glycol, propoxidated bis-phenol, terephthalate dodecenylsuccunitate and trimellitic acid were subjected to condensation reaction. As a result, a polyester (resin-t was obtained, having a number average molecular weight (Mn) of 5,600, a weight average molecular weight (Mw) of 20,000, a glass transition temperature (Tg) of 62.0° C. and an acid value of 30.0.

Next, after the polymerization reaction, the polymer-toluene solutions were respectively weighed so as for the resin-s and resin-t to be in a ratio of 3:7, and then the resin-s and resin-t were melt-blended. The blend solution was set at a temperature of 80° C., to which 1.5 g of zinc acetate was added, and the mixture was vigorously stirred, followed by drying to give binder resin 39.

This binder resin 39 had a domain average particle diameter of 3.0 μm. Values of the respective physical properties are shown in Table 34.

RESIN PREPARATION EXAMPLE 40

Resin for Cross-linking During Kneading

In Resin Preparation Example 39, the resin solutions are melt-blended without cross-linking, and the resulting blend solution was dried to give binder resin 40. This binder resin 40 had a domain average particle diameter of 2.5 μm. Values of the respective physical properties are shown in Table 34.

RESIN PREPARATION EXAMPLES 41 AND 42

Binder resins 41 and 42 were synthesized in the same manner as in Resin Preparation Example 39 or 40 except for changing the amount of the initiator and the monomer weight proportions in Resin Preparation Example 39 or 40. Values of the physical properties of binder resins 41 and 42 thus synthesized and preparation methods used are shown in Table 34.

COMPARATIVE RESIN PREPARATION EXAMPLES 45-50

Polymers were obtained by solution polymerization. The resulting polymers as shown in Table 35 are designated as comparative binder resins TT, UU, WW and XX. The resulting two kinds of polymers (resin-I and resin-II) as shown in Table 35 were melt-blended to give comparative binder resins VV and YY. Monomer composition and values of physical properties of each of the above comparative binder resins TT to YY are shown in Table 35.

TABLE 34

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 39 | 39 | 3.0 | 62.5/30.0 | 30/70 | 30.5 | 4,700 | 12,000 | 62.0 | 5,600 | 20,000 | (XA) |
| 40 | 40 | 2.5 | 62.5/30.0 | 30/70 | 30.5 | 4,700 | 12,000 | 62.0 | 5,600 | 20,000 | (YA) |
| 41 | 41 | 3.5 | 60.0/35.0 | 50/50 | 32.0 | 45,000 | 270,000 | 63.5 | 6,000 | 21,000 | (XA) |
| 42 | 42 | 2.5 | 60.0/35.0 | 50/50 | 32.0 | 45,000 | 270,000 | 63.5 | 6,000 | 21,000 | (YA) |

(XA): Cross-linked in solution
(YA): Uncross-linked (cross-linked during kneading)

TABLE 35

| (1) | (2) | Resin-I Tg | Resin-I Mn | Resin-I Mw | Resin-II Tg | Resin-II Mn | Resin-II Mw | Resin-I/ Resin-II Blend ratio* | Binder resin acid value | Monomer composition |
|---|---|---|---|---|---|---|---|---|---|---|
| 45 | TT | 31.0 | 5,000 | 12,000 | — | — | — | — | 60.0 | St-BA-MBM |
| 46 | UU | 60.0 | 5,500 | 13,000 | — | — | — | — | 30.0 | Polyester |
| 47 | VV | 32.0 | 4,800 | 13,500 | 61.5 | 5,000 | 14,000 | 30/70 | 61.0<br>30.5 | St-BA-MBM/<br>Polyester |
| 48 | WW | 33.0 | 48,000 | 260,000 | — | — | — | — | 65.0 | St-BA-MBM |
| 49 | XX | 62.0 | 5,700 | 17,000 | — | — | — | — | 33.5 | Polyester |
| 50 | YY | 37.0 | 50,000 | 270,000 | 62.5 | 6,000 | 17,000 | 50/50 | 66.0<br>31.5 | St-BA-MBM/<br>Polyester |

(1): Comparative Resin Preparation Example
(2): Comparative binder resin
*Melt-blended
St: Styrene
BA: n-Butyl acrylate
MBM: Monobutyl maleate Example 42

| | |
|---|---|
| Binder resin 39 | 100 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.2 part of fine aluminum oxide powder were externally added.

Thereafter, the same procedure as in Example 34 was repeated to give a two-component developer, and the fixing test was carried out. As a result, color mixture was possible at a fixing temperature range of from 130° to 210° C.

Using this two-component developer, image reproduction was tested with use of CLC-500. As a result, no offset to the fixing roller occurred at all even after copying on 20,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 36.

Example 43

| | |
|---|---|
| Binder resin 40 | 100 parts |
| Chromium complex of di-tert-butylsalicylic acid | 4 parts |
| Copper phthalocyanine pigment represented by | 5.0 parts |

-continued

| Example 43 |
|---|
| structural formula (C) |

Using the above materials, the same procedure as in Example 42 was repeated to effect cross-linking during kneading. A two-component developer was thus prepared. The tests were carried out in the same way. Results obtained are shown in Table 36.

COMPARATIVE EXAMPLES 46 TO 48

Two-component developers were prepared in the same manner as in Example 42 except that the binder resin 39 was replaced with the comparative binder resins TT to VV, respectively. The tests were carried out in the same way. Results obtained are shown in Table 36.

TABLE 36

| | | Color mixing temperature range | Running sheet number: Offset to fixing roll | (1) | (2) | (3) | (4) |
|---|---|---|---|---|---|---|---|
| Example: | Binder Resin | | | | | | |
| 42 | 39 | 140-210° C. | 20,000 sh.: A | A | A | A | A |
| 43 | 40 | 135-220° C. | 20,000 sh.: A | A | A | A | A |
| Comparative Example: | (Comparative binder resin) | | | | | | |
| 46 | TT | 120-135° C. | —*: C | AB | C | AB | C |
| 47 | UU | 170-190° C. | 2,000 sh.**: C | AB | A | AB | A |
| 48 | VV | 145-175° C. | —*: C | AB | BC | AB | C |

(1): Color reproduction
(2): Transport performance
(3): Light transmission properties
(4): Blocking resistance
*Blocking occurred to make the running impossible.
**Offset occurred.
Remarks: Evaluation was made according to five rank system (A, AB, B, BC, C: from "good" to "poor").

| Example 44 | |
|---|---|
| Binder resin 41 | 100 parts |
| Magnetic iron oxide | 70 parts |

The above materials were melt-kneaded using a roll mill, and the kneaded product was cooled, followed by crushing, pulverizing and classification to give a black magnetic toner. Based on 100 parts by weight of the resulting black magnetic toner, 0.6 part by weight of positively chargeable dry process silica powder having been made hydrophobic was externally added as a fluidity improver. A one-component developer has thus prepared.

Using this one-component developer thus prepared, unfixed images were obtained with use of a copier NP-8580, manufactured by Canon Inc., and were tested for their fixing performance using an external fixing machine. As a result, fixing was possible in a fixing temperature range of from 140° C. to 220° C. Using the above one-component developer and the copier, image reproduction was also tested. As a result, no offset to the fixing roller occurred at all even after copying on 100,000 sheets, and good images free from fogging and black spots around line images were obtained. Blocking resistance was also examined in the same manner as in Example 34 to find it good. Results obtained are shown in Table 37.

EXAMPLE 45

A one-component developer was prepared in the same manner as in Example 44 except that the binder resin 41 was replaced with the binder resin 42 and 4 parts of the azo type metal complex represented by the formula Complex (I)-1, to effect cross-linking during kneading. The tests were carried out in the same way. Results obtained are shown in Table 37.

COMPARATIVE EXAMPLES 49 TO 51

One-component developers were prepared in the same manner as in Example 44 except that the binder resin 41 was replaced with the comparative binder resins WW to YY, respectively. The tests were carried out in the same way. Results obtained are shown in Table 37.

TABLE 37

| | | Fixing temperature range | Running sheet number: Offset to fixing roll | Blocking resistance |
|---|---|---|---|---|
| Example: | Binder Resin | | | |
| 44 | 41 | 140-220° C. | 100,000 sheets: A | A |
| 45 | 42 | 130-230° C. | 100,000 sheets: A | A |
| Comparative Example: | (Comparative binder resin) | | | |
| 49 | WW | 80-100° C. | —*: C | C |
| 50 | XX | 170-190° C. | 2,000 sheets**: C | A |

TABLE 37-continued

| | | Fixing temperature range | Running sheet number: Offset to fixing roll | Blocking resistance |
|---|---|---|---|---|
| 51 | YY | 150–180° C. | —*: C | C |

*Blocking occurred to make the running impossible.
**Offset occurred.
Remarks: Evaluation was made according to five rank system (A, AB, B, BC, C: from "good" to "poor").

| Resin Preparation Example 43 (Melt blend of Resins) Polymerization of Resin for Domain Particles | |
|---|---|
| Styrene | 92 parts |
| n-Butyl acrylate | 78 parts |
| Monobutyl maleate (half ester) | 15 parts + 15 parts (after 4 hrs) |
| Benzoyl peroxide | 15 parts |
| Toluene | 500 parts |

Using the above materials, polymerization reaction was carried out at 85° C. for 10 hours. In order to make uniform the compositional distribution in the polymer, the monobutyl maleate was divided into two portions and added by 15 parts at the initiation of the polymerization and 4 hours after the initiation, to carry out the reaction. .As a result, a copolymer (resin-u) was obtained, having a number average molecular weight (Mn) of 4,600, a weight average molecular weight (Mw) of 13,000, a glass transition temperature (Tg) of 31.9° C. and an acid value of 57.0.

| Polymerization of Resin for Matrix | |
|---|---|
| Styrene | 243 parts |
| n-Butyl acrylate | 57 parts |
| Benzoyl peroxide | 22.5 parts |
| Toluene | 750 parts |

Using the above materials, polymerization reaction was carried out at 85° C. for 16 hours. As a result, a copolymer (resin-v) was obtained, having a number average molecular weight (Mn) of 5,400, a weight average molecular weight (Mw) of 15,000, a glass transition temperature (Tg) of 58.5° C. and an acid value of 0.

Next, after the polymerization reaction, the polymer-toluene solutions were respectively weighed so as for the resin-u and resin-v to be in a ratio of 3:7, and then the resin-u and resin-v were melt-blended. The blend solution was set at a temperature of 150° C., and the mixture was vigorously stirred, followed by rapid cooling to give binder resin 43. This binder resin 43 had a domain average particle diameter of 2 μm. Values of the respective physical properties are shown in Table 38.

RESIN PREPARATION EXAMPLE 44

Polymerization in the Presence of Resin

| Polymerization of Resin for Domain Particles | |
|---|---|
| Styrene | 104 parts |
| n-Butyl acrylate | 66 parts |
| Monobutyl maleate (half ester) | 30 parts |
| Benzoyl peroxide | 15 parts |
| Toluene | 500 parts |

Using the above materials, polymerization reaction was carried out at 85° C. for 10 hours to give a copolymer having a number average molecular weight (Mn) of 5,300, a weight average molecular weight (Mw) of 16,000, a glass transition temperature (Tg) of 42.8° C. and an acid value of 60.0. Next, in this resin solution, polymerization for obtaining the resin for matrix was carried out in the following way.

| Polymerization of Resin for Matrix | |
|---|---|
| Styrene | 165 parts |
| n-Butyl acrylate | 35 parts |
| Benzoyl peroxide | 15 parts |
| Toluene | 500 parts |

The above materials were added to the above resin solution, and polymerization reaction was further carried out at 85° C. for 16 hours. As a result, a copolymer was obtained, having a number average molecular weight (Mn) of 5,700 and a weight average molecular weight (Mw) of 15,000. This was dried to give binder resin 44. This binder resin 44 had an acid value of 19.0 and a domain average particle diameter of 1.5 μm. A resin obtained by polymerizing only the resin materials for matrix had a number average molecular weight (Mn) of 6,300, a weight average molecular weight (Mw) of 14,000, a glass transition temperature (Tg) of 59.0° C. and an acid value of 0. Values of the respective physical properties are shown in Table 38.

RESIN PREPARATION EXAMPLES 45 & 46

Binder resins 45 and 46 were synthesized in the same manner as in Resin Preparation Example 43 or 44 except for changing the amount of the initiator and the monomer weight proportions in Resin Preparation Example 43 or 44. Values of the physical properties of binder resins 45 and 46 thus synthesized and preparation methods used are shown in Table 38.

TABLE 38

| Resin prep. Example | Binder resin | Domain particle diam. (μm) | Domain/matrix acid values | Domain/matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 43 | 43 | 2.0 | 57.0/0 | 30/70 | 31.9 | 4,600 | 13,000 | 58.5 | 5,400 | 15,000 | (X) |
| 44 | 44 | 1.5 | 60.0/0 | 50/50 | 42.8 | 5,300 | 16,000 | 59.0 | 6,300 | 14,000 | (Y) |

TABLE 38-continued

| Resin prep. Example | Binder resin | Domain particle diam. (μm) | Domain/ matrix acid values | Domain/ matrix blend ratio | Domain Tg | Domain Mn | Domain Mw | Matrix Tg | Matrix Mn | Matrix Mw | Resin preparation method |
|---|---|---|---|---|---|---|---|---|---|---|---|
| 45 | 45 | 0.3 | 45.0/0 | 30/70 | 23.5 | 8,000 | 20,500 | 60.5 | 6,000 | 15,000 | (Y) |
| 46 | 46 | 3.5 | 55.0/0 | 50/50 | 35.5 | 12,000 | 28,000 | 59.5 | 6,500 | 20,000 | (X) |

(X): Melt blend
(Y): Polymerization in the presence of resin

| Example 46 | |
|---|---|
| Binder resin 43 | 100 parts |
| Styrene/methacrylic acid copolymer | 5 parts |
| Copper phthalocyanine pigment represented by structural formula (C) | 5.0 parts |

The above materials were melt-kneaded using a roll mill, and the kneaded product was cooled, followed by crushing, pulverizing and classification to give a blue toner. Based on 100 parts of the resulting blue toner, 0.5 part of fine silica powder treated with hexamethyldisilazane, serving as a fluidity improver, and 0.7 part of fine strontium titanate powder (average particle diameter: 0.37 μm) serving as a conductive fine powder were mixed, and the mixture was blended using a Henschel mixer.

As a carrier, a Cu-Zn-Fe ferrite carrier (average particle diameter: 45 μm; 250 mesh-pass 400 mesh-on: 87% by weight) coated with 0.5% by weight, on the basis of the carrier, of a styrene/2-ethylhexyl acrylate/methyl methacrylate copolymer (copolymerization weight ratio: 50:20:30) was used. This carrier was mixed in the above blue toner containing external additives, so as to give a toner concentration of 6.0% by weight. A two-component developer was thus prepared.

Using this two-component developer thus prepared, unfixed images were obtained only by development and transfer with use of a full-color copier CLC-500, manufactured by Canon Inc., and were tested for their fixing performance using an external fixing machine.

As a result, color mixture was possible in a fixing temperature range of from 120° C. to 220° C.

Using the above two-component developer, image reproduction was tested with use of CLC-500 in an environment of a temperature of 30° C. and a humidity of 75%. As a result, no offset to the fixing roller occurred at all even after copying on 10,000 sheets in the monochromatic mode, and full-color images free from fogging and with reproduction faithful to an original color chart were obtained. Transport performance of toner in the copying machine was good, and a stable image density was obtained. When an OHP film was used, the transparency of toner image was in a very preferable state. The developer was left to stand for a day in a hot-air dryer of 45° C. to examine the state of blocking of toner to confirm that no changes were seen at all, showing a good fluidity. Results obtained are shown in Table 39.

EXAMPLES 47 AND 48

Two-component developers were prepared in the same manner as in Example 46 except that the binder resin 43 was replaced with the binder resins 44 and 45. The tests were carried out in the same way. Results obtained are shown in Table 39.

EXAMPLE 49

A two-component developer was prepared in the same manner as in Example 46 except that &he binder resin 43 was replaced with the binder resin 46 and 0.7 part of the fine strontium titanate powder was replaced with 0.7 part of titanium nitride having an average particle diameter of 1 μm. The tests were carried out in the same way. Results obtained are shown in Table 39.

EXAMPLES 50 and 51

Two-component developers were prepared in the same manner as in Examples 46 and 49, respectively, except that the Henschel mixer which was a means for mixing the toners and external additives used in Examples 46 and 49 was replaced with Hybridizer (manufactured by Nara Kikai K. K.). The tests were carried out in the same way. Results obtained are shown in Table 40.

TABLE 39

| Example | Binder resin | Conductive fine particles* (particle diameter) | Color fixing temperature range | Running sheet number: Offset to fixing roll | Density | Tribo. Initial stage → After running | Color reproduction | Blocking resistance |
|---|---|---|---|---|---|---|---|---|
| 46 | 43 | Strontium titanate (0.37 μm) | 120–220° C. | 10,000 sh.: A | >1.38 | 22 μc/g → 24 μc/g | A | A |
| 47 | 44 | Strontium titanate (0.37 μm) | 120–220° C. | 10,000 sh.: A | >1.38 | 21 → 22 | A | A |
| 48 | 45 | Strontium titanate (0.37 μm) | 115–220° C. | 15,000 sh.: A | >1.37 | 21 → 20 | A | A |
| 49 | 46 | Titanium nitride (1 μm) | 120–210° C. | 15,000 sh.: A | >1.36 | 19 → 18 | A | A |

*Using a transmission electron microscope, confirmed to be buried by 0.05 μm or more.
Remarks: Evaluation was made according to five rank system (A, AB, B, BC, C: from "good" to "poor").

TABLE 40

| Example | Binder resin | Conductive fine particles* (particle diameter) | Color fixing temperature range | Running sheet number: Offset to fixing roll | Density | Tribo. electricity after running | Transmission properties after OHP fixing |
|---|---|---|---|---|---|---|---|
| 50 | 43 | Strontium titanate (0.37 μm) | 120–220° C. | 10,000 sh.: A | >1.37 | 23 μc/g | A |
| 51 | 46 | Titanium nitride (1 μm) | 120–210° C. | 15,000 sh.: A | >1.37 | 22 | A |

*Controlling mixing time and r.p.m., buried in a depth of 0.05 μm or less.
Remarks: Evaluation was made according to five rank system (A, AB, B, BC, C: from "good" to "poor").

We claim:

1. A heat fixable toner for developing an electrostatic image, comprising toner particles containing i) a binder resin comprising a resin composition with a domain-matrix structure and ii) a colorant;

said resin composition with a domain-matrix structure being comprised of a heat fixable resin P1 that forms domain particles and a heat fixable resin P2 that forms a matrix; said heat fixable resin P1 having a glass transition temperature Tg1 of from 15° C. to 50° C., and said heat fixable resin P2 having a glass transition temperature Tg2 of from 55° C. to 80° C., provided that the glass transition temperature Tg2 of said heat fixable resin P2 is at least 5° C. higher than the glass transition temperature Tg1 of said heat fixable resin P1; and said domain particles having an average particle diameter of not larger than 5 μm.

2. The toner according to claim 1, wherein said resin P1 that forms domain particles has a carboxyl group and said resin P2 that forms a matrix has substantially no carboxyl group.

3. The toner according to claim 2, wherein said resin P1 that forms domain particles has a vinyl resin and said resin P2 that forms a matrix has a vinyl resin.

4. The toner according to claim 2, wherein said resin P1 that forms domain particles has an acid value of not less than 15 and said resin P2 that forms a matrix has an acid value of not more than 10.

5. The toner according to claim 3, wherein said resin P1 that forms domain particles contains a carboxyl group-containing vinyl monomer in an amount of from 0.1% by weight to 50% by weight on the basis of said resin P1.

6. The toner according to claim 3, wherein said resin P1 that forms domain particles contains a carboxyl group-containing vinyl monomer in an amount of from 1% by weight to 30% by weight on the basis of said resin P1.

7. The toner according to claim 3, wherein said resin P1 that forms domain particles has a polymer synthesized from an unsaturated diolefin monomer.

8. The toner according to claim 3, wherein said resin P1 that forms domain particles has an acid-modified polymer synthesized from a vinyl monomer and thereafter subjected to acid addition, and said resin P2 that forms a matrix has a polymer synthesized from a vinyl monomer.

9. The toner according to claim 8, wherein said resin P1 that forms domain particles contains a monomer having an acid-modifiable unsaturated double bond, in an amount of from 0.1% by weight to 70% by weight on the basis of said resin P1.

10. The toner according to claim 8, wherein said resin P1 that forms domain particles contains a monomer having an acid-modifiable unsaturated double bond, in an amount of from 0.3% by weight to 55% by weight on the basis of said resin P1.

11. The toner according to claim 8, wherein said acid-modified polymer has a polymer formed by acid modification of a polymer synthesized from an unsaturated diolefin monomer.

12. The toner according to claim 8, wherein said acid-modified polymer is acid-modified by an acid used in an amount of from 0.1% by weight to 50% by weight on the basis of said resin P1.

13. The toner according to claim 8, wherein said acid-modified polymer is acid-modified by an acid used in an amount of from 1% by weight to 30% by weight on the basis of said resin P1.

14. The toner according to claim 2, wherein said resin P1 that forms domain particles is cross-linked with a cross-linkable metal compound.

15. The toner according to claim 14, wherein said cross-linkable metal compound has an organic metal compound containing a metal ion.

16. The toner according to claim 14, wherein said cross-linkable metal compound has a hydroxide of a metal ion selected from the group consisting of $Na^+$, $K^+$ and $Li^+$.

17. The toner according to claim 1, wherein said resin P2 that forms a matrix has a carboxyl group and said resin P1 that forms domain particles has substantially no carboxyl group.

18. The toner according to claim 17, wherein said resin P2 that forms a matrix has a vinyl resin and said resin P1 that forms domain particles has a vinyl resin.

19. The toner according to claim 17, wherein said resin P2 that forms a matrix has an acid value of not less than 15 and said resin P1 that forms domain particles has an acid value of not more than 10.

20. The toner according to claim 18, wherein said resin P2 that forms a matrix contains a carboxyl group-containing vinyl monomer in an amount of from 0.1% by weight to 50% by weight on the basis of said resin P2.

21. The toner according to claim 18, wherein said resin P2 that forms a matrix contains a carboxyl group-containing vinyl monomer in an amount of from 1% by weight to 30% by weight on the basis of said resin P2.

22. The toner according to claim 18, wherein said resin P2 that forms a matrix has a polymer synthesized from an unsaturated diolefin monomer.

23. The toner according to claim 17, wherein said resin P2 that forms a matrix has an acid-modified polymer synthesized from a vinyl monomer and thereafter subjected to acid addition, and said resin P1 that forms domain particles has a polymer synthesized from a vinyl monomer.

24. The toner according to claim 23, wherein said resin P2 that forms a matrix contains a monomer having an acid-modifiable unsaturated double bond, in an amount of from 0.1% by weight to 70% by weight on the basis of said resin P2.

25. The toner according to claim 23, wherein said resin P2 that forms a matrix contains a monomer having an acid-modifiable unsaturated double bond, in an amount of from 0.3% by weight to 55% by weight on the basis of said resin P2.

26. The toner according to claim 23, wherein said acid-modified polymer has a polymer formed by acid modification of a polymer synthesized from an unsaturated diolefin monomer.

27. The toner according to claim 23, wherein said acid-modified polymer is acid-modified by an acid used in an amount of from 0.1% by weight to 50% by weight on the basis of said resin P2.

28. The toner according to claim 23, wherein said acid-modified polymer is acid-modified by an acid used in an amount of from 1% by weight to 30% by weight on the basis of said resin P2.

29. The toner according to claim 17, wherein said resin P2 that forms a matrix is cross-linked by a cross-linkable metal compound.

30. The toner according to claim 29, wherein said cross-linkable metal compound has an organic metal compound containing a metal ion.

31. The toner according to claim 29, wherein said cross-linkable metal compound has a hydroxide of a metal ion selected from the group consisting of $Na^+$, $K^+$ and $Li^+$.

32. The toner according to claim 1, wherein said resin P1 that forms domain particles has a vinyl resin synthesized from a vinyl monomer and said resin P2 that forms a matrix has a polyester.

33. The toner according to claim 32, wherein said resin P1 that forms domain particles has a polymer having an unsaturated double bond, formed from a vinyl monomer, and said resin P2 that forms a matrix is a polyester having an unsaturated double bond; said unsatutrated double bond of said resin P1 and that of said resin P2 being chemically bonded in part to each other.

34. The toner according to claim 33, wherein the glass transition temperature Tg2 of said resin P2 that forms a matrix is at least 10° C. higher than the glass transition temperature Tg1 of said resin P1 that forms domain particles.

35. The toner according to claim 34, wherein said resin P1 that forms domain particles has an acid value of not less than 15 and said resin P2 that forms a matrix has an acid value of less than 15.

36. The toner according to claim 33, wherein said resin P1 that forms domain particles contains a carboxyl group-containing vinyl monomer in an amount of from 0.1% by weight to 50% by weight on the basis of said resin P1.

37. The toner according to claim 33, wherein said resin P1 that forms domain particles contains a carboxyl group-containing vinyl monomer in an amount of from 1% by weight to 30% by weight on the basis of said resin P1.

38. The toner according to claim 33, wherein said resin P1 that forms domain particles has a polymer synthesized from an unsaturated diolefin monomer.

39. The toner according to claim 33, wherein said resin P1 that forms domain particles has an acid-modified polymer synthesized from a vinyl monomer and thereafter subjected to acid addition.

40. The toner according to claim 39, wherein said resin P1 that forms domain particles contains a monomer having an acid-modifiable unsaturated double bond, in an amount of from 0.1% by weight to 70% by weight on the basis of said resin P1.

41. The toner according to claim 39, wherein said resin P1 that forms domain particles contains a monomer having an acid-modifiable unsaturated double bond, in an amount of from 0.3% by weight to 55% by weight on the basis of said resin P1.

42. The toner according to claim 39, wherein said acid-modified polymer has a polymer formed by acid modification of a polymer synthesized from an unsaturated diolefin monomer.

43. The toner according to claim 39, wherein said acid-modified polymer is acid-modified by an acid used in an amount of from 0.1% by weight to 50% by weight on the basis of said resin P1.

44. The toner according to claim 39, wherein said acid-modified polymer is acid-modified by an acid used in an amount of from 1% by weight to 30% by weight on the basis of said resin P1.

45. The toner according to claim 32, wherein said resin P1 that forms domain particles has a polymer having a carboxyl group, synthesized from a vinyl monomer, and said resin P2 that forms a matrix has a polyester having a carboxyl group said resin P1 and resin P2 being cross-linked by a cross-linkable metal compound.

46. The toner according to claim 45, wherein the glass transition temperature Tg2 of said resin P2 that forms a matrix is at least 10° C. higher than the glass transition temperature Tg1 of said resin P1 that forms domain particles.

47. The toner according to claim 46, wherein said resin P1 that forms domain particles has an acid value of not less than 15 and said resin P2 that forms a matrix has an acid value of not less than 15.

48. The toner according to claim 45, wherein said resin P1 that forms domain particles contains a carboxyl group-containing vinyl monomer in an amount of from 0.1% by weight to 50% by weight on the basis of said resin P1.

49. The toner according to claim 45, wherein said resin P1 that forms domain particles contains a carboxyl group-containing vinyl monomer in an amount of from 1% by weight to 30% by weight on the basis of said resin P1.

50. The toner according to claim 45, wherein said resin P1 that forms domain particles has a polymer synthesized from an unsaturated diolefin monomer.

51. The toner according to claim 45, wherein said resin P1 that forms domain particles has an acid-modified polymer synthesized from a vinyl monomer and thereafter subjected to acid addition.

52. The toner according to claim 50, wherein said resin P1 that forms domain particles contains a monomer having an acid-modifiable unsaturated double bond, in an amount of from 0.1% by weight to 70% by weight on the basis of said resin P1.

53. The toner according to claim 50, wherein said resin P1 that forms domain particles contains a monomer having an acid-modifiable unsaturated double bond, in an amount of from 0.3% by weight to 55% by weight on the basis of said resin P1.

54. The toner according to claim 50, wherein said acid-modified polymer has a polymer formed by acid modification of a polymer synthesized from an unsaturated diolefin monomer.

55. The toner according to claim 50, wherein said acid-modified polymer is acid-modified by an acid used in an amount of from 0.1% by weight to 50% by weight on the basis of said resin P1.

56. The toner according to claim 50, wherein said acid-modified polymer is acid-modified by an acid used in an amount of from 1% by weight to 30% by weight on the basis of said resin P1.

57. The toner according to claim 45, wherein said cross-linkable metal compound has an organic metal compound containing a metal ion.

58. The toner according to claim 45, wherein said cross-linkable metal compound has a hydroxide of a metal ion selected from the group consisting of $Na^+$, $K^+$ and $Li^+$.

59. The toner according to claim 1, wherein said resin P1 that forms domain particles is mixed in an amount of from 3 parts by weight to 300 parts by weight based on 100 parts by weight of said resin P2 that forms a matrix.

60. The toner according to claim 1, wherein said resin P1 that forms domain particles is mixed in an amount of from 3 parts by weight to 100 parts by weight based on 100 parts by weight of said resin P2 that forms a matrix.

61. The toner according to claim 1, wherein the glass transition temperature Tg2 of said resin P2 that forms a matrix is at least 10° C. higher than the glass transition temperature Tg1 of said resin P1 that forms domain particles.

62. The toner according to claim 1, wherein said resin composition has a domain-matrix structure formed by heat-melting a resin P1 that forms domain particles and a resin P2 that forms a matrix, blending them with stirring in a molten state to form a blend solution, and further heating the blend solution to compatibilize it, followed by rapid cooling.

63. The toner according to claim 1, wherein said resin composition has a domain-matrix structure formed by synthesizing a resin P1 that forms domain particles by solution polymerization in a non-polar solvent, and thereafter synthesizing a resin P2 that forms a matrix by solution polymerization in said non-polar solvent in which said resin P1 is present.

64. The toner according to claim 1, wherein said resin composition has a domain-matrix structure formed by synthesizing a resin P2 that forms a matrix by solution polymerization in a non-polar solvent, and thereafter synthesizing a resin P1 that forms domain particles by solution polymerization in said non-polar solvent in which said resin P2 is present.

65. The toner according to claim 1, wherein said resin composition has a domain-matrix structure formed by bulk polymerization which is stopped at a stage in the course of reaction, and subjecting a polymer dissolved in unreacted monomers, to suspension polymerization or solution polymerization.

66. The toner according to claim 1, wherein said resin composition has a domain-matrix structure formed by dissolving in a non-polar solvent a resin P1 that forms domain particles and a resin P2 that forms a matrix, followed by heating and stirring to blend the resins.

67. The toner according to claim 1, wherein said resin composition has a domain-matrix structure formed by dissolving in a solvent a resin P1 that forms domain particles and a resin P2 that forms a matrix, both having no or less compatibility with each other, and cross-linking the residual double bonds thereof each other in the presence of a peroxide.

68. The toner according to claim 1, wherein said resin composition has a domain-matrix structure formed by dissolving in a solvent a resin P1 that forms domain particles and a resin P2 that forms a matrix, both having no or less compatibility with each other, followed by cross-linking in the presence of a peroxide or a radical polymerization initiator and using a vinyl monomer or a divinyl cross-linkable monomer.

69. The toner according to claim 1, wherein said resin P1 that forms domain particles has a number average molecular weight (Mn) of from 1,500 to 40,000 and a weight average molecular weight (Mw) of from 3,000 to 300,000, and said resin P2 that forms a matrix has a number average molecular weight (Mn) of from 1,500 to 20,000 and a weight average molecular weight (Mw) of from 3,000 to 50.000.

70. The toner according to claim 1, wherein said resin P1 that forms domain particles has a number average molecular weight (Mn) of from 3,500 to 30,000 and a weight average molecular weight (Mw) of from 5,000 to 100,000, and said resin P2 that forms a matrix has a number average molecular weight (Mn) of from 3,000 to 10,000 and a weight average molecular weight (Mw) of from 5,000 to 30,000.

71. The toner according to claim 1, wherein said resin P1 that forms domain particles has a number average molecular weight (Mn) of from 3,000 to 150,000 and a weight average molecular weight (Mw) of from 6,000 to 1,000,000, and said resin P2 that forms a matrix has a number average molecular weight (Mn) of from 2,000 to 50,000 and a weight average molecular weight (Mw) of from 6,000 to 250,000.

72. The toner according to claim 1, wherein said resin P1 that forms domain particles has a number average molecular weight (Mn) of from 5,000 to 100,000 and a weight average molecular weight (Mw) of from 10,000 to 700,000, and said resin P2 that forms a matrix has a number average molecular weight (Mn) of from 4,000 to 30,000 and a weight average molecular weight (Mw) of from 10,000 to 150,000.

73. The toner according to claim 1, wherein said toner particles contains a release agent.

74. The toner according to claim 73, wherein said release agent has a melt-starting temperature of of not lower than 40° C., and i) has at least two melting points in a temperature range of from 50° C. to 250° C. as measured using a DSC or ii) comprises at least two kinds of those having different melting points each other in that range said release agent being contained in said toner particles in an amount of from 0.1 part by weight to 20 parts by weight based on 100 parts by weight of the binder resin.

75. The toner according to claim I, wherein said binder resin is cross-linked by a cross-linkable metal compound.

76. The toner according to claim 1, wherein said toner particles comprise a particle on the surface of which a conductive fine powder particle is buried in the inside of the toner particle by 0.05 μm or more from the surface thereof.

77. The toner according to claim 2, wherein the glass transition temperature Tg2 of said resin P2 that forms a matrix is at least 10° C. higher than the glass transition temperature Tg1 of said resin P1 that forms domain particles.

78. The toner according to claim 2, wherein part or the whole of said resin P1 is cross-linked by a cross-linkable metal compound.

79. An image fixing method comprising passing a transfer medium bearing a toner image, through a heat-roller fixing device comprised of a fixing roller and a pressure roller each having a rubbery elastic material layer formed on a mandrel, to fix said toner image to said transfer medium, and outputting said transfer medium in the direction inclined toward the pressure roller side with respect to the direction perpendicular to a line connecting the centers of said fixing roller and said pressure roller, wherein;

said toner for forming the toner image comprises toner particles containing i) a binder resin comprising a resin composition with a domain-matrix structure and ii) a colorant;

said resin composition with a domain-matrix structure being comprised of a heat fixable resin P1 that forms domain particles and a heat fixable resin P2 that forms a matrix; said heat fixable resin P1 having a glass transition temperature Tg1 of from 15° C. to 50° C., and said heat fixable resin P2 having a glass transition temperature Tg2 of from 55° C. to 80° C., provided that the glass transition temperature Tg2 of said heat fixable resin P2 is at least 5° C. higher than the glass transition temperature Tg1 of said heat fixable resin P1; and said domain particles having an average particle diameter of not larger than 5 μm.

* * * * *

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 1

Line 6, "invention" should read --Invention--.

COLUMN 2

Line 35, "has" should be deleted.
Line 50, "On" should read --on--.

COLUMN 4

Line 20, "a" should be deleted.
Line 45, "other" should read --other,--.

COLUMN 5

Line 12, "colors" should read --colors,--.
Line 38, "en" should read --an--.
Line 61, "Of" should read --of--.

COLUMN 6

Line 5, "an" should read --and--.
Line 24, "resin P1" should read --resin P1;--.
Line 51, "comprising;" should read --comprising:--.

COLUMN 7

Line 3, "wherein;" should read --wherein:--.
Line 10, "matrix:" should read --matrix;--.
Line 50, "invention" should read --invention.--.

--

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 10

Line 57, "a more" should read --an--.
Line 66, "Of" should read --of--.

COLUMN 11

Line 58, "ma" should read --may--.

COLUMN 12

Line 3, "Of" should read --of--.
Line 9, "Of" should read --of--.
Line 26, "p-ntrostyrene;" should read --p-nitrostyrene;--.
Line 33, "acid." should read --acid,-- and
"methacrylate." should read --methacrylate,--.

COLUMN 13

Line 37, "a" should read --an--.
Line 57, "particle diameters of 5 μm" should be deleted.
Line 58, "or less." should be deleted.

COLUMN 14

Line 62, "developer" should read --developer,--.

COLUMN 15

Line 34, "ar" should read --are--.
Line 51, "particles" should read --particles.--.

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 16

Line 7, "become" should read --becomes--.
Line 46, "monoer" should read --monomer--.

COLUMN 17

Line 59, "wax" should read --wax,--.

COLUMN 18

Line 20, "monoglyceride.," should read --monoglyceride;--.

COLUMN 20

Line 16, "complexes" should read --complexes are--.

COLUMN 22

Complex (II)-5,

"

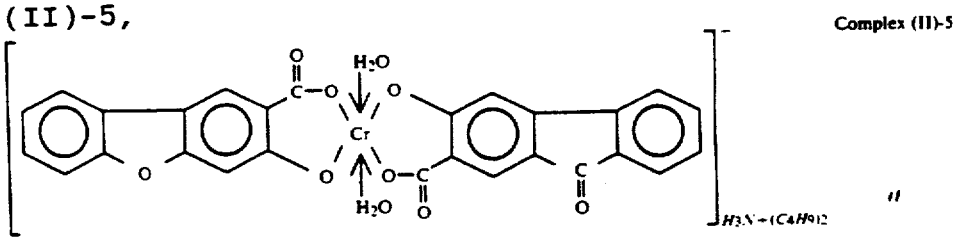

"

should read

-- Complex (II)-5

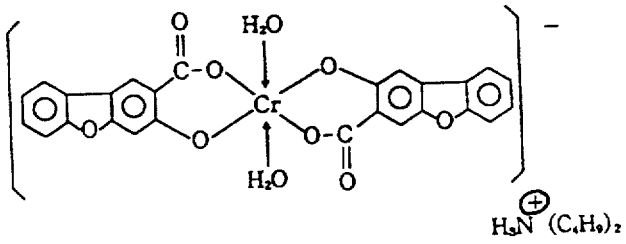

--.

--

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 24

Line 52, "Yellow," should read --yellow,--.
Line 59, "violet." should read --violet,--.
Line 60, "Lake" should read --Lake,--.

COLUMN 25

Line 65, "copolymer" should read --copolymer,--.

COLUMN 26

Line 44, "represent" should read --represents--.
Line 66, "evironment" should read --environment--.

COLUMN 28

Line 31, "MOx170," should read --MOX170,--.
Line 58, "α-chloroethyltrioh-" should read --α-chloroethyltrich- --.

COLUMN 31

Line 58, "moncohlorotrifluoroethylene" should read --monochlorotrifluoroethylene--.

COLUMN 32

Line 4, "invention" should read --invention.--.
Line 17, "70:80" should read --70:30--.
Line 30, "can'" should read --can--.
Line 33, "performances" should read --performances.--.
Line 41, "diffculty" should read --difficulty--.

--

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 33

Line 45, "vlaue" should read --value--.

COLUMN 34

Line 26, "he" should read --the--.

COLUMN 35

Line 3, "is" should read --are--.
Line 11, "apart" should read --portion--.

COLUMN 37

Line 57, "concavities" should read --concavities.--.

COLUMN 38

Line 45, "severe" should read --sleeve--.

COLUMN 39

Line 3, "blade 111" should read --blade 111,--.
Line 60, "has" should read --have--.

COLUMN 45

Line 48, "materials." should read --materials,--.

COLUMN 46

Line 55, "5,300." should read --5,300,--.

--

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 47

TABLE 6, "60.0" should read --61.0--.

COLUMN 51

TABLE 9, "k" should read --K--.

COLUMN 60

Line 52, "resin 22" should read --resin 22.--.

COLUMN 61

Line 48, "45 pm;" should read --45 μm;--.

COLUMN 63

Line 44, "materials." should read --materials,--.

COLUMN 65

TABLE 16, "TABLE 16" should read --TABLE 19--.

COLUMN 66

Line 12, "CLC-500." should read --CLC-500,--.

COLUMN 71

Line 10, "CLO-500." should read --CLC-500.--.

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 72

Line 19, "30°C." should read --130°C.--.

COLUMN 74

TABLE 27, "3800,000" should read --380,000--.

COLUMN 75

Line 61, "rang" should read --range--.

COLUMN 76

Line 16, "Of" should read --of--.
Line 22, "he" should read --the--.

COLUMN 77

Line 65, "(resin-q" should read --(resin-q)-- and "Obtained," should read --obtained,--.

COLUMN 78

Lines 16-21, Example 40 should be deleted and close up right margin.

COLUMN 79

TABLE 31, "44 SS" should read --45 SS--.

--

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 81

Line 12, ""poor")." should read --"poor"). ¶

| Example 40 | |
|---|---|
| Binder resin 37 | 100 parts |
| Magnetic iron oxide | 70 parts |
| Chromium complex of di-tert-butylsalicylic acid | 2 parts |

--.

COLUMN 84

Line 12, "disiIazane," should read --disilazane,--.

COLUMN 86

Line 1, "has" should read --was--.

COLUMN 87

Line 28, ".As" should read --As--.

COLUMN 90

Line 32, "&he" should read --the--.

COLUMN 93

Line 44, "unsatutrated" should read --unsaturated--.

COLUMN 94

Line 31, "group" should read --group;--.

UNITED STATES PATENT AND TRADEMARK OFFICE

CERTIFICATE OF CORRECTION

PATENT NO. : 5,250,382

DATED : October 5, 1993

INVENTOR(S) : MINORU SHIMOJO, ET AL.

It is certified that error appears in the above-identified patent and that said Letters Patent is hereby corrected as shown below:

COLUMN 96

Line 47, "of of" should read --of--.
Line 52, "range" should read --range;--.
Line 56, "claim I," should read --claim 1,--.

COLUMN 97

Line 14, "wherein;" should read --wherein:--.

Signed and Sealed this

Twentieth Day of September, 1994

Bruce Lehman

*Attest:*

BRUCE LEHMAN

*Attesting Officer*

*Commissioner of Patents and Trademarks*

--